US006218096B1

(12) United States Patent
Ishii et al.

(10) Patent No.: US 6,218,096 B1
(45) Date of Patent: Apr. 17, 2001

(54) SILVER HALIDE COLOR PHOTOSENSITIVE MATERIAL

(75) Inventors: Yoshio Ishii; Akira Ikeda; Fumitaka Ueda; Hiroyuki Yamagami; Yoshiharu Yabuki, all of Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/295,245

(22) Filed: Apr. 20, 1999

(30) Foreign Application Priority Data

Apr. 21, 1998 (JP) ..... 10-111197
Jul. 29, 1998 (JP) ..... 10-214195
Mar. 4, 1999 (JP) ..... 11-057097

(51) Int. Cl.[7] ..... G03C 1/46

(52) U.S. Cl. ..... 430/505; 430/573; 430/581; 430/585; 430/551

(58) Field of Search ..... 430/505, 575, 430/585, 581, 551

(56) References Cited

U.S. PATENT DOCUMENTS 5,449,594 * 9/1995 Ueda et al. ..... 430/564

FOREIGN PATENT DOCUMENTS

950922 A1 * 4/1999 (EP) .
8-95208 * 4/1996 (JP) .

OTHER PUBLICATIONS

Research Disclosure 17643, Section VII, Paragraph E, Dec. 1978.*

* cited by examiner

*Primary Examiner*—Hoa Van Le
*Assistant Examiner*—Amanda C. Walke
(74) *Attorney, Agent, or Firm*—Birch, Stewart, Kolasch & Birch, LLP

(57) ABSTRACT

A silver halide (AgX) color photosensitive material comprises, on a support, a AgX emulsion layer (BL) containing a yellow coupler and spectrally sensitized such that a spectral sensitivity region is 400 to 520 nm, a AgX emulsion layer (GL) containing a magenta coupler and spectrally sensitized such that a spectral sensitivity region is 470 to 600 nm, and a AgX emulsion layer (RL) containing a cyan coupler and spectrally sensitized such that a spectral sensitivity region is 540 to 700 nm, wherein barycentric sensitivity wavelength of a spectral sensitivity distribution of GL ($\lambda_G$), that of RL ($\lambda_R$), and that of BL ($\lambda_B$) are 520 to 580 nm, 590 to 650 nm, and 430 to 485 nm, respectively, the material further has an interlayer effect donor lay (DL) by which a barycentric wavelength ($\lambda_{-R}$) of a magnitude distribution of an interlayer effect given to at least one RL at a wavelength of 500 to 600 nm satisfies 500 nm$\leqq\lambda_{-R}\leqq$560 nm, and $\lambda_G-\lambda_{-R}\geqq$5 nm, DL is placed closer to the support than GL, and the material further has a hydrophilic colloid layer containing at least one dye, in a dispersed state of solid fine grains, represented by formula (1): A1=L–Q or (2): A2=L–A3, wherein A1 A2 and A3 each represent an acidic nucleus, Q represents an aryl or aromatic heterocyclic group, and L represents a methine group, and wherein each of and L represents a methine group.

19 Claims, 1 Drawing Sheet

SILVER HALIDE COLOR PHOTOSENSITIVE MATERIAL

BACKGROUND OF THE INVENTION

The present invention relates to a silver halide color photosensitive material and, more particularly, to a color photosensitive material having good color reproduction, high sensitivity, and high graininess and stable against processing variations.

Conventionally, the use of an interlayer inhibiting effect (interlayer effect) as means for improving the color reproduction of a color photosensitive material is known.

In a color negative sensitive material, for example, color generation of a red-sensitive layer upon exposure to white light can be inhibited compared to its color generation upon exposure to red light by giving a development inhibiting effect from a green-sensitive layer to the red-sensitive layer. Similarly, a development inhibiting effect from a red-sensitive layer to a green-sensitive layer gives reproduction of green with a high degree of saturation.

When the saturation of three primary colors, i.e., red, green, and blue is increased by using these methods, the hue of a color from yellow to cyanic green becomes unfaithful. As a countermeasure against this drawback, a technique described in Jpn. Pat. Appln. KOKOKU Publication No. (hereinafter referred to as JP-B-)03-10287 is proposed. This technique is to achieve vivid and faithful color reproduction by using a silver halide color photosensitive material comprising, on a support, at least one blue-sensitive silver halide emulsion layer containing a color coupler which generates yellow, at least one green-sensitive silver halide emulsion layer containing a color coupler which generates magenta, and at least one red-sensitive silver halide emulsion layer containing a color coupler which generates cyan, characterized in that the barycentric sensitivity wavelength (barycenter $\lambda_G$) of the spectral sensitivity distribution of the green-sensitive layer is 520 nm≦barycenter $\lambda_G$≦580 nm, the barycentric wavelength (barycenter $\lambda_{-R}$) of the magnitude distribution of an interlayer effect given to at least one red-sensitive silver halide emulsion layer from another layer at a wavelength of 500 to 600 nm is 500 nm<barycenter $\lambda_{-R}$≦600 nm, and barycenter $\lambda_G$-barycenter $\lambda_{-R}$≧5 nm.

Unfortunately, a sensitive material thus obtained was unsatisfactory in terms of the graininess of a green-sensitive layer. This is considered to be due to the fact that an interlayer effect donor layer and yellow filter layer cut off light near 500 nm more than needed.

Jpn. Pat. Appln. KOKAI Publication No. (hereinafter referred to as JP-A-)6-175289 has disclosed a silver halide color photosensitive material having a yellow filter layer containing a specific oil-soluble dye and a silver halide emulsion layer which gives an interlayer effect to the red-sensitive layer.

This JP-A-6-175289, however, has not disclosed a method of preventing the interlayer effect donor layer from shielding a green-sensitive layer from light. Also, this photosensitive material has another problem that variations in decoloration of the oil-soluble dye vary the photographic properties.

In the field of color photosensitive materials, it is known that the properties of photographic images greatly improve by releasing a photographically useful silver group image-wise at the same time a silver image is formed.

For example, a DIR coupler releases a development inhibitor by coupling with an oxidized form of a developing agent upon development, thereby achieving functions of, e.g., improving the graininess of a color image, improving the sharpness by an edge effect, and improving the color reproduction by diffusion of the inhibitor to other layers. These functions are described in detail in, e.g., U.S. Pat. No. 4,248,962 and JP-A-5-313322.

As described above, development inhibitor releasing couplers contribute to improvements of the quality and sensitivity of a color image. However, these couplers release a development inhibitor by coupling with an oxidized form of a developing agent and at the same time form an azomethine dye. Therefore, these couplers sometimes have an adverse effect on the color reproduction of a color image. This is a large cause of limitations on the versatility, use amount, and molecular design of these DIR couplers. For example, to give a satisfactory interlayer effect from a green-sensitive layer to blue- and red-sensitive layers, a DIR coupler for forming a magenta generating dye alone does not have enough activity. So, it is necessary to combine a high-activity yellow generating DIR coupler and cyan generating DIR coupler. This is unpreferable in terms of color mixing and variations in development processing conditions.

A method of solving these problems is known which uses a redox reaction with an oxidized form of a developing agent as means for releasing a development inhibitor with no dye formation. Examples are DIR-hydroquinones described in, e.g., JP-A-49-129536 and U.S. Pat. No. 4,377,643; DIR-aminophenols described in, e.g., JP-A-52-57828; p-nitrobenzyl derivatives described in, e.g., EP45129; and hydrazine derivatives described in, e.g., JP-A-8-211542. Unfortunately, compared to the functional couplers described above, these redox compounds generally have low stability with time in a sensitive material and are slow to release a development inhibitor after the redox reaction.

Also, couplers, i.e., non-dye-forming couplers, capable of releasing a development inhibitor by coupling with an oxidized form of a developing agent without essentially forming a dye are described in, e.g., JP-B-52-46817 and U.S. Pat. No. 4,315,070. Furthermore, some couplers, i.e., flow-out couplers, release a development inhibitor by coupling with an oxidized form of a developing agent and at the same time form a dye, but this dye formed flows out into a processing solution during processing of photographs. These couplers are described in, e.g., JP-B-1-52742, JP-A-4-356042, and JP-A-8-44011. However, the former non-dye-forming couplers have low coupling activity and are not stable enough. The latter flow-out couplers tend to lower the interlayer effect when used as a DIR coupler, because a nondiffusible group is introduced into a split-off group. Accordingly, it is being desired to further improve the molecular design of these couplers.

BRIEF SUMMARY OF THE INVENTION

It is, therefore, the first object of the present invention to provide a silver halide photosensitive material which has good color reproduction, high sensitivity, and high graininess and causes processing variations little.

It is the second object of the present invention to provide a silver halide photosensitive material which changes the sensitivity little during storage from manufacture to photographing.

The above objects of the present invention are achieved by (1) to (3) below.

(1) A silver halide color photosensitive material comprising, on a support, at least one silver halide emulsion layer (BL) containing a yellow coupler and spectrally sensitized such that a spectral sensitivity region is 400 to 520 nm, at least one silver halide emulsion layer (GL) containing a magenta coupler and spectrally sensitized such that a spectral sensitivity region is 470 to 600 nm, and at least one silver halide emulsion layer (RL) containing a cyan coupler and spectrally sensitized such that a spectral sensitivity region is 540 to 700 nm; wherein a barycentric sensitivity wavelength ($\lambda_G$) of a spectral sensitivity distribution of GL is 520 nm to 580 nm; a barycentric sensitivity wavelength ($\lambda_R$) of a spectral sensitivity distribution of RL is 590 nm to 650 nm; a barycentric sensitivity wavelength ($\lambda_B$) of a spectral sensitivity distribution of BL is 430 nm to 485 nm; the photo-sensitive material further has an interlayer effect donor layer (DL) by which a barycentric wavelength ($\lambda_{-R}$) of a magnitude distribution of an interlayer effect given to at least one RL at a wavelength of 500 to 600 nm satisfies 500 nm$\leqq\lambda_{-R}\leqq$560 nm, and $\lambda_G-\lambda_{-R}\geqq$5 nm; DL is placed closer to the support than GL; and the photosensitive material further has a hydrophilic colloid layer containing at least one dye, in a dispersed state of solid fine grains, selected from the group consisting of dyes represented by formula (1) below and dyes represented by formula (2) below:

$$A1=L-Q \tag{1}$$

wherein A1 represents an acidic nucleus; Q represents an aryl group or aromatic heterocyclic group; and L represents a methine group; and $$A2=L-A3 \tag{2}$$

wherein each of A2 and A3 represents an acidic nucleus; and L represents a methine group.

(2) The photosensitive material described in item (1) above, wherein RL, DL, GL, and the hydrophilic colloid layer are formed by coating in an order named on the support from a side closest to the support.

(3) The photosensitive material described in item (1) or (2) above, wherein the photosensitive material further has at least one compound selected from the group consisting of compounds presented by formula (DI) below and compounds represented by formula (D2) below:

$$A-X \tag{D1}$$

$$A'-B-X \tag{D2}$$

wherein A represents a group which releases X by reacting with an oxidized form of a developing agent and generates a processing solution-soluble or noncolor-forming compound; A' represents a coupler moiety capable of coupling with the oxidized form of a developing agent; B represents a linking group having an electrophilic portion and capable of releasing X, along with forming a ring and without forming a dye, by intramolecular nucleophilic substitution between the electrophilic portion and a nitrogen atom that is originated from the developing agent and that is contained in a product of the reaction of A' with the oxidized form of the developing agent; and X represents a development inhibitor or a precursor moiety thereof.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A barycentric wavelength $\lambda_{-R}$ of the wavelength distribution of the magnitude of an interlayer effect given to a silver halide emulsion layer (RL, to be also referred to as a "red-sensitive layer" hereinafter), which contains a cyan coupler and is so spectrally sensitized that the spectral sensitivity region is 540 to 700 nm, from another silver halide emulsion layer at a wavelength of 500 to 600 nm is obtained as follows.

(1) First, by using a red filter that transmits wavelengths higher than a specific wavelength or an interference filter which transmits the specific wavelength, such that a red-sensitive layer for generating cyan at a wavelength of 600 nm or more is sensitized and other layers are not sensitized, uniform exposure is given to evenly fog the cyan generating red-sensitive layer to an appropriate value.

(2) Spectral exposure is then performed. Consequently, a silver halide emulsion layer (BL, to be also referred to as a "blue-sensitive layer" hereinafter) containing a yellow coupler and so spectrally sensitized that the spectral sensitivity region is 400 to 520 nm and a silver halide emulsion layer (GL, to be also referred to as a "green-sensitive layer" hereinafter) containing a magenta coupler and so spectrally sensitized that the spectral sensitivity region is 470 to 600 nm give a development inhibiting interlayer effect to the fogged red-sensitive emulsion layer, thereby forming a reversal image.

Figure 1A:
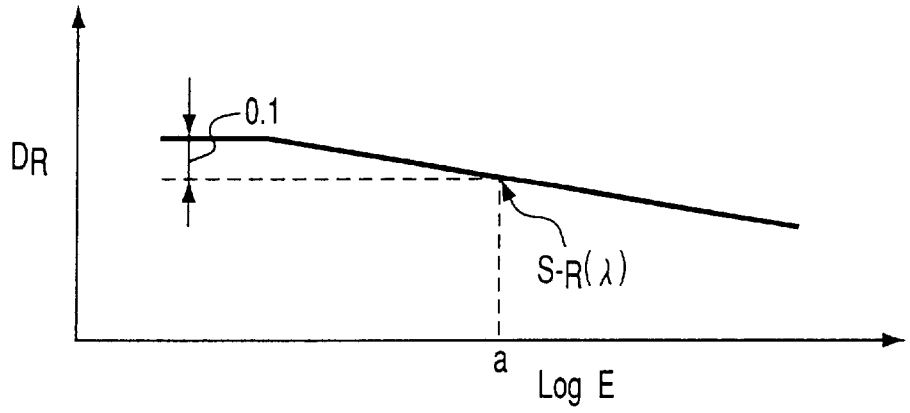
FIG. 1A is a view showing the spectral sensitivity distribution curve of a red-sensitive layer.

(3) From this reversal image, a spectral sensitivity distribution $S_{-R}(\lambda)$ as a reversal sensitive material is obtained. $S_{-R}(\lambda)$ for a specific wavelength $\lambda$ is obtained relatively at a corresponding point of a point a shown in FIG. 1A.

(4) The barycentric wavelength ($\lambda_{-R}$) of the interlayer effect is calculated by equation (L) below:

$$\lambda_{-R}=\frac{\int_{500\,\mathrm{nm}}^{600\,\mathrm{nm}}\lambda\cdot S_{-R}(\lambda)d\lambda}{\int_{500\,\mathrm{nm}}^{600\,\mathrm{nm}}S_{-R}(\lambda)d\lambda} \tag{L}$$

The above barycentric wavelength, $\lambda$ G, is given by the following formula:

$$\lambda_G=\frac{\int_{500\,\mathrm{nm}}^{600\,\mathrm{nm}}\lambda\cdot S_G(\lambda)d\lambda}{\int_{500\,\mathrm{nm}}^{600\,\mathrm{nm}}S_G(\lambda)d\lambda}$$

Figure 1B:
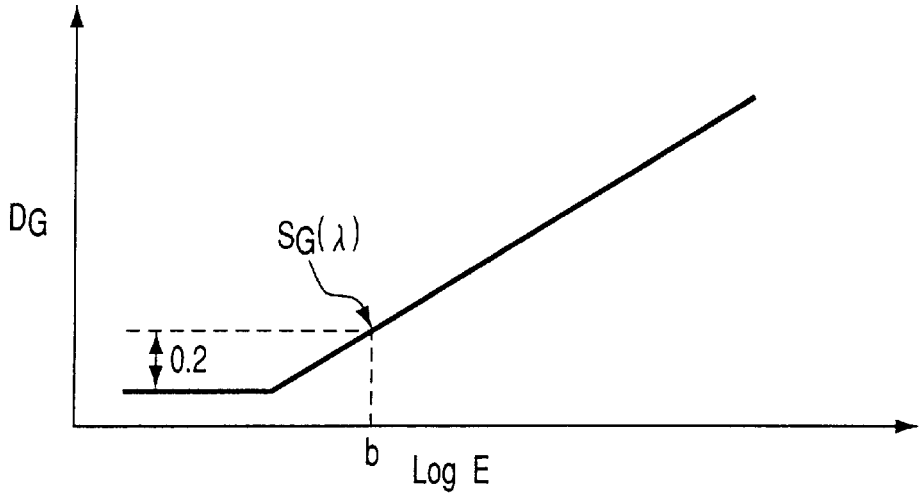
FIG. 1B is a view showing the spectral sensitivity distribution curve of a green-sensitive layer.

In the equation, $S_G(\lambda)$ is the spectral sensitivity distribution curve of a green-sensitive layer. A relative value of $S_G(\lambda)$ of the specific wavelength $\lambda$ is calculated from a point b shown in FIG. 1B.

The dye represented by formula (1): A1=L–Q will be described below.

A1 and Q are linked by a methine linking group. Examples of A1 are acidic nuclei derived from benzoylacetonitrile, α-cyanoacetanilide, 2-phenyl-1,1,3-tricyanopropene, 5-pyrazolone, isoxazolone, barbituric acid, thiobarbituric acid, pyrazolopyridone, rhodanine, hydantoin, thiohydantoin, oxazolidinedione, pyrazolidinedione, indandione, hydroxypyridone, 1,2,3,4-tetrahydroquinoline-2,4-dione, 3-oxo-2,3-dihydrobenzo[d]thiophene-1,1,-dioxide, 3-dicyanomethylene-2,3-dihydrobenzo[d]thiophene-1,1-dioxide, 3-cyano-(2H,5H)dihydrofuran-2-one.

More specifically, preferable examples of A1 are 2-cyano-acetophenone-2-iridene, 2-cyano-acetanilido-2-iridene, 2-phenyl-1,1,3-tricyano-1-propene-3-iridene, 3H-pyrazole-3-one-4-indene, 5(4H)-isoxazolone-4-iridene, 2,4,6(1H,3H,5H)-pyrimidinetrione-5-iridene, dihydro-2-thioxo-4,6(1H,5H)-pyrimidinedione-5-iridene, 1H-pyrazolo[3,4,-b]pyridine-3,6(2H,5H)-dione-5-iridene, rhodanine-5-iridene, hydantoin-5-iridene, 2-thiohydantoin-5-iridene, oxazolidine-2,4-dione-5-iridene, pyrazolidine-3,5-dione-4-iridene, indane-1,3-dione-2-iridene, 6-oxo-2(3H,6H)pyridone-3-iridene, 1,2,3,4-tetrahydroquinoline-2,4-dione-3-iridene, 3-oxo-2,3-dihydrobenzo[d]thiophene-1,1-dioxide-2-iridene, 3-dicyanomethylene-2,3-dihydrobenzo[d]thiophene-1,1-dioxide-2-iridene, and 3-cyano-(2H,5H)dihydrofuran-2-one-5-iridene.

More preferable examples are 2-cyano-acetophenone-2-iridene, 3H-pyrazole-3-one-4-iridene, 6-oxo-2(3H,6H)pyridone-3-iridene, 3H-isoxazole-3-one-4-iridene, 2,4,6(1H,3H,5H)-pyrimidinetrione-5-iridene, 1H-pyrazolo[3,4,-b]pyridine-3,6(2H,5H)-dione-5-iridene, pyrazolidine-3,5-dione-4-iridene, and 3-cyano-(2H,5H)dihydrofuran-2-one-5-iridene, and 3H-pyrazole-3-one-4-iridene is especially preferable. A1 preferably contains at least one dissociative group having a pKa of 3 to 11, e.g., a carboxyl group, sulfonamide group, sulfamoyl group, and phenolic hydroxyl group.

When Q represents an aryl group, a substituted or nonsubstituted phenyl group or a substituted or nonsubstituted naphthyl group is preferable, and a substituted phenyl group whose p-position is substituted by a hetero atom is especially preferable. Preferable examples of the substituent are an alkyl group (e.g., methyl and ethyl), amino group (e.g., nonsubstituted amino, dimethylamino, diethylamino, and bis(ethoxycarbonylmethyl)amino), alkoxy group (e.g., methoxy, ethoxy, and methoxyethoxy), hydroxyl group, and nitrogen-containing saturated heterocyclic group (e.g., piperidino and morpholino). These substituents can form a ring by combining with each other or with a phenyl group.

When Q represents an aromatic heterocyclic group, Q is a 5- or 6-membered aromatic heterocyclic group composed of at least one carbon atom and at least one hetero atom selected from the hetero atom group consisting of an oxygen atom, nitrogen atom, and sulfur atom. A substituted or nonsubstituted benzene ring can also be condensed to this aromatic heterocyclic group.

Preferable examples of the aromatic heterocyclic ring are 3-pyrrolyl, 3-indolyl, 3-carbozolyl, 4-pyrazolyl, 2-furyl, 2-thienyl, and 4-isoxazolyl, and 3-pyrrolyl, 3-indolyl, and 2-furyl are particularly preferable. This aromatic heterocyclic ring can further have a substituent. Preferable examples of this substituent are an alkyl group (e.g., methyl, ethyl, cyanomethyl, and methoxycarbonylmethyl), amino group (e.g., nonsubstituted amino, dimethylamino, diethylamino, and bis(ethoxycarbonylmethyl)amino), alkoxy group (e.g., methoxy, ethoxy, and methoxyethoxy), hydroxyl group, nitrogen-containing saturated heterocyclic group (e.g., piperidino and morpholino), sulfonamide group (e.g., methanesulfonamide, butanesulfonamide, and benzenesulfonamide), sulfamoyl group (e.g., phenylsulfamoyl and acetylsulfamoyl), carboxyl group, cyano group, and halogen atom (e.g., chlorine and bromine).

The methine group represented by L can have a substituent, and an example of this substituent is an alkyl group (e.g., a methyl group and ethyl group). L is preferably a nonsubstituted methine group.

A compound represented by formula (1) is more preferably a compound represented by formula (3) or (4) below:

(3)

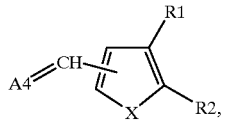

(4)

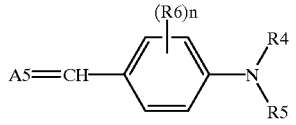

Formula (3) will be described below.

A4 represents an acidic nucleus having the same meaning as A1 in formula (1). X represents an oxygen atom, sulfur atom, or N—Y, wherein Y represents a hydrogen atom, substituted or nonsubstituted alkyl group, substituted or nonsubstituted aryl group, or substituted or nonsubstituted heterocyclic group. Each of R1 and R2 independently represents a hydrogen atom or substituent. R1 and R2 can combine with each other to form a condensed ring.

In the following definition of R1 and R2, the carbon atoms of a substituent mean those of the substituent assuming the substituent is an unsubstituted group. Specifically, the number of carbon atoms of an alkyl group having a substituent does not include the number of carbon atoms of the substituent attached to the alkyl group. The same rule applies correspondingly to the other groups represented by R1 and R2.

Examples of the substituent represented by each of R1 and R2 are a 1- to 8-carbon substituted or nonsubstituted alkyl group (e.g., methyl, ethyl, propyl, isopropyl, n-butyl, isobutyl, sec-butyl, t-butyl, cyclohexyl, methoxyethyl, ethoxyethyl, ethoxycarbonylmethyl, ethoxycarbonylethyl, cyanoethyl, diethylaminoethyl, hydroxyethyl, chloroethyl, and acetoxyethyl), 2- to 8-carbon substituted or nonsubstituted alkenyl group (e.g., vinyl, allyl, and 1-butenyl), 7- to 12-carbon substituted or nonsubstituted aralkyl group (e.g., benzyl and 2-carboxybenzyl), 6- to 18-carbon substituted or nonsubstituted aryl group (e.g., phenyl, 4-methylphenyl, 4-methoxyphenyl, 4-carboxyphenyl, and 3,5-dicarboxyphenyl), 2- to 6-carbon substituted or nonsubstituted acyl group (e.g., acetyl, propionyl, butanoyl, and chloroacetyl), 1- to 8-carbon substituted or nonsubstituted sulfonyl group (e.g., methanesulfonyl and p-toluenesulfonyl), 2- to 6-carbon alkoxylcarbonyl group (e.g., methoxycarbonyl and ethoxycarbonyl), 7- to 12-carbon aryloxycarbonyl group (e.g., phenoxycarbonyl, 4-methylphenoxycarbonyl, and 4-methoxyphenoxycarbonyl), 1- to 4-carbon substituted or nonsubstituted alkoxy group (e.g., methoxy, ethoxy, n-butoxy, and methoxyethoxy), 6- to 10-carbon substituted or nonsubstituted aryloxy group (e.g., phenoxy and 4-methoxyphenoxy), 2- to 8-carbon substituted or nonsubstituted acyloxy group (e.g., acetoxy, ethylcarbonyloxy, cyclohexylcarbonyloxy, benzoyloxy, and chloroacetyloxy), 1- to 6-carbon substituted or nonsubstituted sulfonyloxy group (e.g., methanesulfonyloxy), 2- to 8-carbon carbamoyloxy group (e.g., methylcarbamoyloxy and diethylcarbamoyloxy), 0- to 8-carbon substituted or nonsubstituted amino group (e.g., nonsubstituted amino, methylamino, dimethylamino, diethylamino, phenylamino, methoxyphenylamino, chlorophenylamino, morpholino, piperidino, pyrrolidino, pyridylamino, methoxycarbonylamino, n-butoxycarbonylamino, phenoxycarbonylamino, methylcarbamoylamino, phenylcarbamoylamino, acetylamino, ethylcarbonylamino, cyclohexylcarbonylamino, benzoylamino, chloroacetylamino, and methylsulfonylamino), 1- to 8-carbon substituted or nonsubstituted carbamoyl group (e.g., nonsubstituted carbamoyl, methylcarbamoyl, ethylcarbamoyl, n-butylcarbamoyl, t-butylcarbamoyl, dimethylcarbamoyl, morpholinocarbamoyl, and pyrrolidinocarbamoyl), 1- to 8-carbon substituted or nonsubstituted sulfonamide group (e.g., methanesufonamide and p-toluenesulfonamide), halogen atom (e.g., fluorine, chlorine, and bromine), hydroxyl group, nitro group, cyano group, and carboxyl group.

R1 and R2 each preferably represent a hydrogen atom or a substituent selected from an alkyl group and aryl group or combine with each other to form a benzo condensed ring. The formed benzene ring can further have a substituent that is mentioned as the substituent represented by R1 and R2, on it.

Formula (4) will be described below.

A5 represents an acidic nucleus having the same meaning as A1 in formula (1). Each of R4 and R5 represents a hydrogen atom, substituted or nonsubstituted alkyl group, or substituted or nonsubstituted aryl group. The alkyl group and the aryl group represented by R4 and R5 are the same as those defined for R1 and R2, respectively. R6 represents a substituent having the same meaning as R1 and R2. n represents an integer from 0 to 4. When n is an integer from 2 to 4, R6's can be the same or different, and two R6's can combine with each other to form a condensed ring. The thus formed condensed ring can further have a substituent that is mentioned as the substituent represented by R1 and R2, on it.

Formula (5) below is particularly preferable:

(5)

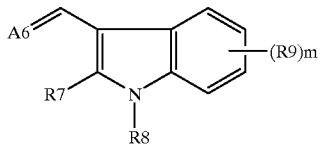

In formula (5), A6 represents an acidic nucleus having the same meaning as A1 in formula (1). In the following definition of R7 to R9, the total carbon atoms of a substituent mean all the carbon atoms of the substituent. Specifically, the number of carbon atoms of an alkyl group having a substituent includes the number of carbon atoms of the substituent attached to the alkyl group. The same rule applies correspondingly to the other groups represented by R7 to R9.

R7 represents a hydrogen atom or substituent. R9 represents a substituent. m represents an integer from 0 to 4. When m is an integer from 2 to 4, R9's can be the same or different. R8 represents a hydrogen atom or 1- to 8-total carbon substituted or nonsubstituted alkyl group. R8 more preferably represents a 1- to 6-carbon alkyl group substituted by an electrophilic group whose Hammett's substituent constant a m is 0.3 to 1.5. Examples of this electrophilic group whose Hammett's substituent constant σ m (described in, e.g., Chem. Rev., 91, 165(1991), the disclosure of which is herein incorporated by reference) is 0.3 to 1.5, are a halogen atom (e.g., a fluorine atom (σm=0.34 (hereinafter, σm of each substituent is set forth in parentheses)), chlorine atom (0.37), bromine atom (0.39), and iodine atom (0.35)), trifluoromethyl group (0.43), cyano group (0.56), formyl group (0.35), acyl group (e.g., acetyl (0.38)), acyloxy group (e.g., acetoxy (0.39)), carboxyl group (0.37), alkoxycarbonyl group (e.g., methoxycarbonyl (0.37)), aryloxycarbonyl group (e.g., phenoxycarbonyl (0.37)), alkylcarbamoyl group (e.g., methylcarbamoyl (0.35)), nitro group (0.71), alkylsulfinyl group (e.g., methylsulfinyl (0.52)), alkylsulfonyl group (e.g., methylsulfonyl (0.60)), and sulfamoyl group (0.53). An alkoxycarbonyl group or cyano group is preferable, and an alkoxycarbonyl group is more preferable.

Examples of the substituent represented by each of R7 and R9 are a 1- to 8-total carbon substituted or nonsubstituted alkyl group (e.g., methyl, ethyl, propyl, isopropyl, n-butyl, isobutyl, sec-butyl, t-butyl, cyclohexyl, methoxyethyl, ethoxyethyl, ethoxycarbonylmethyl, ethoxycarbonylethyl, cyanoethyl, diethylaminoethyl, hydroxyethyl, chloroethyl, and acetoxyethyl), 7- to 12-total carbon substituted or nonsubstituted aralkyl group (e.g., benzyl and 2-carboxybenzyl), 6- to 18-total carbon substituted or nonsubstituted aryl group (e.g., phenyl, 4-methylphenyl, 4-methoxyphenyl, 4-carboxyphenyl, and 3,5-dicarboxyphenyl), 2- to 6-total carbon substituted or nonsubstituted acyl group (e.g., acetyl, propionyl, butanoyl, and chloroacetyl), 1- to 8-total carbon substituted or nonsubstituted sulfonyl group (e.g., methanesulfonyl and p-toluenesulfonyl), 2- to 6-total carbon alkoxylcarbonyl group (e.g., methoxycarbonyl and ethoxycarbonyl), 7- to 12-total carbon aryloxycarbonyl group (e.g., phenoxycarbonyl, 4-methylphenoxycarbonyl, and 4-methoxyphenoxycarbonyl), 1- to 4-total carbon substituted or nonsubstituted alkoxy group (e.g., methoxy, ethoxy, n-butoxy, and methoxyethoxy), 6- to 10-total carbon substituted or nonsubstituted aryloxy group (e.g., phenoxy and 4-methoxyphenoxy), 2- to 8-total carbon substituted or nonsubstituted acyloxy group (e.g., acetoxy, ethylcarbonyloxy, cyclohexylcarbonyloxy, benzoyloxy, and chloroacetyloxy), 1- to 6-total carbon substituted or nonsubstituted sulfonyloxy group (e.g., methanesulfonyloxy), 2- to 8-total carbon carbamoyloxy group (e.g., methylcarbamoyloxy and diethylcarbamoyloxy), 0- to 8-total carbon substituted or nonsubstituted amino group (e.g., nonsubstituted amino, methylamino, dimethylamino, diethylamino, phenylamino, methoxyphenylamino, chlorophenylamino, morpholino, piperidino, pyrrolidino, pyridylamino, methoxycarbonylamino, n-butoxycarbonylamino, phenoxycarbonylamino, methylcarbamoylamino, phenylcarbamoylamino, acetylamino, ethylcarbonylamino, cyclohexylcarbonylamino, benzoylamino, chloroacetylamino, and methylsulfonylamino), 1- to 8-total carbon substituted or nonsubstituted carbamoyl group (e.g., nonsubstituted carbamoyl, methylcarbamoyl, ethylcarbamoyl, n-butylcarbamoyl, t-butylcarbamoyl, dimethylcarbamoyl, morpholinocarbamoyl, and pyrrolidinocarbamoyl), 1- to 8-total carbon substituted or nonsubstituted sulfonamide group (e.g., methanesufonamide and p-toluenesulfonamide), halogen atom (e.g., fluorine, chlorine, and bromine), hydroxyl group, nitro group, cyano group, and carboxyl group.

R7 is preferably a hydrogen atom or a group selected from an alkyl group, aryl group, alkoxycarbonyl group, and aryloxycarbonyl group. R7 is especially preferably a hydrogen atom.

m is preferably 0, 1, or 2. When m=1 or 2, R9 is preferably a group selected from an alkyl group, aryl group, amino group, alkoxy group, acyloxy group, carbamoyl group, sulfonamide group, halogen atom, nitro group, and carboxyl group. m=0 is especially preferable.

Preferable combinations of A6, R7 to R9 and m are as follows: A6 is 2-cyano-acetophenone-2-iridene, 3H-pyrazole-3-one-4-iridene, 6-oxo-2(3H,6H)-pyridone-3-iridene, 3H-isoxazole-3-one-4-iridene, 2,4,6(1H,3H,5H)-pyrimidinetrione-5-iridene, 1H-pyrazolo[3,4,-b]pyridine-3,6(2H,5H)-dione-5-iridene, pyrazolidine-3,5-dione-4-iridene, or 3-cyano-(2H,5H)dihydrofuran-2-one-5-iridene, R7 is a hydrogen atom, R9 is a hydrogen atom or alkyl group, and R8 is a hydrogen atom or an alkyl group substituted by an electrophilic group whose Hammett's substituent constant σm is 0.3 to 1.5. Especially preferable combinations are A6 is 2-cyano-acetophenone-2-iridene or 3H-pyrazol-3-one-4-iridene, m=0, R7 is a hydrogen atom, and R8 is a hydrogen atom, alkoxycarbonylmethyl group, or cyanomethyl group.

Compounds disclosed in, e.g., Resisted Japanese Patent No. 2649980 (corresponding U.S. Pat. No. is 5,213,957), JP-A-8-50345, JP-A-7-92613, JP-A-5-86056, EP775938A1, EP524594A, U.S. Pat. Nos. 5,776,667, 4,923,788, 4,950,586, 4,948,717, 4,857,446, and 4,764,455, the disclosures of which are herein incorporated by reference, are preferably used. Any of these dyes is sparingly soluble in water having pH 5 to 7 and can dye a specific layer when dispersed as fine solid grains or as an emulsion. These dyes are especially preferably used in a dispersed state of fine solid grains.

Practical examples of compounds used in the present invention will be presented below. However, the present invention is not limited to these examples.

1.

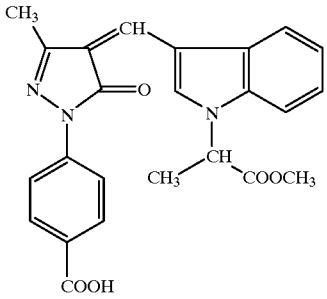

2.

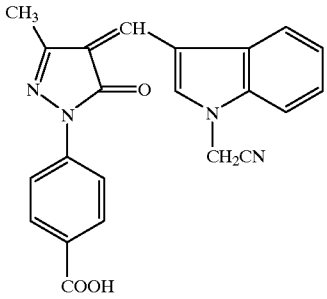

3.

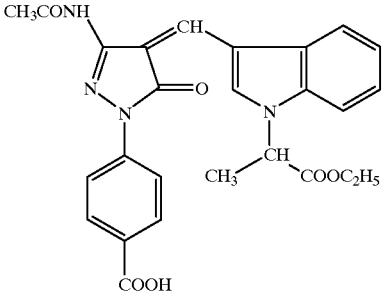

4.

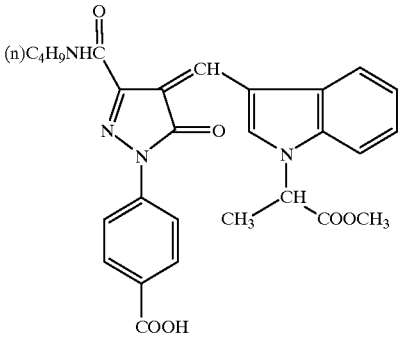

5.

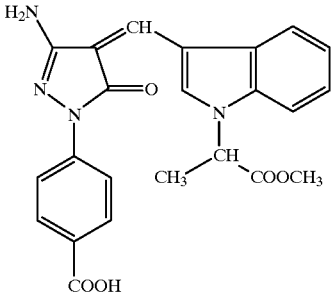

6.

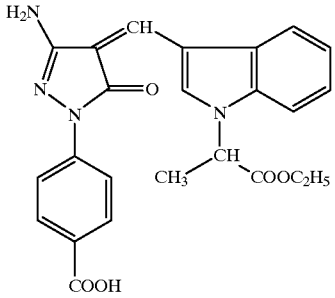

-continued
7.
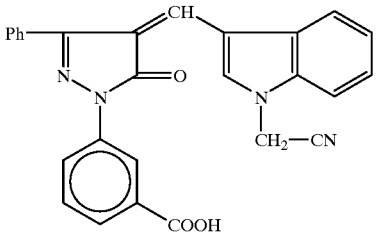
8.
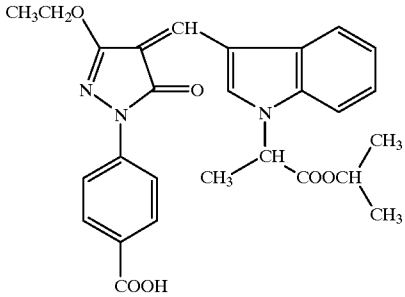
9.
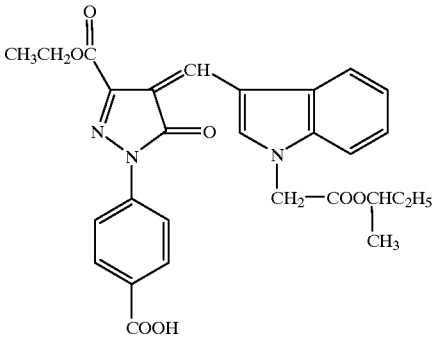
10.
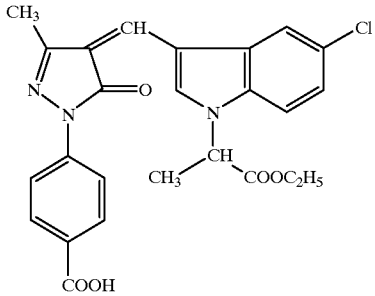
11.
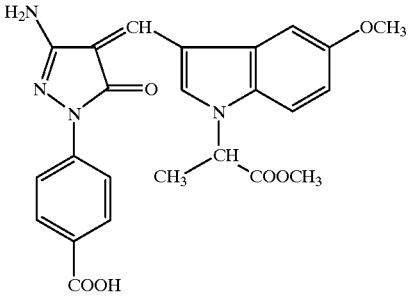
12.
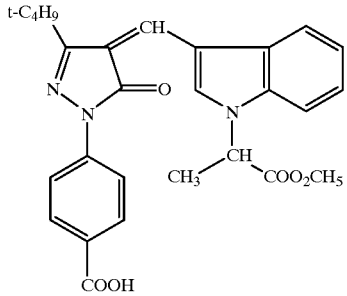
13.
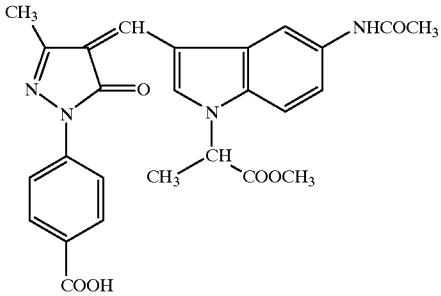
14.
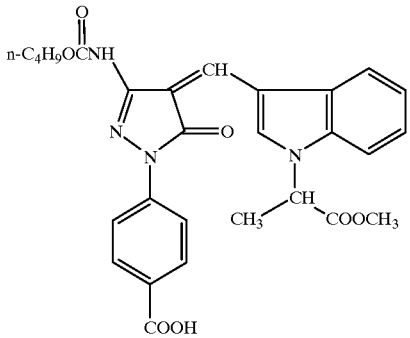
15.
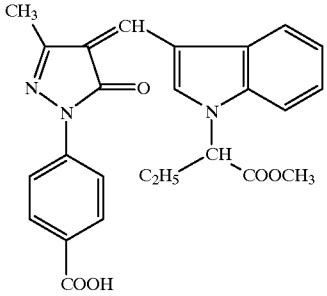
16.
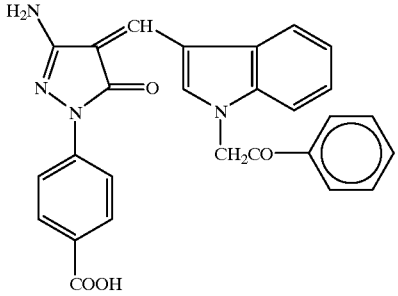

-continued
17.
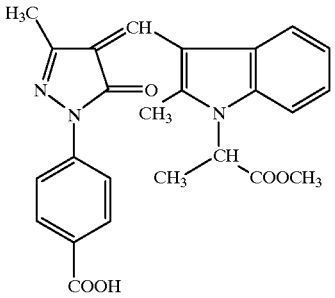
18.
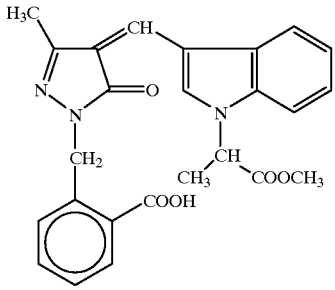
19.
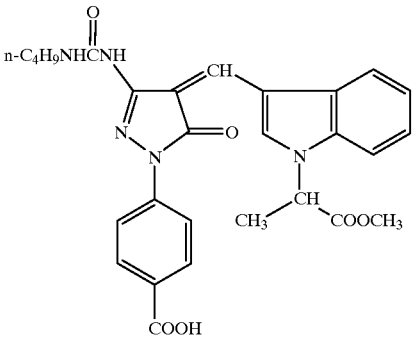
20.
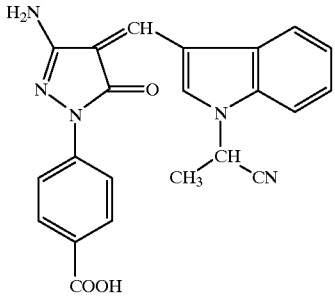
21.
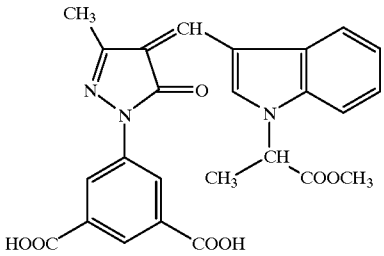
22.
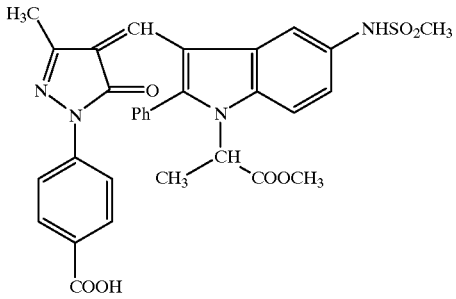
23.
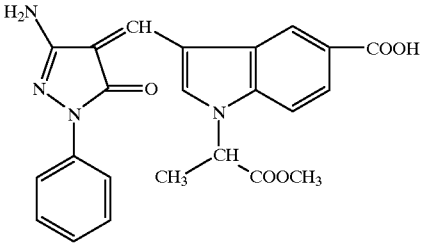
24.
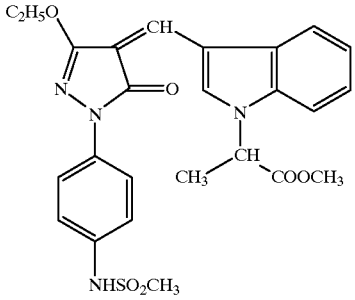
25.
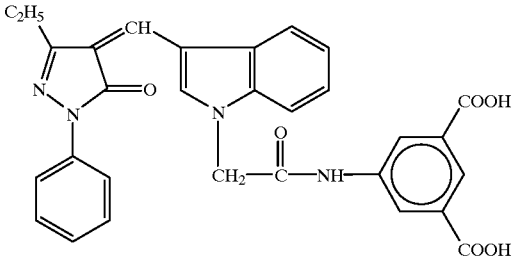
26.
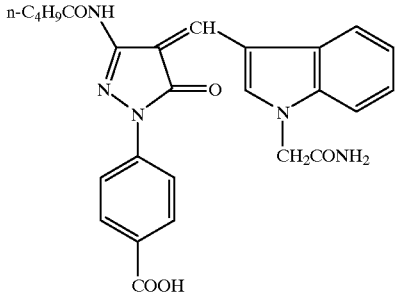

-continued
27.
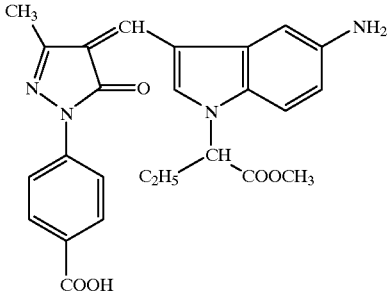
28.
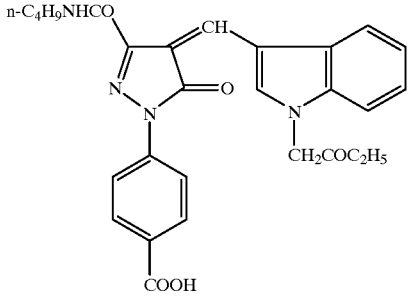
29.
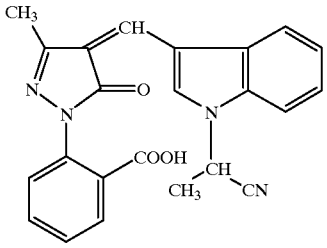
30.
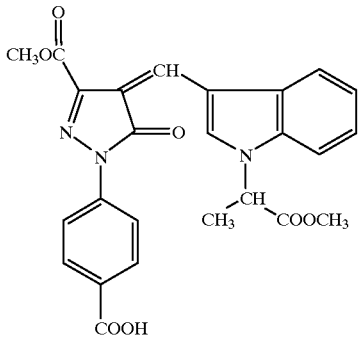
31.
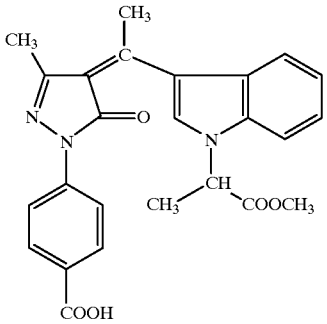
32.
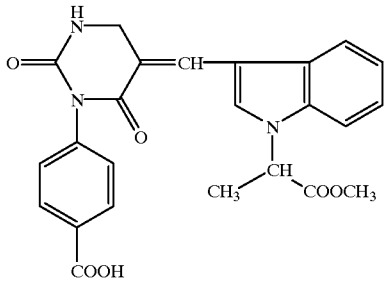
33.
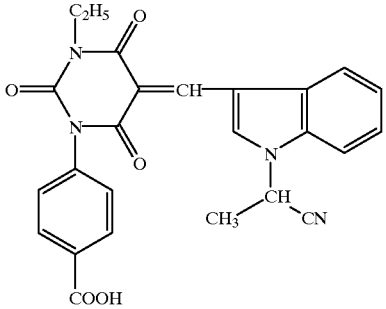
34.
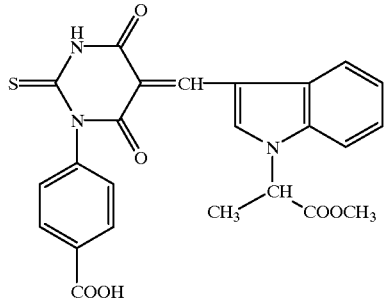
35.
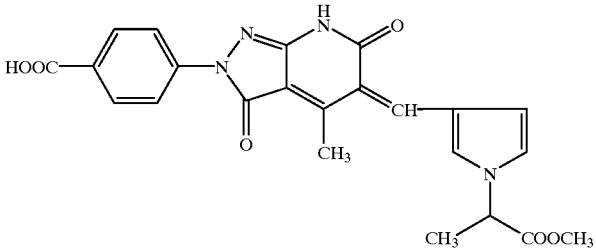

-continued
36.
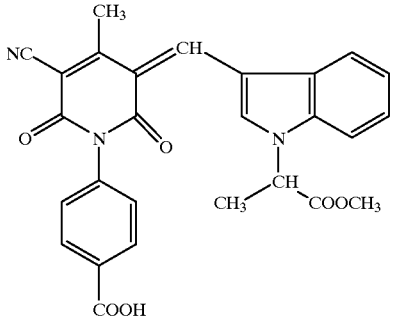
37.
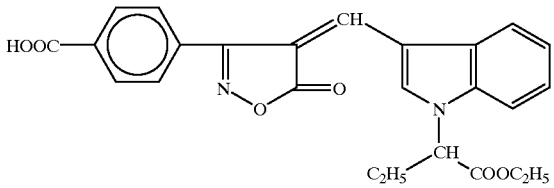
38.
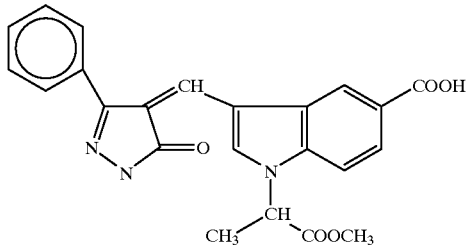
39.
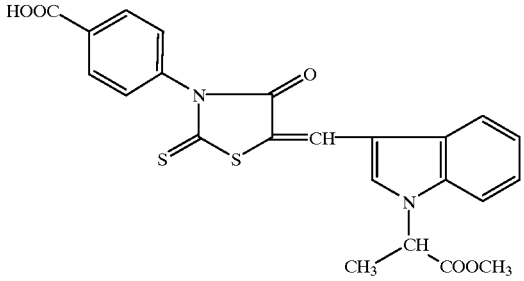
40.
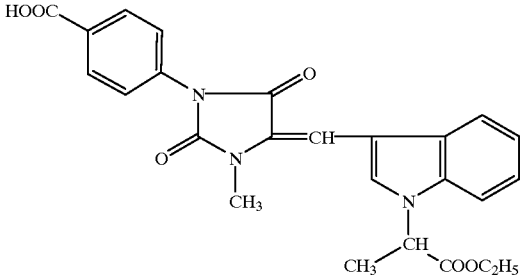
41.
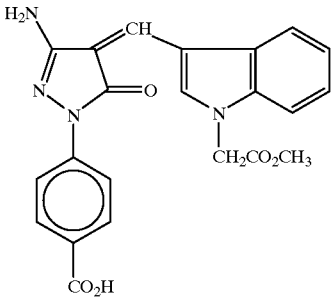
42. R = —NHSO$_2$CH$_3$
43. R = —CO$_2$H
44. R = —OH
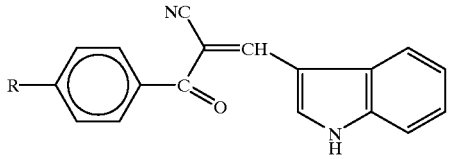
45.
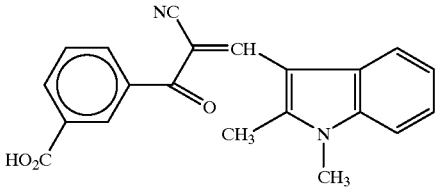
46.
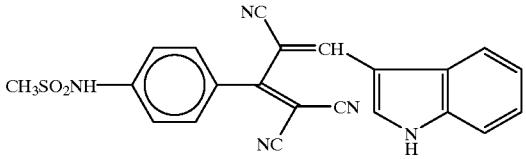

-continued
47.
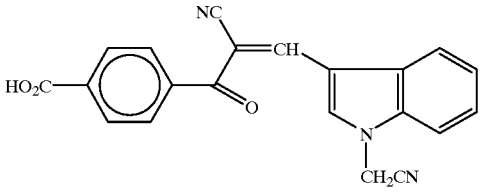
48.
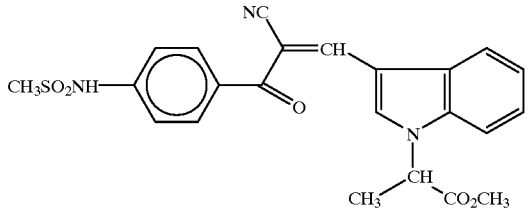
49.
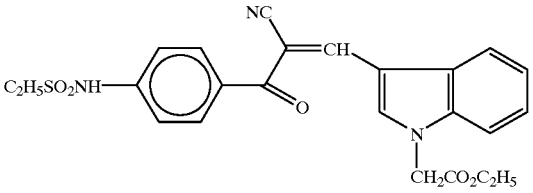
50.
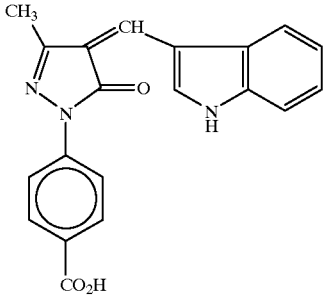
51.
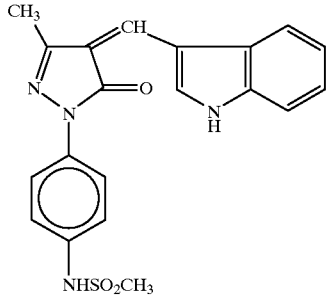
52.
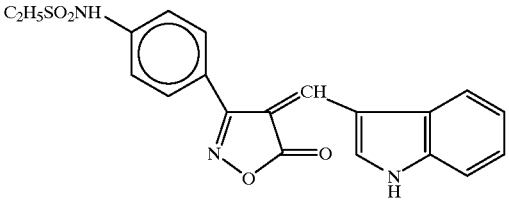
53.
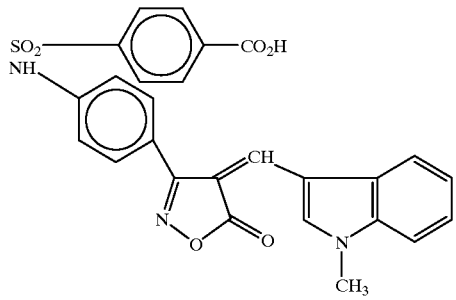
54.
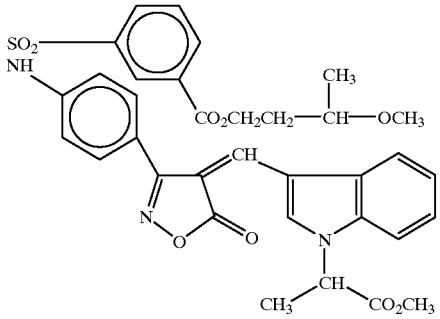
55.
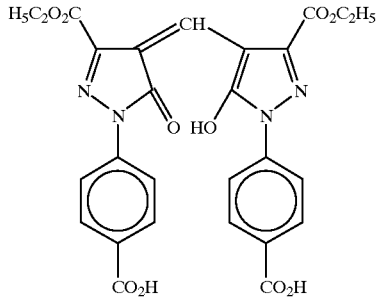

-continued
56.
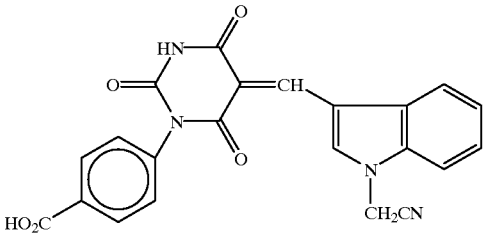
57.
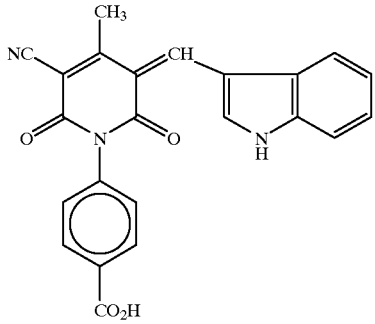
58. R = $CH_3$
59. R = n-$C_4H_9$
60. R =
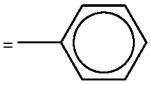
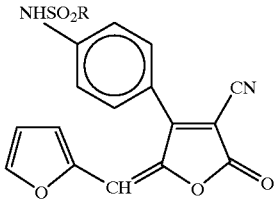
61.
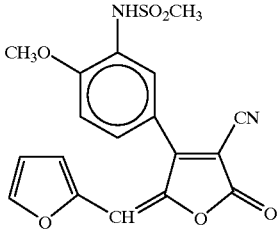
62.
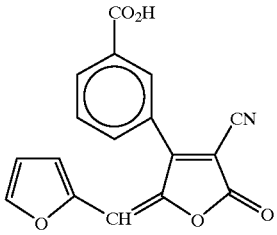
63.
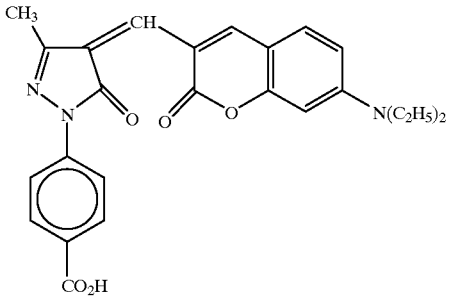
64.
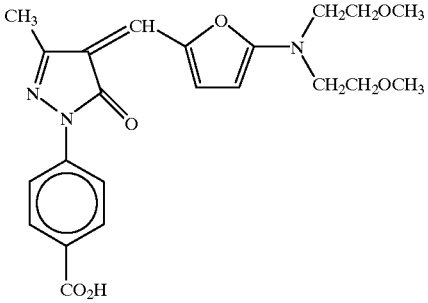
65.
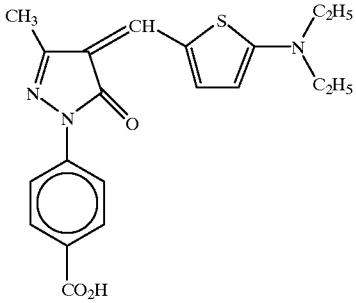
66.
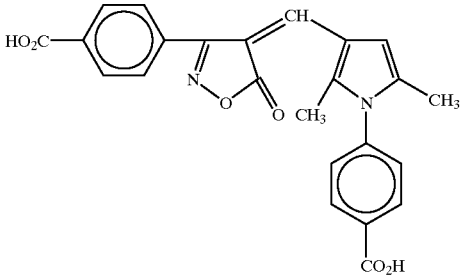
67.
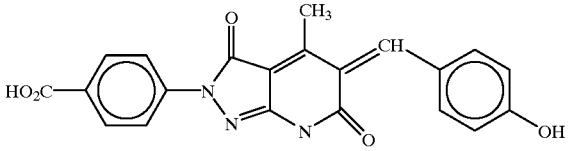

-continued
68.
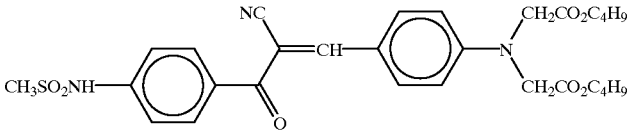
69.
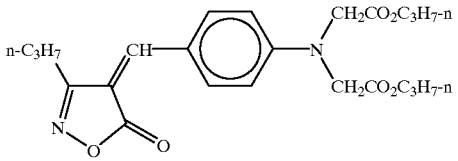
70.
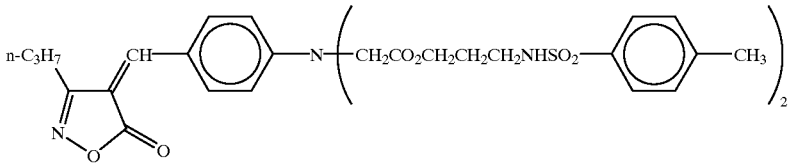
71.
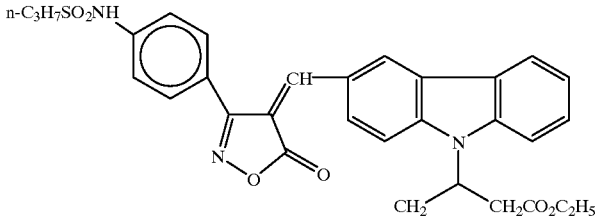
72.
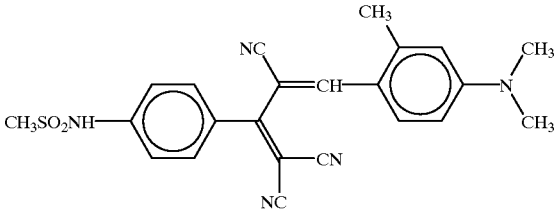
73.
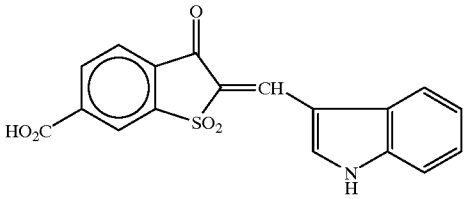
74.
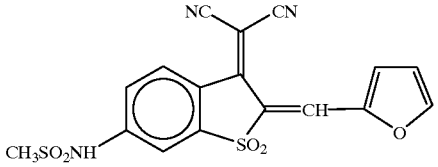
75.
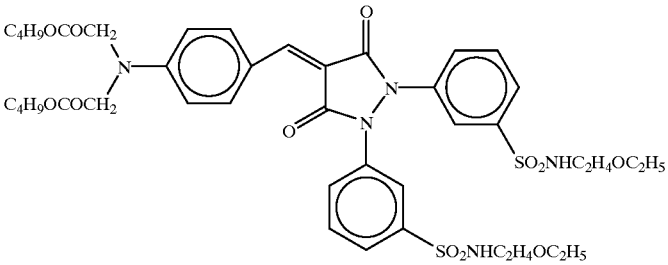

-continued

76.

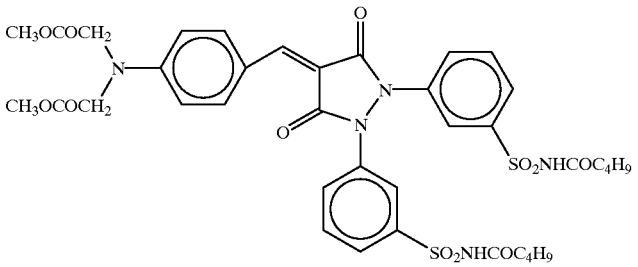

77.

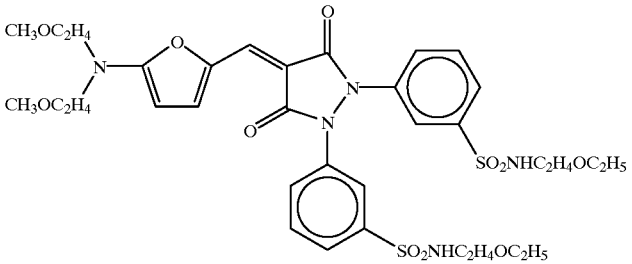

78.

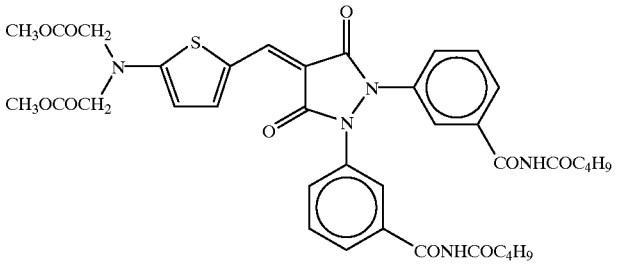

Any of these dyes can be easily synthesized by methods described in Registered Patent No. 2649980 (U.S. Pat. No. 5,213,957), JP-A-8-50345, JP-A-7-92613, JP-A-5-86056, EP775938A1, EP524594A, U.S. Pat. Nos. 5,776,667, 4,923,788, 4,950,586, 4,948,717, 4,857,446, 4,764,455, JP-A-9-311401, and JP-A-10-39449, the disclosures of which are herein incorporated by reference.

Examples of Synthesis will be Described Below (a) Synthesis of Methyl 2-(3-formyl-1-indolyl)propionate (compound a)

4,4 g of iondole-3-carbaldehyde, 5.5 g of methyl 2-bromopropionate, and 8.3 g of potassium carbonate were mixed in 30 milliliters (to be referred to as mL hereinafter) of N,N-dimethylformamide, and the mixture was stirred while being heated over a steam bath for 3 hrs. The reaction solution was naturally cooled to room temperature and poured into 120 mL of ice water under stirring. Consequently, an oily matter precipitated and then solidified. When the solid oily matter was recrystallized by ethanol, 6.2 g of crystals of a compound a were obtained.

(b) Synthesis of Compound 1

5.5g of 1-p-carboxyphenyl-3-methyl-5-pyrazolone and 5.8 g of the compound a were mixed in 50 mL of N,N-dimethylacetamide, and the mixture was heated over a steam bath for 4 hrs. The resultant material was cooled to room temperature, 50 mL of methanol were added, and crystals were filtered out. When the crystals were washed with a small amount of methanol and dried, 7.4 g of a compound 1 were obtained. λmax=406 nm (dimethylformamide).

(c) Synthesis of Compound 5

6.6g of 3-amino-1-p-carboxyphenyl-5-pyrazolone and 6.9 g of the compound a were mixed in 30 mL of N,N-dimethylformamide, and the mixture was heated over a steam bath for 4 hrs. The resultant material was cooled to room temperature, and 30 mL of methanol were added. After the material was stirred for a while at the same temperature, crystals were filtered out. When the crystals were washed with methanol and dried, 7.6 g of a compound 5 were obtained. λmax=414 nm (dimethylformamide).

A compound represented by formula (2) will be described in detail below.

In formula (2), A2 and A3 preferably represent the same acidic nucleus. Preferable examples are a cyclic ketomethylene compound and a compound having a methylene group sandwiched by electrophilic groups. Examples of a cyclic ketomethylene compound are 2-pyrazoline-5-one, rhodanine, hydantoin, thiohydantoin, 2,4-oxazolidinedione, isoxazolone, barbituric acid, thiobarbituric acid, indandione, hydroxypyridine, pyrazolidinedione, and 2,5-dihydrofuran. These compounds can have a substituent.

A compound having a methylene group sandwiched by electrophilic groups can be represented by $Z^1CH_2Z^2$ wherein each of $Z^1$ and $Z^2$ represents CN, $SO_2R^{21}$, $COR^{21}$, $COOR^{22}$, $CONHR^{22}$, $SO_2NHR^{22}$, $C[=C(CN)_2]R^{21}$, or $C[=C(CN)_2]NHR^{21}$. $R^{21}$ represents an alkyl group, aryl group, or heterocyclic ring. $R^{22}$ represents a hydrogen atom or a group represented by $R^{21}$. Each of $R^{21}$ and $R^{22}$ can have a substituent.

Of these acidic nuclei, 2-pyrazoline-5-one, isoxazolone, barbituric acid, indandione, hydroxypyridine, and pyrazolidinedione are more preferable, and 2-pyrazoline-5-one is especially preferable.

A methine group represented by L can have a substituent, e.g., an alkyl group.

A substituent which each group described above can have is not particularly limited provided that the substituent does not render to essentially dissolve the compound represented by formula (2) in water having pH 5 to 7. "Essential dissolution" means a solubility of 1.0 g/L (25° C.) or more. Examples are a carboxyl group, 1- to 10-carbon sulfonamide group (e.g., methanesulfonamide, benzenesulfonamide, butanesulfonamide, and n-octanesulfonamide), 1- to 10-carbon sulfamoyl group (e.g., nonsubstituted sulfamoyl, methylsulfamoyl, phenylsulfamoyl, and butylsulfamoyl), 2- to 10-carbon sulfonylcarbamoyl group (e.g., methanesulfonylcarbamoyl, propanesulfonylcarbamoyl, and benzenesulfonylcarbamoyl), 1- to 10-carbon acylsulfamoyl (e.g., acetylsulfamoyl, propionylsulfamoyl, pivaloylsulfamoyl, and benzoylsulfamoyl), 1- to 8-carbon chain or cyclic alkyl group (e.g., methyl, ethyl, isopropyl, butyl, hexyl, cyclopropyl, cyclohexyl, 2-hydroxyethyl, 4-carboxylbutyl, 2-methoxyethyl, benzyl, phenethyl, 4-carboxybenzyl, and 2-diethylaminoethyl), 2- to 8-carbon alkenyl (e.g., vinyl and allyl), 1- to 8-carbon alkoxy (e.g., methoxy, ethoxy, and butoxy), halogen atom (e.g., fluorine, chlorine, and bromine), 0- to 10-carbon amino group (e.g., nonsubstituted amino, dimethylamino, diethylamino, and carboxyamino), 2- to 10-carbon ester group (e.g., methoxycarbonyl), 1- to 10-carbon amide group (e.g., acetamide and benzamide), 1- to 10-carbon carbamoyl group (e.g., nonsubstituted carbamoyl, methylcarbamoyl, and ethylcarbamoyl), 6- to 10-carbon aryl group (e.g., phenyl, naphthyl, 4-carboxyphenyl, 3-carboxyphenyl, 3,5-dicarboxyphenyl, 4-methanesulfonamidophenyl, and 4-butanesulfonamidophenyl), 6- to 10-carbon aryloxy group (e.g., phenoxy, 4-carboxyphenoxy, 3-methylphenoxy, and naphthoxy), 1- to 8-carbon alkylthio group (e.g., methylthio, ethylthio, and octylthio), 6- to 10-carbon arylthio group (e.g., phenylthio and naphthylthio), 1- to 10-carbon acyl group (e.g., acetyl, benzoyl, and propanoyl), 1- to 10-carbon sulfonyl group (e.g., methanesulfonyl and benzenesulfonyl), 1- to 10-carbon ureido group (e.g., ureido and methylureido), 2- to 10-carbon urethane group (e.g., methoxycarbonylamino and ethoxycarbonylamino), cyano group, hydroxyl group, nitro group, heterocyclic group (e.g., a 5-carboxybenzoxazol ring, pyridine ring, sulforan ring, furan ring, pyrrole ring, pyrrolidine ring, morpholine ring, piperazine ring, and pyrimidine ring).

Of a compound represented by formula (2) above, a compound represented by formula (6) below is particularly preferable:

(6)

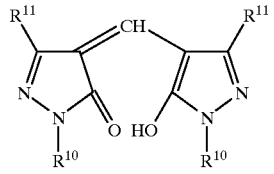

wherein $R^{10}$ represents a hydrogen atom, alkyl group, or aryl group, $R^{11}$ represents an alkyl group or aryl group. Preferable alkyl and aryl groups represented by $R^{10}$ and $R^{11}$ are the alkyl and aryl groups described above as substituents which a compound represented by formula (2) can have. Practical examples of a compound represented by formula (2) used in the present invention will be presented below. However, the present invention is not limited to these examples.

(2-1)

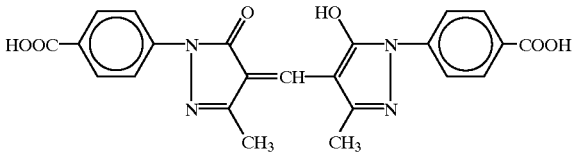

(2-1)

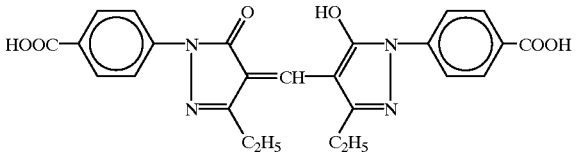

(2-3)

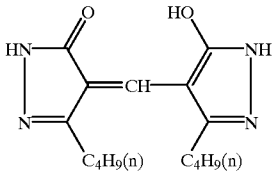

(2-4)

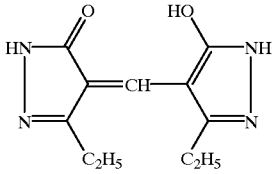

(2-5)

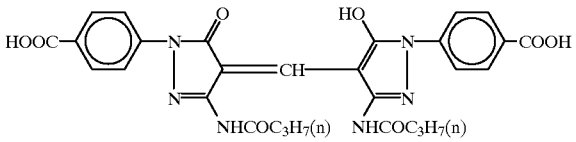

(2-6)

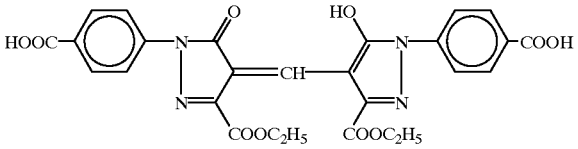

-continued (2-7)

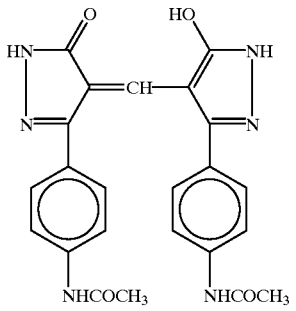

(2-8)

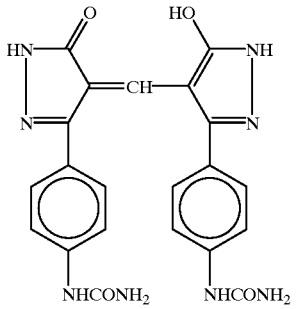

(2-9)

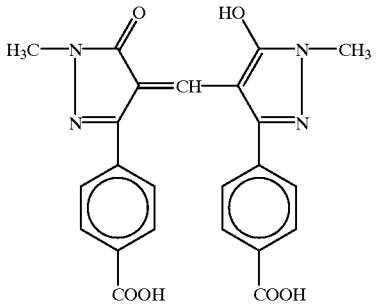

(2-10)

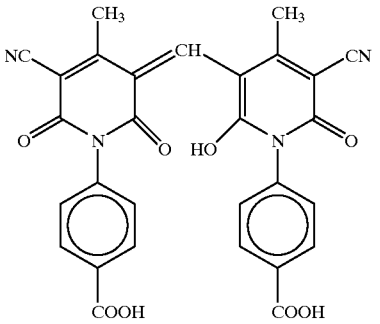

The dye used in the present invention is preferably a compound represented by formula (1), more preferably a compound represented by formula (3) or (4), and especially preferably a compound represented by formula (5).

A dye represented by formula (1) or (2) of the present invention is preferably sparingly soluble in water having pH 5 to 7. A "sparingly soluble compound" is a compound whose solubility in water having pH 5 to 7 is 1.0 g/L (25° C.) or less. Liter will be referred to as "L" hereinafter.

As a method of introducing this compound to a photosensitive material, various dispersion methods such as described in U.S. Pat. No. 5,776,667, the disclosure of which is herein incorporated by reference, can be used. However, a dye is preferably dispersed as fine solid grains or an emulsion, and especially preferably dispersed as fine solid grains. In order for the dye used in the present invention to be sparingly soluble in water, the dye preferably does not have a sulfo group or its salt (e.g., sodium salt, potassium salt, or ammonium salt) as a substituent.

To disperse the dye in the form of fine solid grains for preparing the photosensitive material of the present invention, it is possible to properly choose from dispersion apparatuses such as a ball mill, sand mill, and colloid mill as described in JP-A-52-92716 and WO88/04794, the disclosures of which is herein incorporated by reference, and dispersion apparatuses such as an oscillating ball mill, planetary ball mill, jet mill, roll mill, mantongaulin, micro fluidizer, and disk impeller mill. However, a vertical or horizontal medium dispersion apparatus is preferable. Also, the use of a dispersion surfactant is more preferable. As a dispersion surfactant, it is possible to use an anionic surfactant described in, e.g., JP-A-52-92716 or WO88/04794, the disclosures of which are herein incorporated by reference, or an anionic polymer described in, e.g., JP-A-4-324858, the disclosure of which is herein incorporated by reference. A nonionic or cationic surfactant can also be used where necessary. However, the use of an anionic polymer or anionic surfactant is preferable.

After the dye represented by formula (1) or (2) of the present invention is dissolved in an appropriate solvent, a poor solvent of the dye can be added to separate out fine crystals. As in the above case, any of the aforementioned dispersion surfactants can be used. Alternatively, a dye is first dissolved in a solvent by controlling the pH thereof, and then the pH is changed to form fine crystals. In a dispersion, the average grain size of a dye represented by formula (1) or (2) of the present invention is 0.005 to 10 $\mu$m, preferably 0.01 to 1 $\mu$m, and more preferably 0.01 to 0.5 $\mu$m. In some instances, a grain size of 0.01 to 0.1 $\mu$m is preferable.

A dye represented by formula (1) or (2) can be directly dispersed without performing any pre-processing for the dye solid. Preferably, a dye solid in a wet state obtained in a synthesis process is used in dispersion. Heating can also be performed where necessary before and/or after dispersion. To more effectively perform heating, heating is preferably performed at least after dispersion. The heating temperature is preferably 40° C. or more, and its upper limit needs only be a temperature at which a dye does not decompose. This upper-limiting temperature is preferably 250° C. or less, and more preferably 50° C. to 150° C. The heating time needs only be in a range within which a dye does not decompose, i.e., 15 min to one week, preferably 1 hr to four days. To effectively perform heating, heating is preferably performed in a solvent. This solvent can be any solvent provided that the solvent does not essentially dissolve a dye represented by formula (1) or (2). Examples are water, alcohols (e.g., methanol, ethanol, isopropylalcohol, butanol, isoamylalcohol, octanol, ethyleneglycol, diethyleneglycol, and ethylcellosolve), ketones (e.g., acetone and methylethylketone), esters (e.g., ethyl acetate and butyl acetate), alkylcarboxylic acids (e.g., acetic acid and propionic acid), nitrites (e.g., acetonitrile), and ethers (e.g., dimethoxyethane, dioxane, and tetrahydrofuran).

When organic carboxylic acid coexists during heating, the objects of the present invention can be more effectively achieved. Examples of organic carboxylic acid are alkylcarboxylic acids (e.g., acetic acid and propionic acid), carboxymethylcellulose (CMC), and arylcarboxylic acids (e.g., benzoic acid and salicylic acid). The amount of organic carboxylic acid when the acid is used as a solvent is 0.5 to 100 times the weight of a dye represented by formula (1) or (2). When organic carboxylic acid is added to a solvent which is not organic carboxylic acid, its weight ratio is 0.05 to 100% with respect to a dye represented by formula (1) or (2).

Practical methods of dispersing a dye represented by formula (1) or (2) of the present invention together with a high-boiling solvent or polymer are described in U.S. Pat. No. 5,776,667, JP-A-7-92613, JP-A-9-311401, and JP-A-10-39449 described earlier.

An effective arbitrary amount of a dye represented by formula (1) or (2) can be used. However, this dye is preferably used such that an optical density is 0.05 to 3.0. This "optical density" is the optical density of a sensitive material coated with this dye. One or a plurality of different dyes represented by formula (1) or (2) can be added. Also, the dye represented by formula (1) and the dye represented by formula (2) can be used together. The addition amount of the dye represented by formula (1) or (2) is preferably 0.5 $mg/m^2$ to 1,000 $mg/m^2$, and more preferably 1 $mg/m^2$ to 600 $mg/m^2$. The dye can be added in any step before coating. A dye represented by formula (1) or (2) can be used in any of emulsion layers and other hydrophilic colloid layers (e.g., an interlayer, a protective layer, an antihalation layer, a filter layer, and a back layer). A dye can be used in one or a plurality of layers. A preferable addition layer is a yellow filter layer.

A development inhibitor-releasing compound represented by formula (D1) will be described below.

A development inhibitor releasing compound represented by formula (D1) is more specifically represented by formula (D3) or (D4) below $$A\text{-}(TIME)_m\text{-}DI \quad (D3)$$

$$A\text{-}(TIME)_i\text{-}RED\text{-}DI \quad (D4)$$

wherein A represents a coupler moiety which splits off $(TIME)_m$-DI or $(TIME)_i$-RED-DI by coupling with an oxidized form of a developing agent and generates a processing solution-soluble or noncolor-forming compound, TIME represents a timing group which cleaves DI or RED-DI after splitting off from A by the coupling reaction, RED represents a group which reacts with the oxidized form of the developing agent after splitting off from A or TIME and cleaves DI, DI represents a development inhibitor, m represents 1 or 2, and i represents 0 or 1. When m is 2, two TIMEs can be the same or different.

When A represents a yellow coupler moiety, examples of this coupler moiety are a pivaloylacetanilide type coupler moiety, benzoylacetanilide type coupler moiety, malondiester type coupler moiety, malondiamide type coupler moiety, dibenzoylmethane type coupler moiety, benzothiazolylacetamide type coupler moiety, malonestermonoamide type coupler moiety, benzoxazolylacetamide type coupler moiety, benzoimidazolylacetamide type coupler moiety, quinazoline-4-one-2-ylacetanilide type coupler moiety, and cycloalkanoylacetamide type coupler moiety.

When A represents a magenta coupler moiety, examples of this coupler moiety are a 5-pyrazolone type coupler moiety, pyrazolo[1,5-a]benzimidazole type coupler moiety, pyrazolo[1,5-b][1,2,4]triazole type coupler moiety, pyrazolo[5,1-c][1,2,4]triazole type coupler moiety, imidazo[1,2-b]pyrazole type coupler moiety, pyrrolo[1,2-b][1,2,4]triazole type coupler moiety, pyrazolo[1,5-b]pyrazole type coupler moiety, and cyanoacetophenone type coupler moiety.

When A represents a cyan coupler moiety, examples of this coupler moiety are a phenol type coupler moiety, naphthol type coupler moiety, pyrrolo[1,2-b][1,2,4]triazole type coupler moiety, pyrrolo[2,1-c][1,2,4]triazole type coupler moiety, and 2,4-diphenylimidazole type coupler moiety.

A can also be a coupler moiety which does not essentially leave any color image. Examples of a coupler moiety of this type are indanone type and acetophenone type coupler moieties.

Preferable examples of A are coupler moieties represented by formulas (Cp-1), (Cp-2), (Cp-3), (Cp-4), (Cp-5), (Cp-6), (Cp-7), (Cp-8), (Cp-9), (Cp-10), (Cp-11), and (Cp-12) below. Compounds having these coupler moieties are preferable because of their high coupling rates.

(Cp-1)

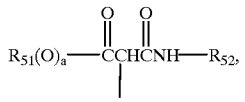

(Cp-2)

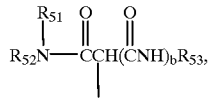

(Cp-3)

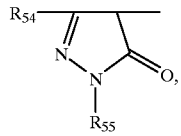

(Cp-4)

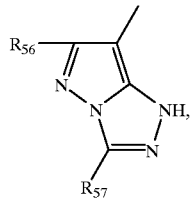

(Cp-5)

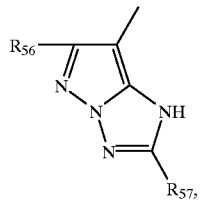

(Cp-6)

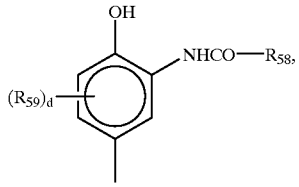

(Cp-7)

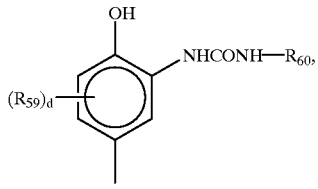

-continued (Cp-8)

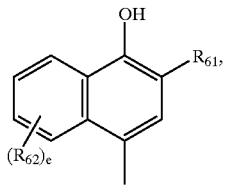

(Cp-9)

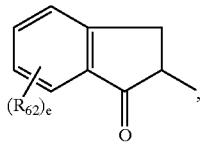

(Cp-10)

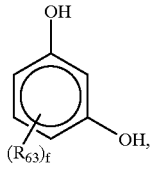

(Cp-11)

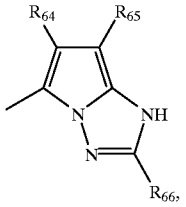

(Cp-12)

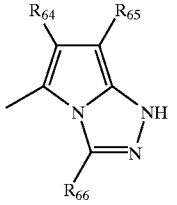

In the above formulas, a free bond hand deriving from a coupling position represents the bonding position of a coupling split-off group.

In the above formulas, the number of carbon atoms of each of $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, $R_{63}$, $R_{64}$, $R_{65}$, and $R_{66}$ is preferably 10 or less.

The coupler moiety represented by A preferably has at least one substituent selected from an $R_{71}OCO$— group, $HOSO_2$— group, HO— group, $R_{72}NHCO$— group, and $R_{72}NHSO_2$— group. That is, at least one of $R_{51}$ and $R_{52}$ in formula (Cp-1), at least one of $R_{51}$, $R_{52}$, and $R_{53}$ in formula (Cp-2), at least one of $R_{54}$ and $R_{55}$ in formula (Cp-3), at least one of $R_{56}$ and $R_{57}$ in formulas (Cp-4) and (Cp-5), at least one of $R_{58}$ and $R_{59}$ in formula (Cp-6), at least one of $R_{59}$ and $R_{60}$ in formula (Cp-7), at least one of $R_{61}$ and $R_{62}$ in formula (Cp-8), at least one $R_{63}$ in formulas (Cp-9) and (Cp-10), and at least one of $R_{64}$, $R_{65}$, and $R_{66}$ in formulas (Cp-11) and (Cp-12) preferably have at least one substituent selected from an $R_{71}OCO$— group, $HOSO_2$— group, HO— group, $R_{72}NHCO$— group, and $R_{72}NHSO_2$— group. $R_{71}$ represents a hydrogen atom, alkyl group (e.g., methyl, ethyl, propyl, isopropyl, butyl, and t-butyl) having 6 or less carbon atoms, or phenyl group. $R_{72}$ represents a group represented by $R_{71}$, $R_{74}CO$— group, $R_{74}N(R_{75})CO$— group, $R_{73}SO_2$— group, or $R_{74}N(R_{75})SO_2$— group. $R_{73}$ represents an alkyl group (e.g., methyl, ethyl, propyl, isopropyl, butyl, or t-butyl) having 6 or less carbon atoms, or phenyl group. Each of $R_{74}$ and $R_{75}$ represents a group represented by $R_{71}$. These groups can further have a substituent.

$R_{51}$ to $R_{66}$, a, b, d, e, and f will be described in detail below. In the following description, $R_{41}$ represents an alkyl group, aryl group, or heterocyclic group, $R_{42}$ represents an aryl group or heterocyclic group, and each of $R_{43}$, $R_{44}$, and $R_{45}$ represents a hydrogen atom, alkyl group, aryl group, or heterocyclic group.

$R_{51}$ represents the same meaning as $R_{41}$. a represents 0 or 1. Each of $R_{52}$ and $R_{53}$ represents the same meaning as $R_{43}$. When $R_{52}$ is not a hydrogen atom in formula (Cp-2), $R_{52}$ and $R_{51}$ can combine with each other to form a 5- to 7-membered ring. b represents 0 or 1.

$R_{54}$ represents a group having the same meaning as $R_{41}$, $R_{41}CON(R_{43})$— group, $R_{41}SO_2N(R_{43})$— group, $R_{41}N(R_{43})$— group, $R_{41}S$— group, $R_{43}O$— group, or $R_{45}N(R_{43})CON(R_{44})$— group. $R_{55}$ represents a group having the same meaning as $R_{41}$.

Each of $R_{56}$ and $R_{57}$ independently represents a group having the same meaning as $R_{43}$, $R_{41}S$— group, $R_{43}O$— group, $R_{41}CON(R_{43})$— group, $R_{41}OCON(R_{43})$— group, or $R_{41}SO_2N(R_{43})$— group.

$R_{58}$ represents a group having the same meaning as $R_{43}$. $R_{59}$ represents a group having the same meaning as $R_{41}$, $R_{41}CON(R_{43})$— group, $R_{41}OCON(R_{43})$— group, $R_{41}SO_2N(R_{43})$— group, $R_{43}N(R_{44})CON(R_{45})$— group, $R_{41}O$— group, $R_{41}S$— group, halogen atom, or $R_{41}N(R_{43})$— group. d represents an integer from 0 to 3. When d is 2 or 3, a plurality of $R_{59}$'s represent the same substituent or different substituents. $R_{60}$ represents a group having the same meaning as $R_{43}$.

$R_{61}$ represents a group having the same meaning as $R_{43}$, $R_{43}OSO_2$— group, $R_{43}N(R_{44})SO_2$— group, $R_{43}OCO$— group, $R_{43}N(R_{44})CO$— group, cyano group, $R_{41}SO_2N(R_{43})CO$— group, $R_{43}CON(R_{44})CO$— group, $R_{43}N(R_{44})SO_2N(R_{45})CO$— group, $R_{43}N(R_{44})CON(R_{45})CO$— group, $R_{43}N(R_{44})SO_2N(R_{45})SO_2$— group, or $R_{43}N(R_{44})CON(R_{45})SO_2$— group. $R_{62}$ represents a group having the same meaning as $R_{41}$, $R_{41}CONH$— group, $R_{41}OCONH$— group, $R_{41}SO_2NH$— group, $R_{43}N(R_{44})CONH$— group, $R_{43}N(R_{44})SO_2NH$— group, $R_{43}O$— group, $R_{41}S$— group, halogen atom, or $R_{41}N(R_{43})$— group. In formula (Cp-8), e represents an integer from 0 to 4. When e is 2 or more, a plurality of $R_{62}$'s represent the same substituent or different substituents.

$R_{63}$ represents a group having the same meaning as $R_{41}$, $R_{43}CON(R_{44})$— group, $R_{43}N(R_{44})CO$— group, $R_{41}SO_2N(R_{43})$— group, $R_{41}N(R_{43})SO_2$— group, $R_{41}SO_2$— group, $R_{43}OCO$— group, $R_{43}OSO_2$— group, halogen atom, nitro group, cyano group, or $R_{43}CO$— group. In formula (Cp-9), e represents an integer from 0 to 4. When e is 2 or more, a plurality of $R_{63}$'s represent the same substituent or different substituents. In formula (Cp-10), f represents an integer from 0 to 3. When f is 2 or more, a plurality of $R_{63}$'s represent the same substituent or different substituents.

Each of $R_{64}$, $R_{65}$, and $R_{66}$ independently represents a group having the same meaning as $R_{43}$, $R_{41}S$— group, $R_{43}O$— group, $R_{41}CON(R_{43})$— group, $R_{41}SO_2N(R_{43})$— group, $R_{41}OCO$— group, $R_{41}OSO_2$— group, $R_{41}SO_2$— group, $R_{41}N(R_{43})CO$— group, $R_{41}N(R_{43})SO_2$— group, nitro group, or cyano group.

In the above description, the alkyl group represented by $R_{41}$, $R_{43}$, $R_{44}$, or $R_{45}$ is a 1- to 10-carbon, preferably 1- to 6-carbon saturated or unsaturated, chain or cyclic, straight-chain or branched, or substituted or nonsubstituted alkyl group. Representative examples of this alkyl group are methyl, cyclopropyl, isopropyl, n-butyl, t-butyl, i-butyl, t-amyl, n-hexyl, cyclohexyl, 2-ethylhexyl, n-octyl, 1,1,3,3-tetramethylbutyl, and n-decyl.

The aryl group represented by $R_{41}$, $R_{42}$, $R_{43}$, $R_{44}$, or $R_{45}$ is a 6- to 10-carbon aryl group, preferably substituted or nonsubstituted phenyl or substituted or nonsubstituted naphthyl.

The heterocyclic group represented by $R_{41}$, $R_{42}$, $R_{43}$, $R_{44}$, or $R_{45}$ is a 1- to 10-carbon, preferably 1- to 6-carbon substituted or nonsubstituted heterocyclic group which contains a heterocyclic atom selected from a nitrogen atom, oxygen atom, and sulfur atom and which is preferably a 3- to 8-membered ring. Representative examples of this heterocyclic group are 2-pyridyl, 2-benzoxazolyl, 2-imidazolyl, 2-benzimidazolyl, 1-indolyl, 1,3,4-thiadiazole-2-yl, 1,2,4-triazole-2-yl, and 1-indolynyl.

When the alkyl group, aryl group, and heterocyclic group described above have substituents, representative examples of the substituents are a halogen atom, $R_{43}O$— group, $R_{41}S$— group, $R_{43}CON(R_{44})$— group, $R_{43}N(R_{44})CO$— group, $R_{41}OCON(R_{43})$— group, $R_{41}SO_2N(R_{43})$— group, $R_{43}N(R_{44})SO_2$— group, $R_{41}SO_2$— group, $R_{43}OCO$— group, $R_{41}SO_2O$— group, group having the same meaning as $R_{41}$, $R_{43}N(R_{44})$— group, $R_{41}CO_2$— group, $R_{41}OSO_2$— group, cyano group, and nitro group.

Preferable ranges of $R_{51}$ to $R_{66}$, a, b, d, e, and f will be described below.

$R_{51}$ is preferably an alkyl group or aryl group. a is especially preferably 1. Each of $R_{52}$ and $R_{55}$ is preferably an aryl group. When b is 1, $R_{53}$ is preferably an aryl group; when b is 0, $R_{53}$ is preferably a heterocyclic group. $R_{54}$ is preferably an $R_{41}CON(R_{43})$— group or $R_{41}N(R_{43})$— group. Each of $R_{56}$ and $R_{57}$ is preferably an alkyl group, aryl group, $R_{41}O$— group, or $R_{41}S$— group. $R_{58}$ is preferably an alkyl group or aryl group. In formula (Cp-6), $R_{59}$ is preferably a chlorine atom, alkyl group, or $R_{41}CON(R_{43})$— group, and d is preferably 1 or 2. $R_{60}$ is preferably an aryl group. In formula (Cp-7), $R_{59}$ is preferably an $R_{41}CON(R_{43})$— group, and d is preferably 1.

$R_{61}$ is preferably an $R_{43}OSO_2$— group, $R_{43}N(R_{44})SO_2$— group, $R_{43}OCO$— group, $R_{43}N(R_{44})CO$—, cyano group, $R_{41}SO_2N(R_{43})CO$— group, $R_{43}CON(R_{44})CO$— group, $R_{43}N(R_{44})SO_2N(R_{45})CO$— group, or $R_{43}N(R_{44})CON(R_{45})CO$— group. In formula (Cp-8), e is preferably 0 or 1. $R_{62}$ is preferably an $R_{41}OCON(R_{43})$— group, $R_{41}CON(R_{43})$— group, or $R_{41}SO_2N(R_{43})$— group, and the substitution position of any of these substituents is preferably the 5th position of a naphthol ring. In formula (Cp-9), $R_{63}$ is preferably an $R_{41}CON(R_{43})$— group, $R_{41}SO_2N(R_{43})$— group, $R_{41}N(R_{43})SO_2$— group, $R_{41}SO_2$— group, $R_{41}N(R_{43})CO$— group, nitro group, or cyano group. e is preferably 1 or 2. In formula (Cp-10), $R_{63}$ is preferably an $R_{43}N(R_{44})CO$— group, $R_{43}OCO$— group, or $R_{43}CO$— group. f is preferably 1 or 2. In formulas (Cp-11) and (Cp-12), each of $R_{64}$ and $R_{65}$ is preferably an $R_{41}OCO$— group, $R_{41}OSO_2$— group, $R_{41}SO_2$— group, $R_{44}N(R_{43})CO$— group, $R_{44}N(R_{43})SO_2$— group, or cyano group, and especially preferably an $R_{41}OCO$— group, $R_{44}N(R_{43})CO$— group, or cyano group. $R_{66}$ is preferably a group having the same meaning as $R_{41}$. The total number of carbon atoms, including those of a substituent, of each of $R_{51}$ to $R_{66}$ is preferably 18 or less, and more preferably 10 or less.

In the present invention, A is preferably a group which generates a processing solution-soluble compound.

A development inhibitor represented by DI will be described below.

Examples of a development inhibitor represented by DI are described in Research Disclosure Vol. 76, No. 17643, (December, 1978), U.S. Pat. Nos. 4,477,563, 5,021,332, 5,026,628, 3,227,554, 3,384,657, 3,615,506, 3,617,291, 3,733,201, 3,933,500, 3,958,993, 3,961,959, 4,149,886, 4,259,437, 4,095,984, and 4,782,012, and British Patent 1,450,479, and U.S. Pat. No. 5,034,311, the disclosures of which are herein incorporated by reference. This development inhibitor is preferably a heterocyclic thio group, heterocyclic seleno group, or triazolyl group (monocyclic or condensed-ring 1,2,3-triazolyl or 1,2,4-triazolyl), and especially preferably tetrazolylthio, tetrazolylseleno, 1,3,4-oxadiazolylthio, 1,3,4-thiadiazolylthio, 1-(or 2-)benzotriazolyl, 1,2,4-triazole-1-(or 4-)yl, 1,2,3-triazole-1-yl, 2-benzothiazolylthio, 2-benzoxazolylthio, 2-benzoimidazolylthio, or a derivative of any of these compounds. Preferable development inhibitors are represented by Formulas DI-1 to DI-6 below:

DI-1

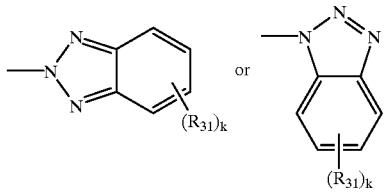

DI-2

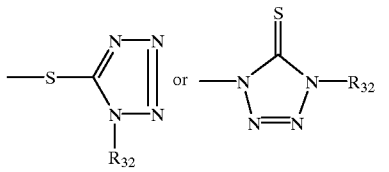

DI-3

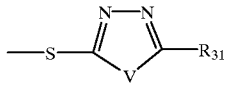

DI-4

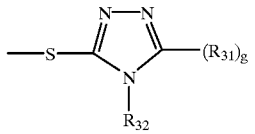

DI-5

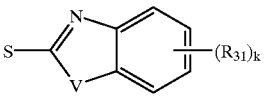

DI-6

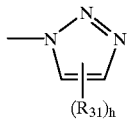

wherein $R_{31}$ represents a halogen atom, $R_{46}O$— group, $R_{46}S$— group, $R_{47}CON(R_{48})$— group, $R_{47}N(R_{48})CO$— group, $R_{46}OCON(R_{47})$— group, $R_{46}O_2(R_{47})$— group, $R_{47}N(R_{48})SO_2$ group, $R_{46}SO_2$— group, $R_{47}OCO$— group, $R_{47}N(R_{48})CON(R_{49})$— group, $R_{47}CON(R_{48})SO_2$— group, $R_{47}N(R_{48})CON(R_{49})SO_2$— group, group having the same meaning as $R_{46}$, $R_{47}N(R_{48})$— group, $R_{46}CO_2$— group, $R_{47}OSO_2$— group, cyano group, or nitro group.

$R_{46}$ represents an alkyl group, aryl group, or heterocyclic group. Each of $R_{47}$, $R_{48}$, and $R_{49}$ represents an alkyl group, aryl group, heterocyclic group, or hydrogen atom. The alkyl group represented by $R_{46}$, $R_{47}$, $R_{48}$, or $R_{49}$ is a 1- to 32-carbon, preferably 1- to 20-carbon saturated or unsaturated, chain or cyclic, straight-chain or branched, or substituted or nonsubstituted alkyl group. Representative examples are methyl, cyclopropyl, isopropyl, n-butyl, t-butyl, i-butyl, t-amyl, n-hexyl, cyclohexyl, 2-ethylhexyl, n-octyl, 1,1,3,3-tetramethylbutyl, and n-decyl.

The aryl group represented by $R_{46}$, $R_{47}$, $R_{48}$, or $R_{49}$ is a 6- to 32-carbon aryl group, preferably substituted or nonsubstituted phenyl or substituted or nonsubstituted naphthyl.

The heterocyclic group represented by $R_{46}$, $R_{47}$, $R_{48}$, or $R_{49}$ is a 1- to 32-carbon, preferably 1- to 20-carbon substituted or nonsubstituted heterocyclic group which contains a hetero atom selected from a nitrogen atom, oxygen atom, and sulfur atom and which is preferably a 3- to 8-membered ring. Representative examples of this heterocyclic group are 2-pyridyl, 2-benzoxazolyl, 2-imidazolyl, 2-benzimidazolyl, 1-indolyl, 1,3,4-thiadiazole-2-yl, 1,2,4-triazole-2-yl, or 1-indolinyl. $R_{32}$ represents a group having the same meaning as $R_{46}$. k represents an integer from 1 to 4, g represents 0 or 1, and h represents 1 or 2. V represents an oxygen atom, sulfur atom, or —N($R_{46}$)—. $R_{31}$ and $R_{32}$ can further have a substituent.

Examples of a timing group represented by TIME are a group described in U.S. Pat. No. 4,146,396, 4,652,516, or 4,698,297, which uses a cleavage reaction of hemiacetal; a timing group described in JP-A-9-114058 or U.S. Pat. Nos. 4,248,962, 5,719,017, or 5,709,987, which causes a cleavage reaction by using an intramolecular ring closure reaction; a group described in JP-B-54-39727, JP-A-57-136640, JP-A-57-154234, JP-A-4-261530, JP-A-4-211246, JP-A-6-324439, JP-A-9-114058, or U.S. Pat. Nos. 4,409,323 or 4,421,845, which causes a cleavage reaction by using electron transfer via π electrons; a group described in JP-A-57-179842, JP-A-4-261530, or JP-A-5-313322, which causes a cleavage reaction by generating carbon dioxide; a group described in U.S. Pat. No. 4,546,073, which causes a cleavage reaction by using a hydrolytic reaction of iminoketal; a group described in Laid-open West German Patent 2,626,317, which causes a cleavage reaction by using a hydrolytic reaction of ester; and a group described in EP572084, which causes a cleavage reaction by using a reaction with sulfurous acid ions, all the disclosures of which are herein incorporated by reference.

In the present invention, preferable examples of a timing group represented by TIME are timing groups described in JP-B-1-52742, pages 6 and 7, the disclosure of which is herein incorporated by reference. However, the present invention is not limited to these examples.

A group represented by RED in formula (D4) will be described below. RED is a group which cleaves from A or TIME to form RED–DI and can be cross-oxidized by an acidic substance, such as an oxidized form of a developing agent, present during development. RED–DI can be any compound as long as it cleaves DI when oxidized. Examples of RED are hydroquinones, catechols, pyrogallols, 1,4-naphthohydroquinones, 1,2-naphthohydroquinones, sulfonamidophenols, hydrazides, and sulfonamidonaphthols. Practical examples of these groups are described in JP-A-61-230135, JP-A-62-251746, JP-A-61-278852, U.S. Pat. Nos. 3,364,022, 3,379,529, 4,618,571, 3,639,417, and 4,684,604, and J. Org. Chem., Vol. 29, page 588 (1964), the disclosures of which are herein incorporated by reference.

Of these compounds, preferable examples of RED are hydroquinones, 1,4-naphthohydroquinones, 2-(or 4-)sulfonamidophenols, pyrogallols, and hydrazides. Of these compounds, a redox group having a phenolic hydroxyl group links to A or TIME at an oxygen atom of the phenol group.

In order for a compound represented by formula (D3) and/or a compound represented by formula (D4) to be fixed to a sensitive layer or a nonsensitive layer to which these compounds are added before a silver halide photosensitive material containing the compound represented by formula (D3) and/or the compound represented by formula (D4) is developed, a compound represented by formula (D3) or (D4) preferably has a nondiffusing group. Especially preferably, this nondiffusing group is contained in TIME or RED. Preferable examples of the nondiffusing group are an 8- to 40-carbon, preferably 12- to 32-carbon alkyl group and an 8- to 40-carbon, preferably 12- to 32-carbon aryl group having at least one alkyl group (having 3 to 20 carbons), alkoxy group (having 3 to 20 carbons), or aryl group (having 6 to 20 carbons).

A compound represented by formula (D2) will be described in detail below. A' represents a coupler moiety capable of coupling with an oxidized form of a developing agent. The coupler used in the present invention is characterized in that the coupler does not generate a dye after coupling with an oxidized form of a developing agent. As a coupler moiety represented by A', however, it is also possible to use coupler moieties generally known as photographic couplers. Examples are yellow coupler moieties (e.g., open chain ketomethine type coupler moieties such as acylactanilide and malondianilide), magenta coupler moieties (e.g., 5-pyrazolon type, pyrazolotriazole type, and imidazopyrazole type coupler moieties), and cyan coupler moieties (e.g., phenol type, naphthol type, and pyrrolotriazole type coupler moieties).

Preferable examples of A' of the present invention are coupler moieties represented by the following formulas:

(I-A1)

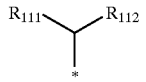

(I-A2)

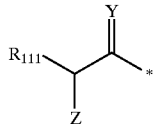

(I-B1)

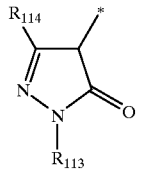

(I-B2)

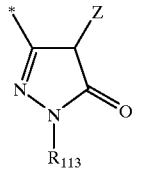

-continued (I-C1)

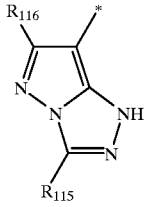

(I-C2)

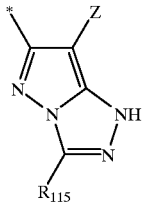

(I-D1)

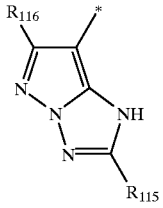

(I-D2)

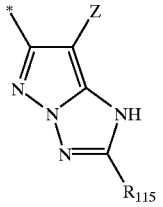

(I-E1)

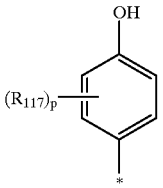

(I-E2)

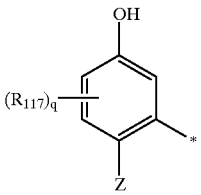

(I-F1)

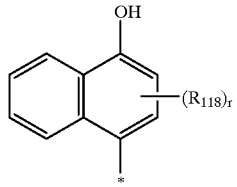

-continued (I-F2)

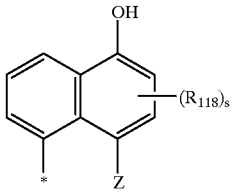

(I-F3)

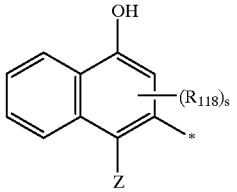

(I-G1)

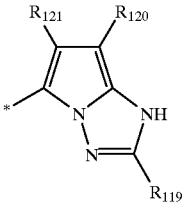

(I-G2)

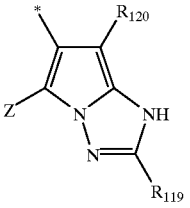

wherein * represents a position of bonding to B, z represents a hydrogen atom, halogen atom (e.g., a fluorine atom, chlorine atom, bromine atom, or iodine atom), $R_{151}$—, $R_{152}O$—, $R_{152}S$—, $R_{152}OCOO$—, $R_{153}COO$—, $R_{153}(R_{154})NCOO$—, or $R_{153}CON(R_{154})$—, Y represents an oxygen atom, sulfur atom, $R_{153}N$=, or $R_{153}ON$=.

$R_{151}$ represents an aliphatic group (an "aliphatic group" means a saturated or unsaturated, chain or cyclic, straight-chain or branched, and substituted or nonsubstituted aliphatic hydrocarbon group, or an aliphatic group used in the following description has the same meaning).

$R_{151}$ is an aliphatic group having preferably 1 to 32 carbon atoms, and more preferably 1 to 22 carbon atoms. Examples are methyl, ethyl, vinyl, ethynyl, propyl, isopropyl, 2-propenyl, 2-propynyl, butyl, isobutyl, t-butyl, t-amyl, hexyl, cyclohexyl, 2-ethylhexyl, octyl, 1,1,3,3-tetramethylbutyl, decyl, dodecyl, hexadecyl, and oxadecyl.

$R_{152}$ represents an aliphatic group, aryl group, or heterocyclic group. The aliphatic group represented by $R_{152}$ has the same meaning as $R_{151}$. The aryl group represented by $R_{152}$ is a substituted or nonsubstituted aryl group having preferably 1 to 32 carbon atoms, and more preferably 1 to 22 carbon atoms. Examples are phenyl, tolyl, and naphthyl. The heterocyclic group represented by $R_{152}$ is a substituted or nonsubstituted heterocyclic group having preferably 1 to 32 carbon atoms, and more preferably 1 to 22 carbon atoms. Examples are 2-furyl, 2-pyrrolyl, 2-thiophenyl, 3-tetrahydrofuranyl 4-pyridyl, 2-pyrimidinyl, 2-thiadiazolyl, 2-benzothiazolyl, 2-benzoxazolyl, 2-benzoimidazolyl, 2-benzoselenazolyl, 2-quinolyl, 2-oxazolyl, 2-thiazolyl, 2-imidazolyl, 2-selenazolyl, 5-tetrazolyl, and 3-oxadiazolyl.

Each of $R_{153}$ and $R_{154}$ independently represents a hydrogen atom, aliphatic group, aryl group, or heterocyclic group. The aliphatic group, aryl group, and heterocyclic group represented by $R_{153}$ and $R_{154}$ have the same meanings as $R_{152}$.

Preferably, Z represents a hydrogen atom, $R_{151}$—, $R_{151}O$—, $R_{151}S$—, or $R_{153}CON(R_{154})$—, and Y represents an oxygen atom.

Examples of substituents suited to the groups described above and groups to be described below and examples of "substituents" to be described below are a halogen atom (e.g., a fluorine atom, chlorine atom, bromine atom, and iodine atom), hydroxy group, carboxy group, sulfo group, cyano group, nitro group, alkyl group (e.g., methyl, ethyl, and hexyl), fluoroalkyl group (e.g., trifluoromethyl), aryl group (e.g., phenyl, tolyl, and naphthyl), heterocyclic group (e.g., a heterocyclic group having the same meaning as $R_{152}$), alkoxy group (e.g., methoxy, ethoxy, and octyloxy), aryloxy group (e.g., phenoxy and naphthyloxy), alkylthio group (e.g., methylthio and butylthio), arylthio (e.g., phenylthio), amino group (e.g., amino, N-methylamino, N,N-dimethylamino, and N-phenylamino), acyl group (e.g., acetyl, propionyl, and benzoyl), alkylsulfonyl and arylsulfonyl groups (e.g., methylsulfonyl and phenylsulfonyl), acylamino group (e.g., acetylamino and benzoylamino), alkylsulfonylamino and arylsulfonylamino groups (e.g., methanesulfonylamino and benzenesulfonylamino), carbamoyl group (e.g., carbamoyl, N-methylaminocarbonyl, N,N-dimethylaminocarbonyl, and N-phenylaminocarbonyl), sulfamoyl group (e.g., sulfamoyl, N-methylaminosulfonyl, N,N-dimethylaminosulfonyl, and N-phenylaminosulfonyl), alkoxycarbonyl group (e.g., methoxycarbonyl, ethoxycarbonyl, and octyloxycarbonyl), aryloxycarbonyl group (e.g., phenoxycarbonyl and naphthyloxycarbonyl), acyloxy group (e.g., acetyloxy and benzoyloxy), alkoxycarbonyloxy group (e.g., methoxycarbonyloxy and ethoxycarbonyloxy), aryloxycarbonyloxy group (e.g., phenoxycarbonyloxy), alkoxycarbonylamino group (e.g., methoxycarbonylamino and butoxycarbonylamino), aryloxycarbonylamino group (e.g., phenoxycarbonylamino), aminocarbonyloxy group (e.g., N-methylaminocarbonyloxy and N-phenylaminocarbonyloxy), aminocarbonylamino group (e.g., N-methylaminocarbonylamino and N-phenylaminocarbonylamino).

Each of $R_{111}$ and $R_{112}$ independently represents $R_{152}CO$—, $R_{152}OCO$—, $R_{153}(R_{154})NCO$—, $R152SO_n$—, $R_{153}(R_{154})NSO_2$—, or cyano group. $R_{152}$, $R_{153}$, and $R_{154}$ have the same meanings as above. n represents 1 or 2.

$R_{113}$ represents a group having the same meaning as $R_{152}$.

$R_{114}$ represents $R_{152}$—, $R_{153}CON(R_{154})$—, $R_{153}(R_{154})N$—, $R_{152}SO_2N(R_{153})$—, $R_{152}S$—, $R_{152}O$—, $R_{152}OCON(R_{153})$—, $R_{153}(R_{154})NCON(R_{155})$—, $R_{152}OCO$—, $R_{153}(R_{154})NCO$—, or cyano group. $R_{152}$, $R_{153}$, and $R_{154}$ have the same meanings as above. $R_{155}$ represents a group having the same meaning as $R_{153}$.

Each of $R_{115}$ and $R_{116}$ independently represents a substituent, preferably $R_{152}$—, $R_{153}CON(R_{154})$—, $R_{152}SO_2N(R_{153})$—, $R_{152}S$—, $R_{152}O$—, $R_{152}OCON(R_{153})$—, $R_{153}(R_{154})NCON(R_{155})$—, $R_{152}OCO$—, $R_{153}(R_{154})NCO$—, a halogen atom, or cyano group, and more preferably a group represented by $R_{152}$. $R_{152}$, $R_{153}$, and $R_{154}$ have the same meanings as above. $R_{155}$ represents a group having the same meaning as $R_{153}$.

$R_{117}$ represents a substituent, p represents an integer from 0 to 4, and q represents an integer from 0 to 3. p is preferably 2 or 3, and q is preferably 2 or 3. Preferable examples of a substituent represented by $R_{117}$ are $R_{153}CON(R_{154})$—, $R_{152}OCON(R_{153})$—, $R_{152}SO_2N(R_{153})$—, $R_{153}(R_{154})NCON(R_{155})$—, $R_{152}S$—, $R_{152}O$—, and a halogen atom. $R_{152}$, $R_{153}$, and $R_{154}$ have the same meanings as above. $R_{155}$ represents a group having the same meaning as $R_{153}$. When p and q are 2 or more, a plurality of $R_{117}$'s can be the same or different, and adjacent $R_{117}$'s can combine with each other to form a ring. In preferable forms of formulas (I-E1) and (I-E2), at least one ortho position to the hydroxyl group is substituted by $R_{153}CONH$—, $R_{152}OCONH$—, or $R_{153}(R_{154})NCONH$—.

$R_{118}$ represents a substituent, r presents an integer from 0 to 6, and s represents an integer from 0 to 5. r preferably represents 2, 3, or 4, and s preferably represents 2 or 3. Preferable examples of a substituent represented by $R_{118}$ are $R_{153}CON(R_{154})$—, $R_{152}OCON(R_{153})$—, $R_{152}SO_2N(R_{153})$—, $R_{153}(R_{154})NCON(R_{155})$—, $R_{152}S$—, $R_{152}O$—, $R_{153}(R_{154})NCO$—, $R_{153}(R_{154})NSO_2$—, $R_{153}OCO$—, a cyano group, and halogen atom. $R_{152}$, $R_{153}$, and $R_{154}$ have the same meanings as above. $R_{155}$ represents a group having the same meaning as $R_{153}$. When r and s are 2 or more, a plurality of $R_{118}$'s can be the same or different, and adjacent $R_{118}$'s can combine with each other to form a ring. In preferable forms of formulas (I-F1), (IF-2), and (I-F3), an ortho position to the hydroxyl group is substituted by $R_{153}CONH$—, $R_{153}HNCONH$—, or $R_{153}NHCO$—.

$R_{119}$ represents a substituent, preferably $R_{152}$—, $R_{153}CON(R_{154})$—, $R_{152}SO_2N(R_{153})$—, $R_{152}S$—, $R_{152}O$—, $R_{152}OCON(R_{153})$—, $R_{153}(R_{154})NCON(R_{155})$—, $R_{152}OCO$—, $R_{153}(R_{154})NSO_2$—, $R_{153}(R_{154})NCO$—, a halogen atom, or cyano group, and more preferably a group represented by $R_{152}$. $R_{152}$, $R_{153}$, and $R_{154}$ have the same meanings as above. $R_{155}$ represents a group having the same meaning as $R_{153}$.

Each of $R_{120}$ and $R_{121}$ independently represents a substituent, preferably $R_{152}$—, $R_{153}CON(R_{154})$—, $R_{152}SO_2N(R_{153})$—, $R_{152}S$—, $R_{152}O$—, $R_{152}OCON(R_{153})$—, $R_{153}(R_{154})NCON(R_{155})$—, $R_{153}(R_{154})NCO$—, $R_{153}(R_{154})NSO_2$—, $R_{152}OCO$—, a halogen atom, or cyano group, and more preferably $R_{153}(R_{154})NCO$—, $R_{153}(R_{154})NSO_2$—, a trifluoromethyl group, $R_{152}OCO$—, or cyano group. $R_{152}$, $R_{153}$, and $R_{154}$ have the same meanings as above. $R_{155}$ represents a group having the same meaning as $R_{153}$.

B represents a linking group having an electrophilic portion and capable of releasing X, along with forming a ring and without forming a dye, by intramolecular nucleophilic substitution between the electrophilic portion and a nitrogen atom that is originated from the developing agent and that is contained in a product of the reaction of A' with the oxidized form of the developing agent. A preferable form of B can be represented by the following formula:

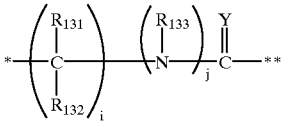

wherein * represents a portion binding to A', ** represents a portion binding to X, and Y has the same meaning as above. $R_{131}$, $R_{132}$, $R_{133}$ represent groups having the same meanings as $R_{153}$. i represents an integer from 0 to 3, and j represents 0 or 1. $R_{131}$ or $R_{132}$ can combine with A' or $R_{133}$ to form a ring. When i is 2 or 3, adjacent $R_{131}$'s or $R_{132}$'s can combine with each other to form a ring. Each of $R_{131}$ and $R_{132}$ is preferably a hydrogen atom or (1- to 20-carbon, preferably 1- to 10-carbon) aliphatic group, and more preferably a hydrogen atom. $R_{133}$ is preferably a 1- to 32-carbon aliphatic group, and more preferably a 1- to 22-carbon aliphatic group. j is preferably 1. i is preferably 1 in formulas (I-A1), (I-B1), (I-C1), (I-D1), (I-E1), (I-F1), and (I-G1). i is preferably 0 or 1 in formulas (I-A2), (I-B2), (I-C2), (I-D2), (I-E2), (I-F3), and (I-G2). i is preferably 0 in formula (I-F2).

X represents a development inhibitor or its precursor group. Preferable forms of X are represented by $$**\text{-}(\text{TIME})_k\text{-DI},$$

or $$**\text{-}(\text{TIME})_j\text{-RED-DI}$$

wherein ** represents a portion binding to B, TIME represents a timing group capable of releasing DI after being released from A', RED represents a group that cleaves DI by reacting with an oxidized form of a developing agent after RED splits off from A' or TIME, k represents an integer from 0 to 2, j represents 0 or 1, and DI represents a development inhibitor.

TIME, RED, and DI have the same meanings as described in formulas (D3) and (D4).

Formula (D2) is more preferably represented by formula (I-F2') below and especially preferably represented by formula (I-F2") below:

(I-F2')

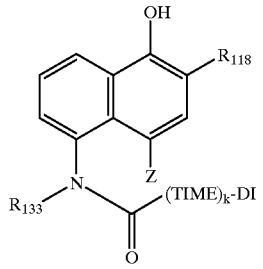

(I-F2")

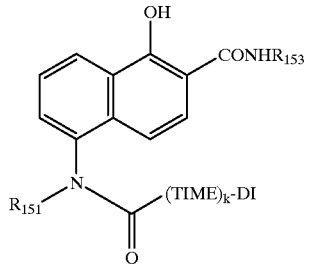

wherein Z, TIME, k, DI, $R_{118}$, $R_{133}$, $R_{151}$, and $R_{153}$ have the same meanings as above.

Of compounds represented by formulas (D1) and (D2), a compound represented by formula (D2) is preferable.

Practical representative examples of compounds represented by formulas (D1) and (D2) used in the present invention will be presented below. However, the present invention is not limited to these examples.

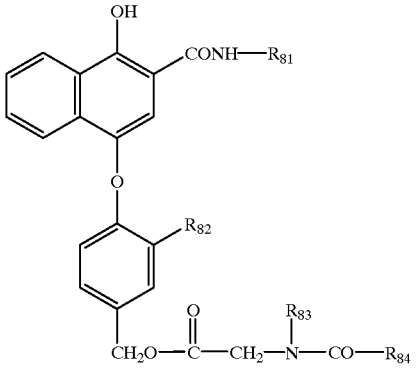
| No. | $R_{81}$ | $R_{82}$ | $R_{83}$ | $R_{84}$ |
|---|---|---|---|---|
| D-1 | —$CH_3$ | —$NHSO_2C_{16}H_{33}(n)$ | —$C_6H_5$ | 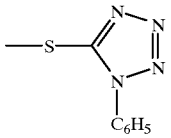 |
| D-2 | —H | —$NHSO_2C_{16}H_{33}(n)$ | —$C_6H_5$ | 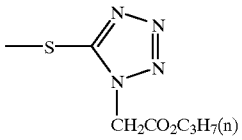 |
| D-3 | —$CH_2CH_2OCH_3$ | —$NHSO_2C_{16}H_{33}(n)$ | —$C_6H_5$ | 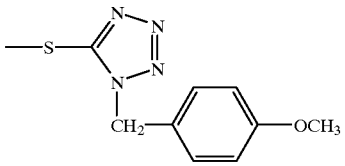 |
D-4
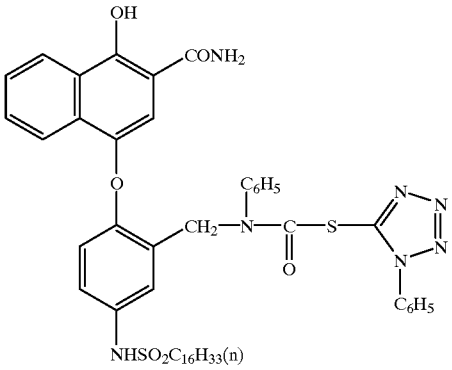
D-5

-continued
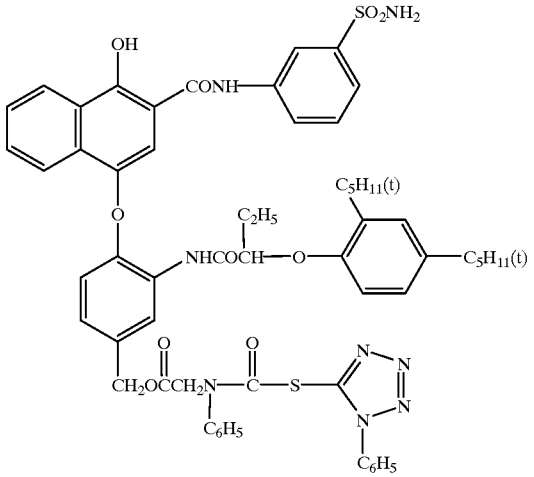
D-6
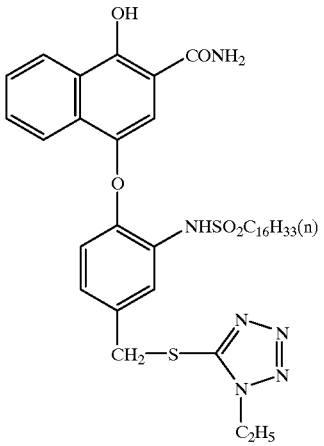
D-7
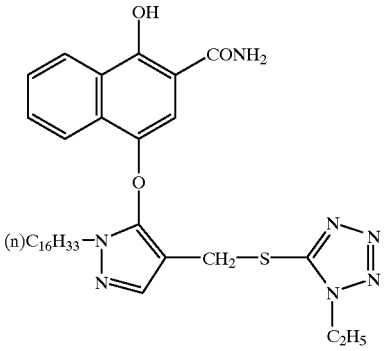
D-8

-continued
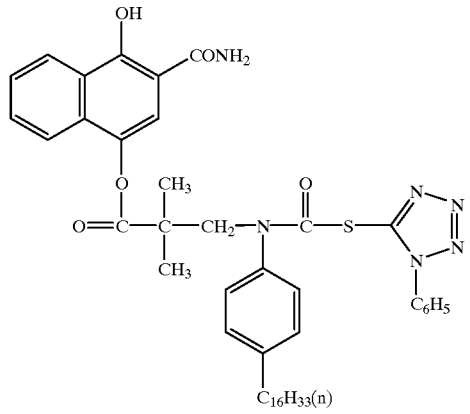
D-9
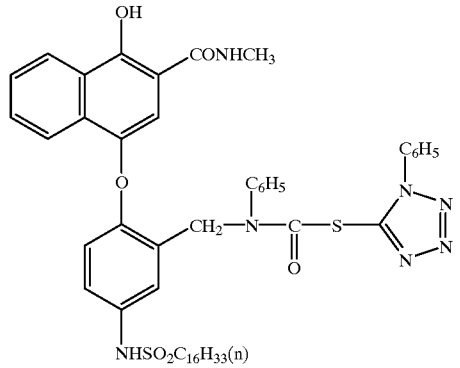
D-10
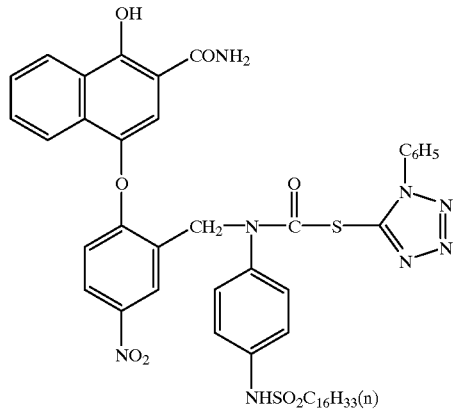
D-11
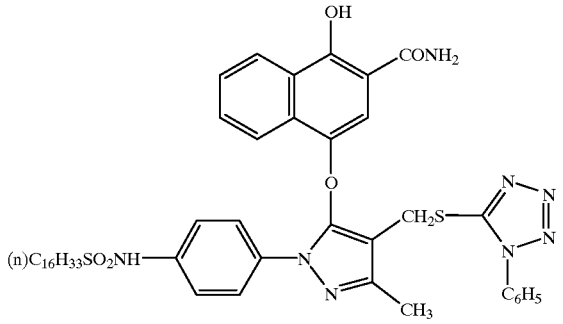

-continued
D-12
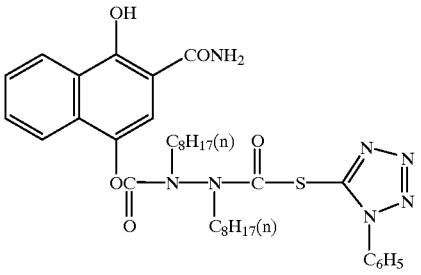
D-13
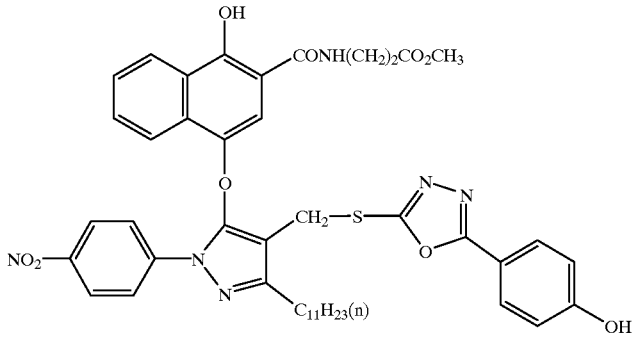
D-14
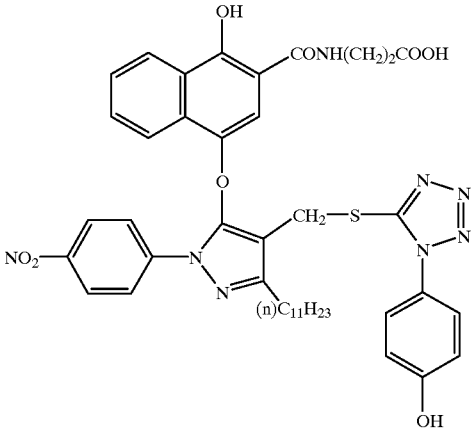
D-15
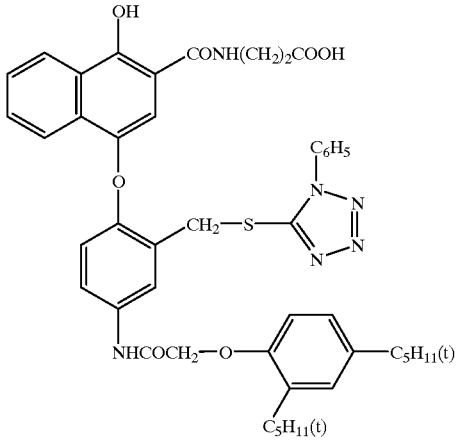

-continued
D-16
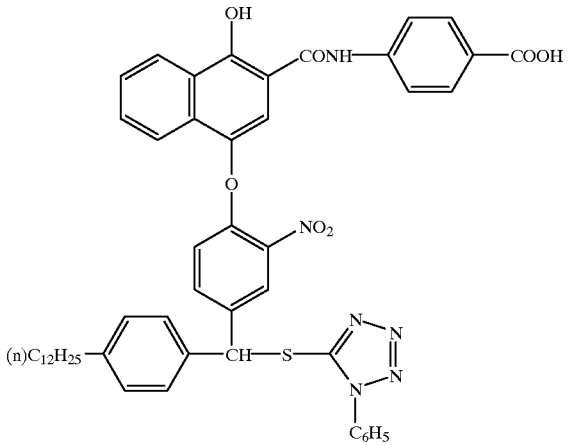
D-17
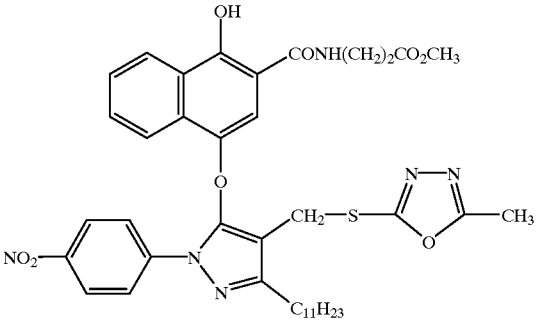
D-18
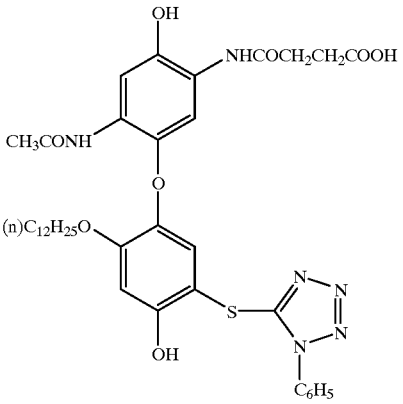
D-19

-continued
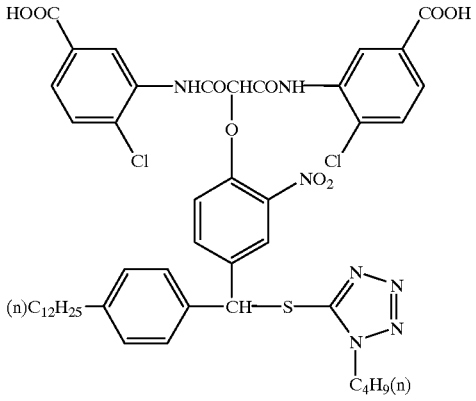
D-20
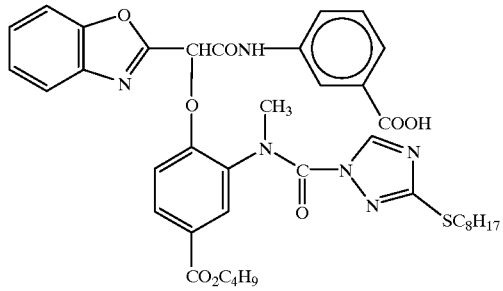
D-21
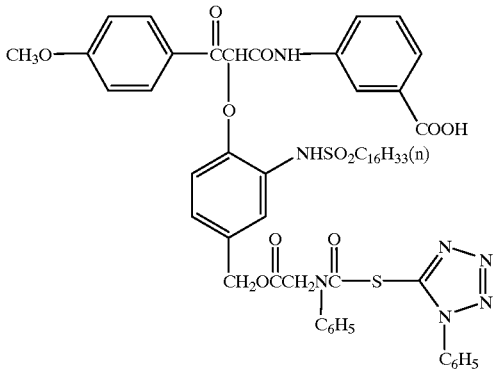
D-22
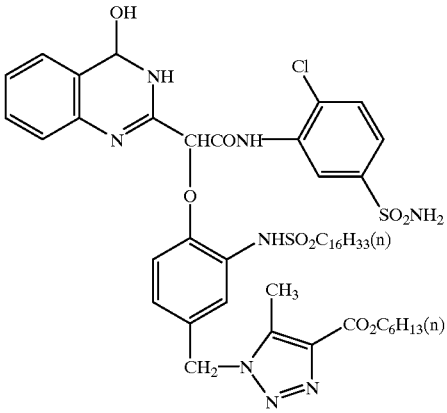

-continued
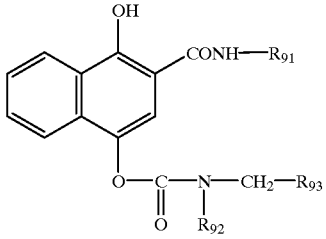
| No. | $R_{91}$ | $R_{92}$ | $R_{93}$ |
|---|---|---|---|
| D-23 | H | 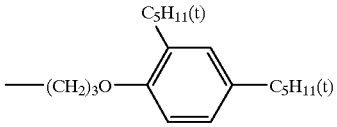 | 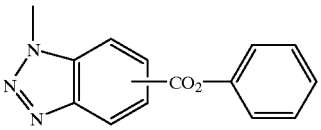 |
| D-24 | $—CH_2CO_2CH_3$ | $—(CH_2)_3OC_{12}H_{25}(n)$ | 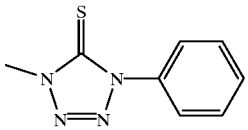 |
| D-25 | $—(CH_2)_2CO_2H$ | 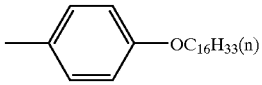 | 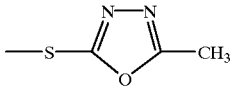 |
| D-26 | $—CH_2CONHCH_2CO_2CH_3$ | 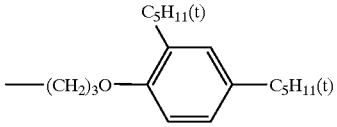 | 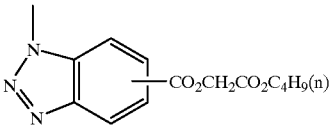 |
| D-27 | $—SO_2CH_3$ | $—CH_2CO_2C_{14}H_{29}(n)$ | 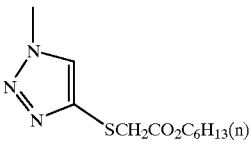 |
| D-28 | 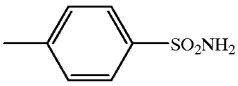 | $—(CH_2)_3OC_{12}H_{25}(n)$ | 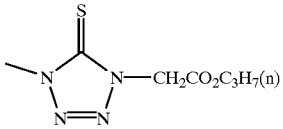 |
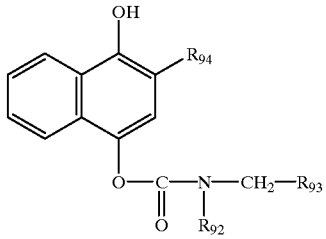
| No. | $R_{94}$ | $R_{92}$ | $R_{93}$ |
|---|---|---|---|
| D-29 | $—CO_2H$ | 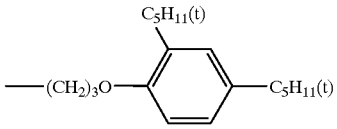 | 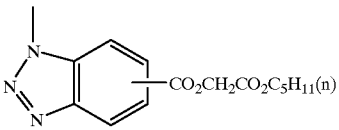 |

-continued
| | | | |
|---|---|---|---|
| D-30 | $—CO_2CH_3$ | $—C_6H_4—CO_2C_{16}H_{33}(n)$ | 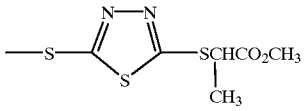 |
| D-31 | —CN | $—(CH_2)_3OC_{14}H_{29}(n)$ | 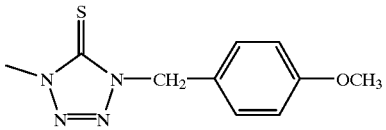 |
| D-32 | $—SO_3H$ | $—CH_2CO_2C_{16}H_{33}(n)$ | 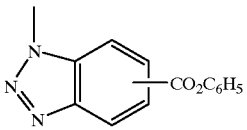 |
| D-33 | $—SO_2NH_2$ | $—(CH_2)_4OCH_2CH(C_6H_{13}(n))C_8H_{17}(n)$ | 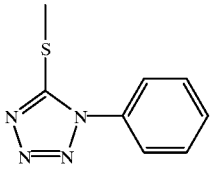 |
| D-34 | $—CONHCONH_2$ | $—CH_2—C_6H_4—CO_2C_{12}H_{25}(n)$ | 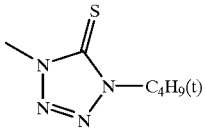 |
| D-35 | 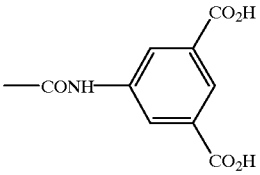 | 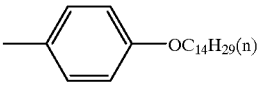 | 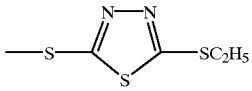 |
| D-36 | 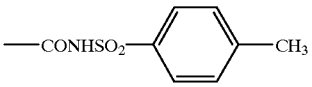 | $—(CH_2)_3OC_{14}H_{29}(n)$ | 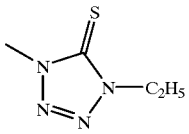 |
| D-37 | $—CONHCH_2CO_2CH_2CO_2CH_3$ | 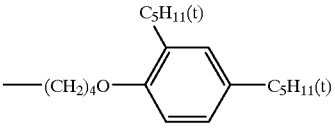 | 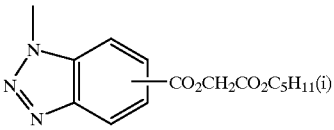 |
| D-38 | $—CONHCH_3$ | 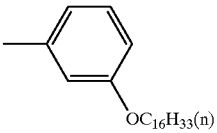 | 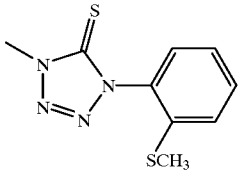 |

-continued
| | | | |
|---|---|---|---|
| D-39 | —CONH(CH$_2$)$_2$OH | —(CH$_2$)$_3$OC$_{12}$H$_{25}$(n) | 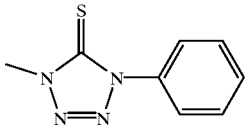 |
| D-40 | —CONHSO$_2$N(CH$_3$)$_2$ | 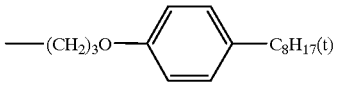 | 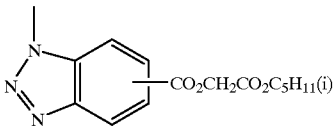 |
D-41
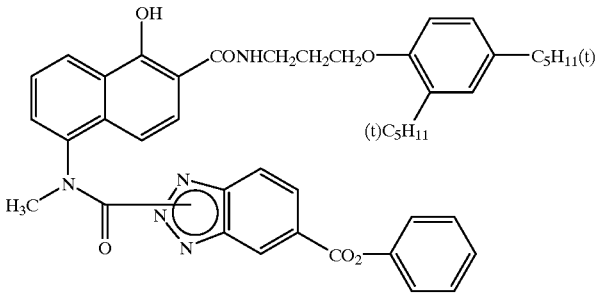
D-42
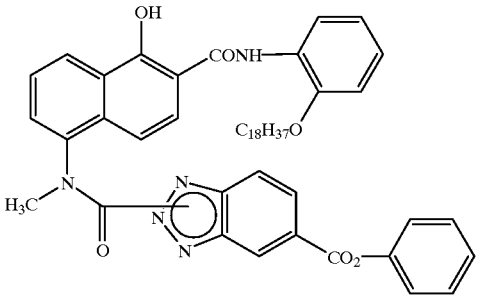
D-43
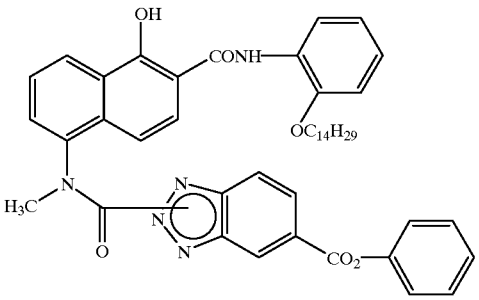
D-44

-continued
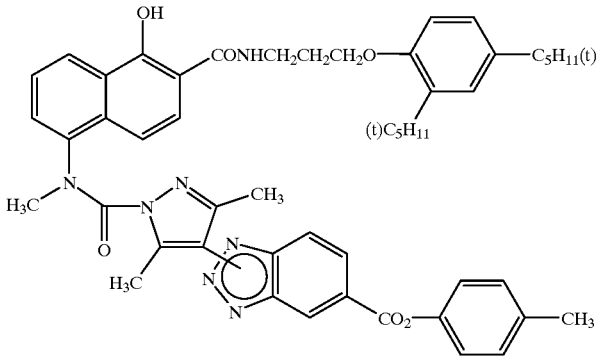
D-45
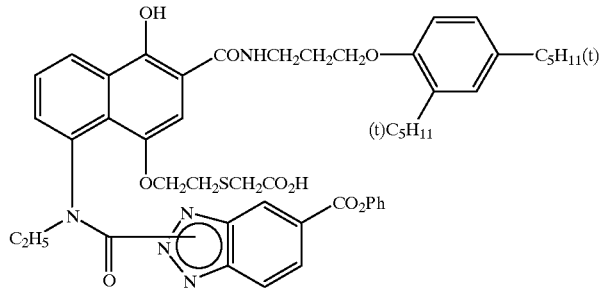
D-46
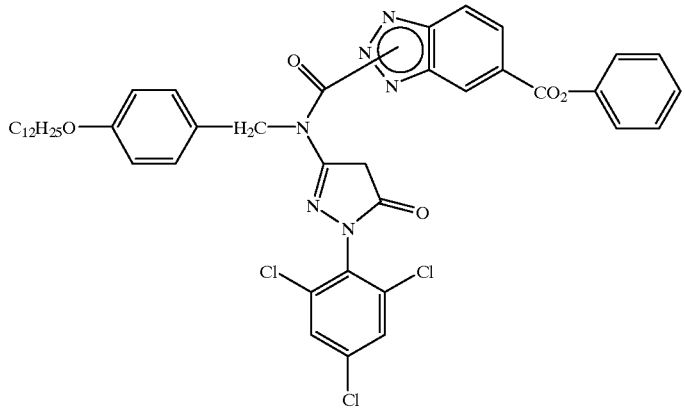
D-47
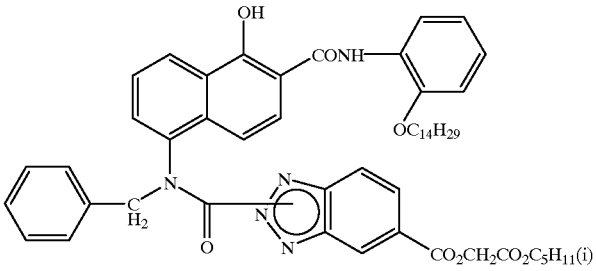
D-48

-continued
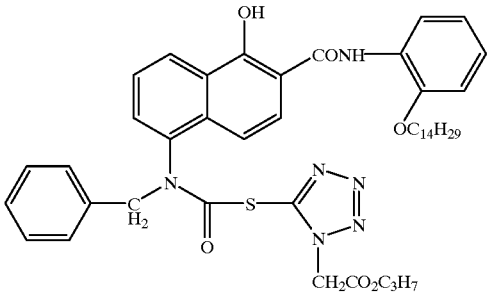
D-49
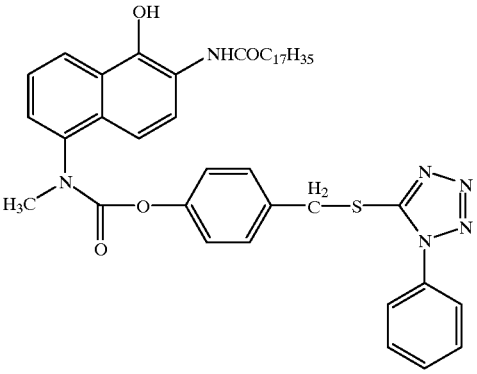
D-50
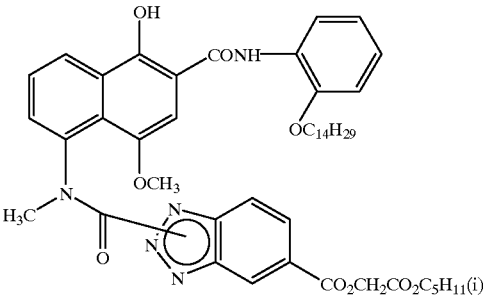
D-51
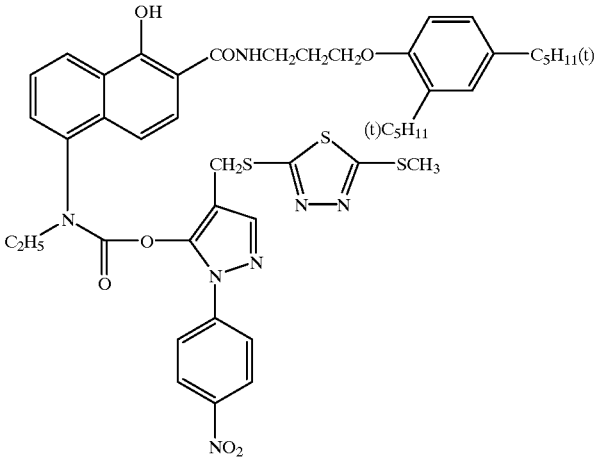
D-52

-continued
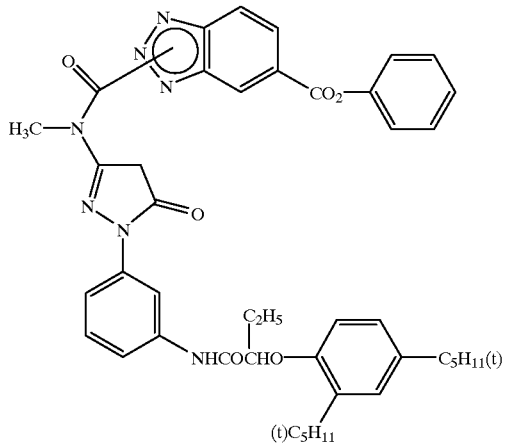
D-53
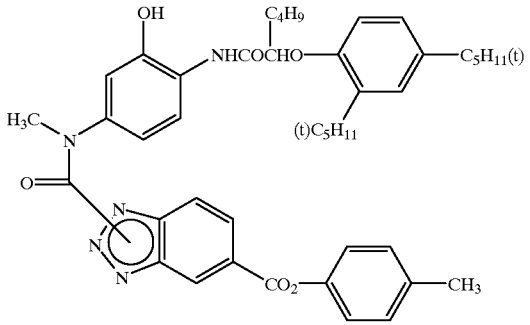
D-54
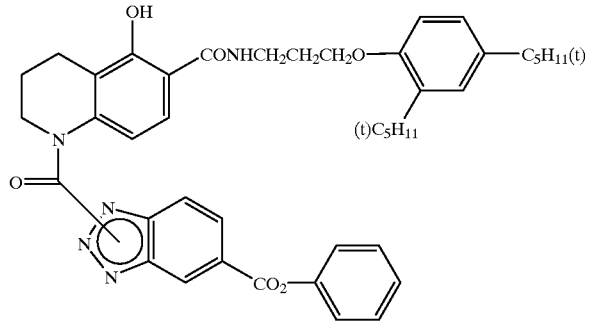
D-55

-continued
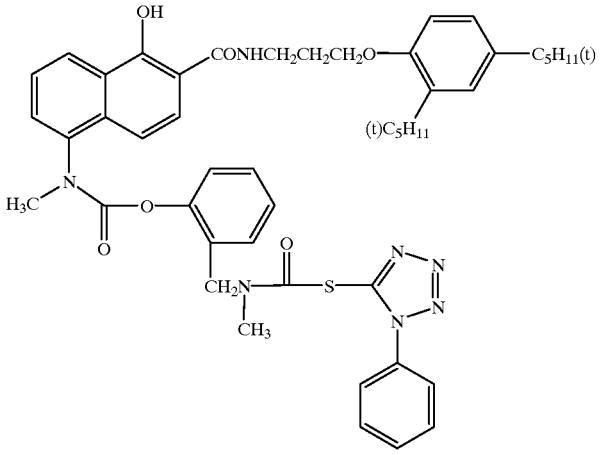
D-56
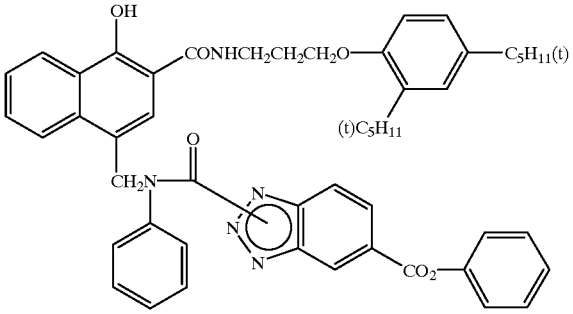
D-57
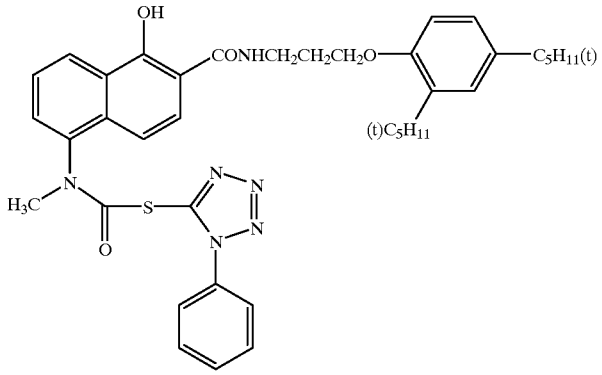
D-58
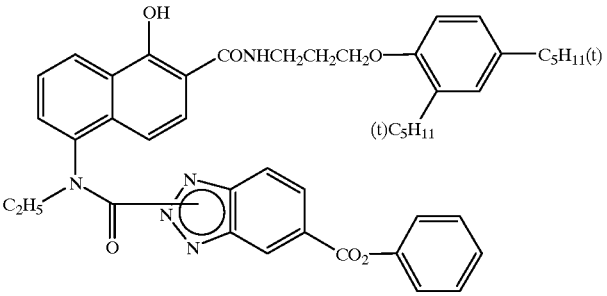
D-59

-continued
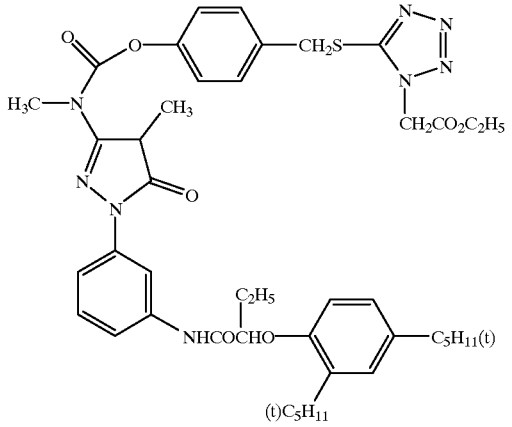
D-60
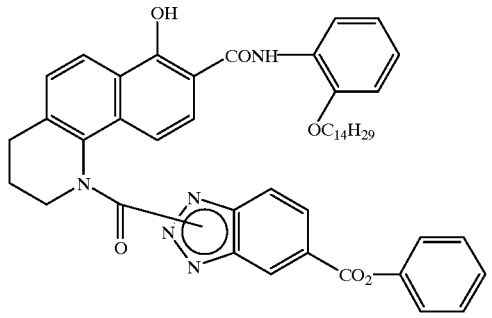
D-61
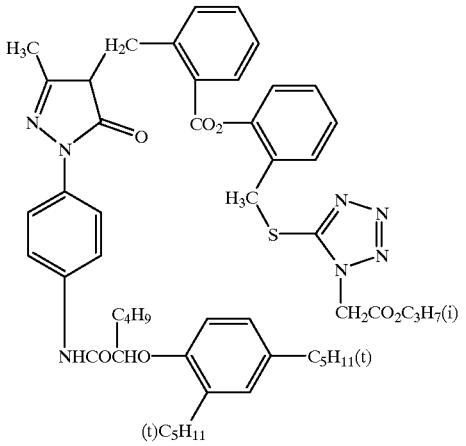
D-62

-continued
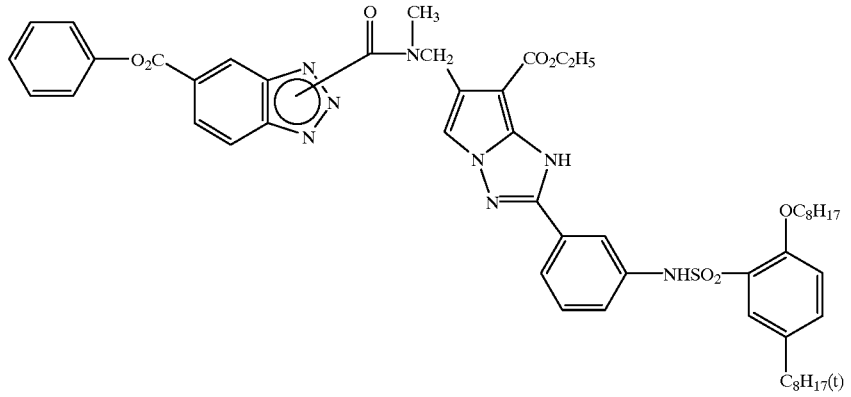
D-63
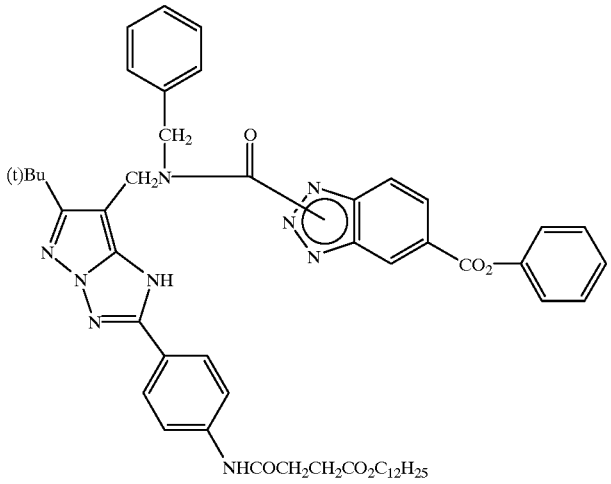
D-64
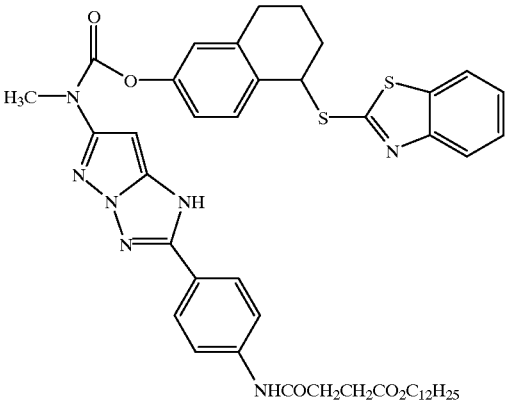
D-65

-continued
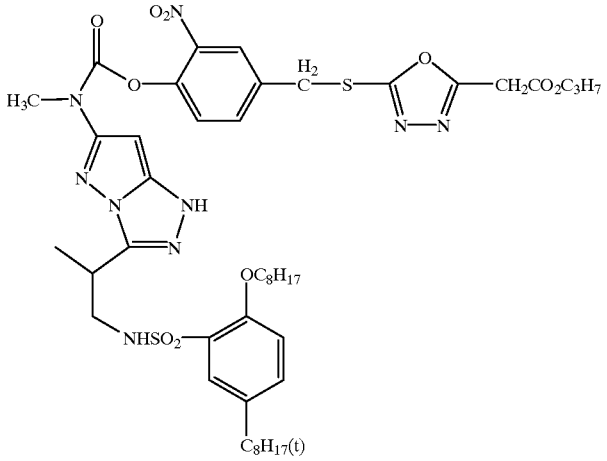
D-66
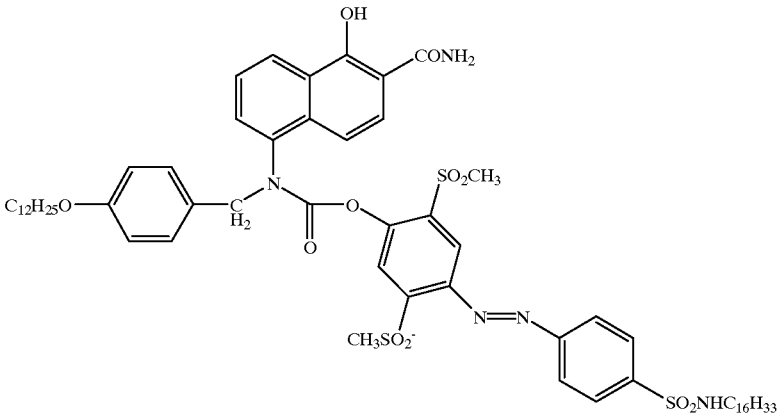
D-67
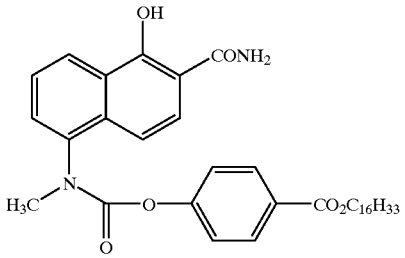
D-68
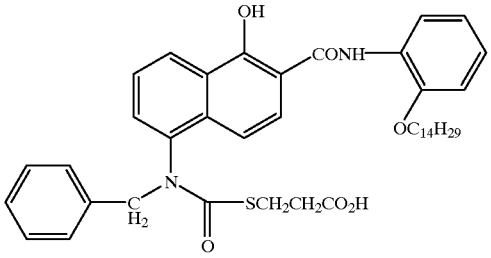
D-69

-continued
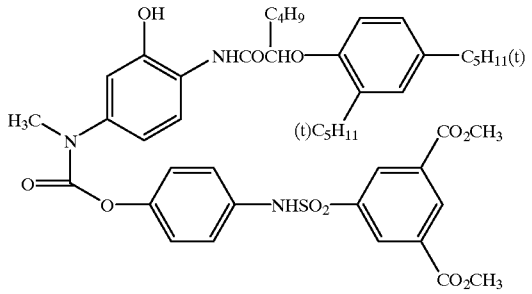
D-70
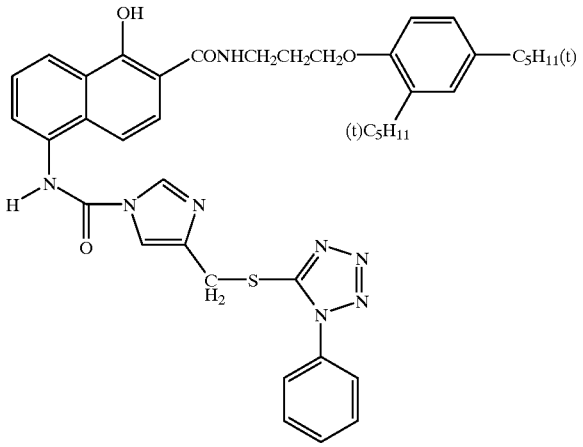
D-71
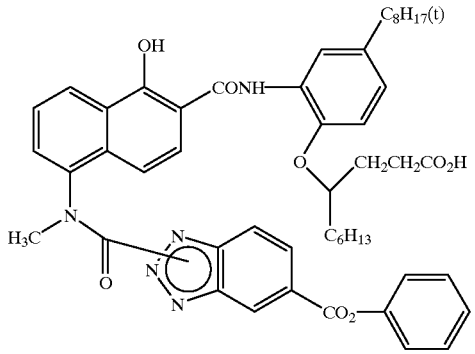
D-72
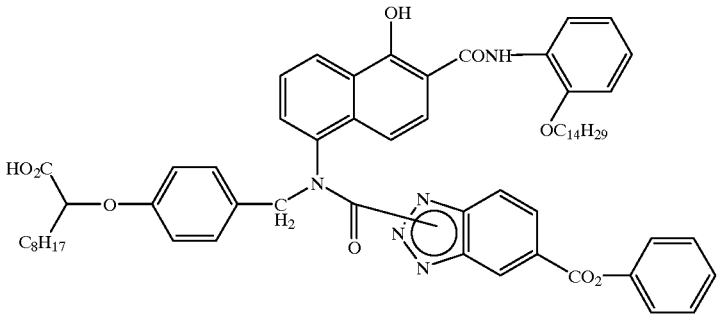
D-73

-continued
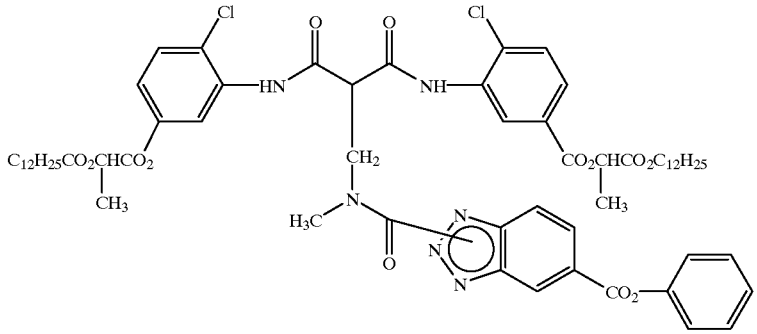
D-74
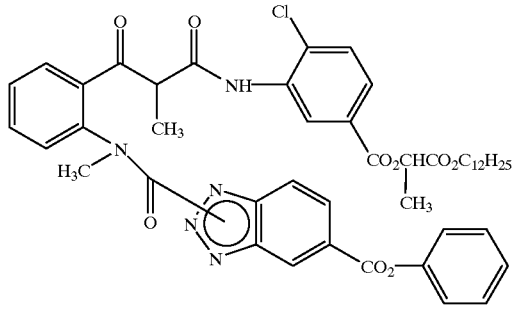
D-75
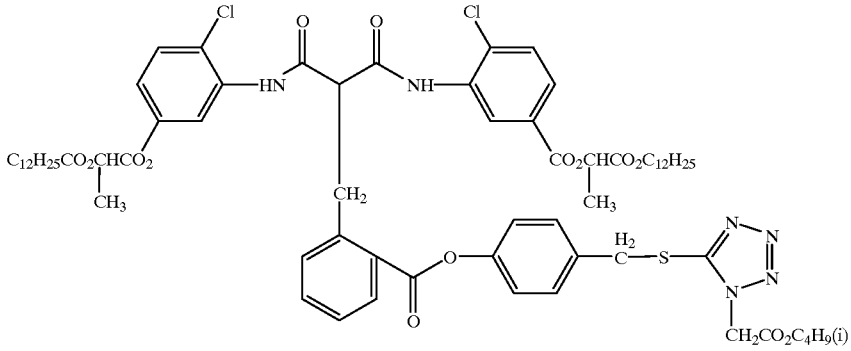
D-76
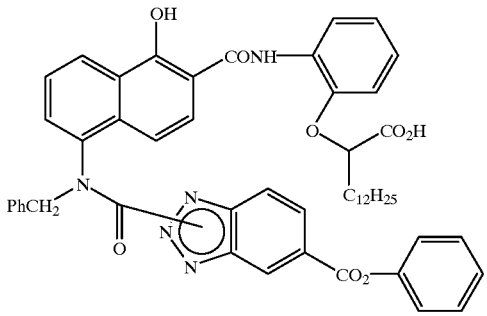
D-77

-continued

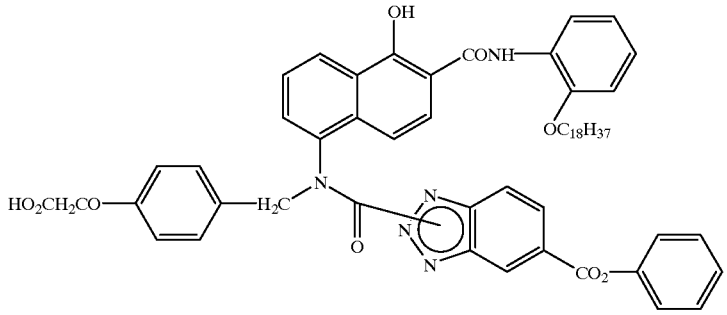

D-78

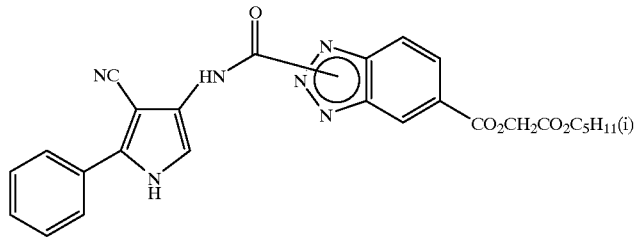

D-79

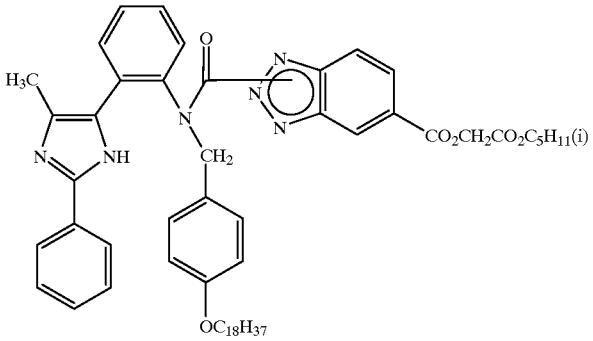

D-80

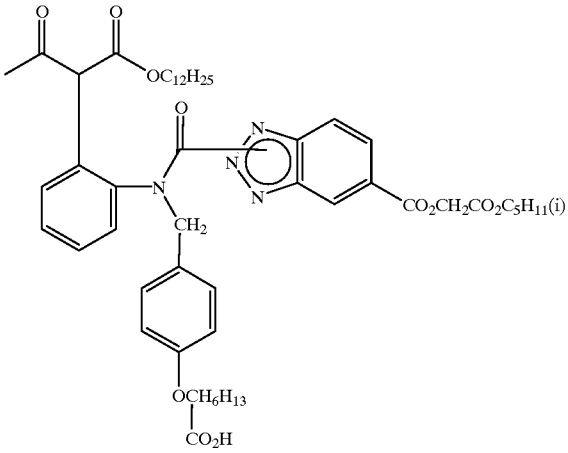

Methods of synthesizing a compound represented by formula (D1) are described in, e.g., the know patents and references cited to explain TIME, RED, and DI, JP-A-61-156127, JP-A-58-160954, JP-A-58-162949, JP-A-61-249052, JP-A-63-37350, U.S. Pat. No. 5,026,628, EP443530A2, and EP444501A2, the disclosures of which are herein incorporated by reference.

Practical examples of synthesis of a compound represented by formula (D2) will be described below.

Synthesis of coupler of compound example D-43

A coupler of a compound example D-43 was synthesized in accordance with the following scheme:

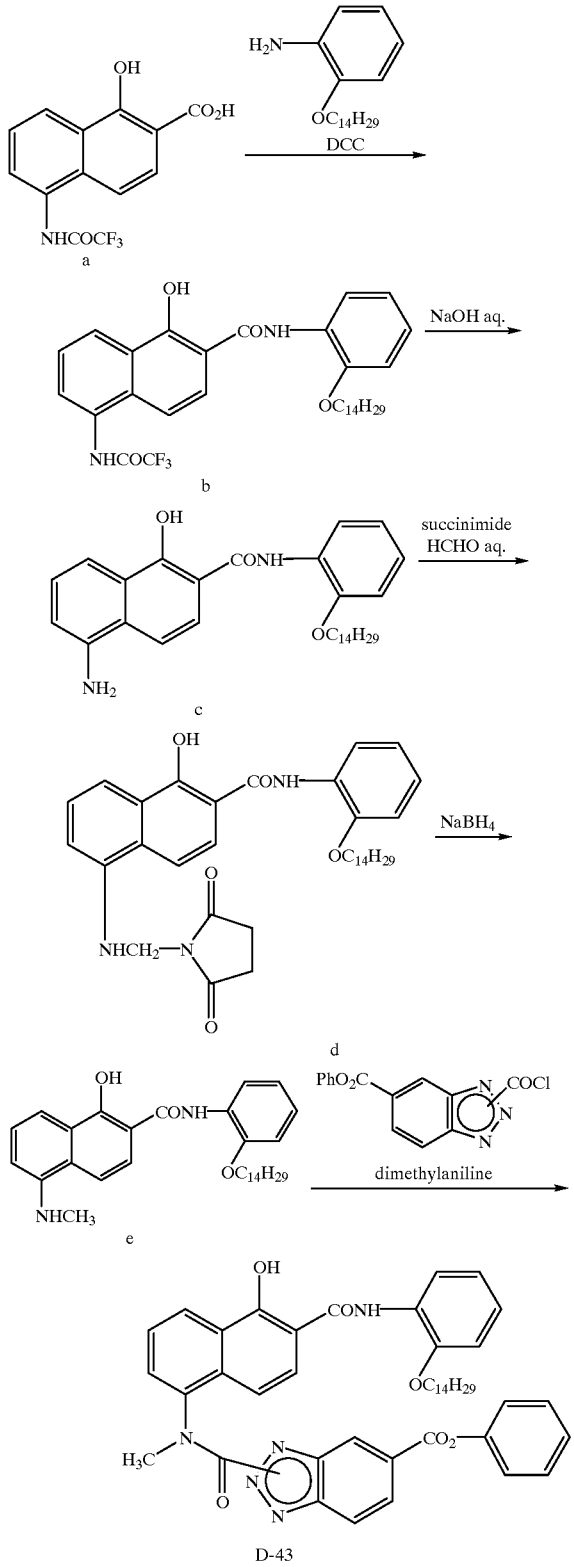

Synthesis of Compound b

A dimethylacetamide (60 mL) solution of dicyclohexacarbodiamide (41.3 g) was dropped into a dimethylacetamide (250 mL) solution of a compound a (50 g) and o-tetradecyloxyaniline (51.1 g) at 30° C. After the reaction solution was stirred at 50° C. for 1 hr, ethyl acetate (250 mL) was added, and the resultant solution was cooled to 20° C. The reaction solution was filtered by suction, and 1N hydrochloric acid solution (250 mL) was added to the filtrate to separate it. Hexane (100 mL) was added to the organic layer, and the separated crystals were filtered out, washed with acetonitrile, and dried to obtain a compound b (71 g).

Synthesis of Compound c

An aqueous solution (150 mL) of sodium hydroxide (30 g) was dropped into a methanol (350 mL)/tetrahydrofuran (70 mL) solution of the compound b (71 g). The resultant solution was stirred in a nitrogen atmosphere at 60° C. for 1 hr. After the reaction solution was cooled to 20° C., concentrated hydrochloric acid was dropped until the system became acidic. The separated crystals were filtered out, washed with water and acetonitrile, and dried to obtain a compound c (63 g).

Synthesis of Compound d

An ethanol solution (150 mL) of the compound c (20 g), succinic acid imide (5.25 g), and an aqueous 37% formalin solution (4.3 mL) was stirred under reflux for 5 hrs. After the resultant solution was cooled to 20° C., the separated crystals were filtered out and dried to obtain a compound d (16 g).

Synthesis of Compound e

Sodium boron hydride (1.32 g) was slowly added to a dimethylsulfoxide (70 mL) solution of the compound d (7 g) at 60° C. such that the temperature did not exceed 70° C. The resultant solution was stirred at the same temperature for 15 min. After the reaction solution was slowly added to 1N hydrochloric acid water (100 mL), ethyl acetate (100 mL) was added for extraction. The organic layer was washed with water, dried by magnesium sulfate, and condensed at reduced pressure. After a placing point component was removed by a short-passage column (developing solvent: ethyl acetate/hexane=2/1), the resultant material was recrystallized from the ethyl acetate/hexane system to obtain a compound e (3.3 g).

Synthesis of Compound Example D-43

A dichloromethane (100 mL)/ethyl acetate (200 mL) solution of phenoxycarbonylbenzotriazole (4.78 g) and dimethylaniline (2.42 g) was dropped into dichloromethane (80 mL) of triphosgene (1.98 g). The resultant solution was stirred at 20° C. for 2 hrs (Solution S).

120 mL of this solution S were dropped into a tetrahydrofuran (20 mL)/ethyl acetate (20 mL) solution of the compound e (2.0 g) and dimethylaniline (0.60 g). The resultant solution was stirred at 20° C. for 2 hrs. After the reaction solution was slowly added to 1N hydrochloric acid water (200 mL), ethyl acetate (200 mL) was added for extraction. The organic layer was washed with water, dried by magnesium sulfate, and concentrated at reduced pressure. The resultant material was purified through a column (developing solvent: ethyl acetate/hexane=1/5) and recrystallized from the ethyl acetate/hexane system to obtain a compound example D-43 weighing 1.3 g. (The melting point of the obtained crystal was 138 to 140° C., and the crystal was identified as the compound example D-43 by elementary analysis, NMR, and mass spectrum.)

Synthesis of Coupler of Compound Example D-56

A coupler of a compound example D-56 was synthesized in accordance with the following scheme:

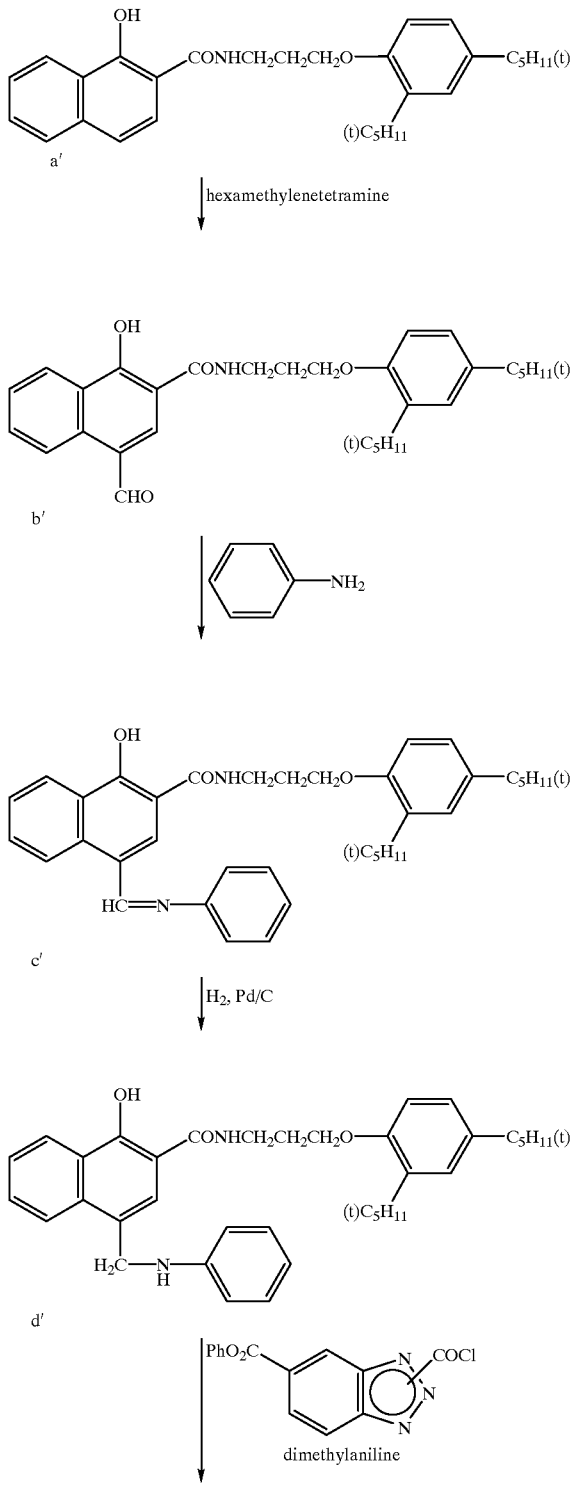

-continued

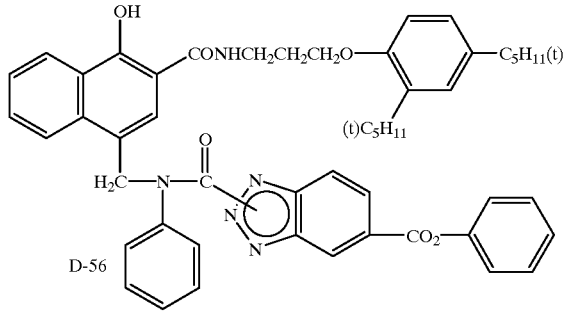

Synthesis of Compound b'

A compound a' (23.1 g), hexamethylenetetramine (7.1 g), and $Na_2SO_3$ (6.3 g) were stirred in glacial acetic acid (150 mL) at 90° C. for 4 hrs. After the resultant solution was cooled to 20° C., the separated crystals were filtered out, washed with a small amount of methanol, and dried to obtain a compound b' (19.8 g).

Synthesis of Compound d'

A toluene (200 mL) solution of the compound b' (15.0 g) and aniline (3.0 g) was stirred under reflux for 5 hrs while water was removed. After the resultant material was cooled to 20° C., ethyl acetate (100 mL) was added, and the material was dried by magnesium sulfate and concentrated at reduced pressure to obtain a coarse compound c'. 10%-Pd/C (5 g) and ethyl acetate (200 mL) were added to this coarse compound c', and the material was stirred in 20 kg/cm$^2$ a hydrogen atmosphere at room temperature for 3 hrs. The catalyst was filtered away, and the resultant material was concentrated at reduced pressure. The concentrated residue was recrystallized from the ethyl acetate/hexane system to obtain a compound d' (13.0 g).

Synthesis of Compound Example D-56

The solution S (100 mL) was dropped into an ethyl acetate (10 mL) solution of the compound d' (2.5 g) and dimethylaniline (0.55 g) at 10° C. The resultant solution was stirred at 20° C. for 2 hrs. The reaction solution was slowly added to 1N hydrochloric acid solution (200 mL), and ethyl acetate (200 mL) was added for extraction. The organic layer was washed with water, dried by magnesium sulfate, and concentrated at reduced pressure. The resultant material was purified through a column (developing solvent: ethyl acetate/hexane=1/3) and recrystallized from the ethyl acetate/hexane system to obtain a compound example D-56 weighing 2.3 g. (The melting point of the obtained crystal was 150 to 152° C., and the crystal was identified as the compound example D-56 by elementary analysis, NMR, and mass spectrum.)

Development inhibitor releasing compounds represented by formulas (D1) and (D2) of the present invention can be used in any layer of a sensitive material. That is, these development inhibitor releasing compounds can be used in any of sensitive layers (blue- , green- , and red-sensitive layers, and interlayer effect donor layers having different spectral sensitivity distributions from those of these main sensitive layers) and non-sensitive layers (e.g., a protective layer, a yellow filter layer, an interlayer, and an antihalation layer). When a layer sensitive to one color is divided into two or more layers having different sensitivities, development inhibitor releasing compounds can be added to any or all of highest- , lowest- , and medium-sensitive layers. Development inhibitor releasing compounds are preferably added to a sensitive layer and/or a non-sensitive layer adjacent to the sensitive layer.

The coating amount of development inhibitor releasing compounds represented by formulas (D1) and (D2) in a sensitive material is $5\times10^{-4}$ to 2 g/m$^2$, preferably $1\times10^{-3}$ to 1 g/m$^2$, and more preferably $5\times10^{-3}$ to $5\times10^{-1}$ g/m$^2$.

Development inhibitor releasing compounds represented by formulas (D1) and (D2) can be added to a sensitive material by using any known dispersion method suited to compounds. For example, if a compound is soluble in alkali, the compound can be added as an aqueous alkaline solution or as a solution prepared by dissolving the compound in an organic solvent miscible with water. Alternatively, the compound can be added by an oil-in-water dispersion method using a high-boiling-point organic solvent or by a solid dispersion method.

Development inhibitor releasing compounds represented by formulas (D1) and (D2) can be used singly, or two or more types of these compounds can be used together. The same compound can also be used in two or more layers. Furthermore, these development inhibitor releasing compounds can be used together with other known development inhibitor releasing compounds or development inhibitor precursor releasing compounds and can coexist with couplers and other additives (to be described later). These compounds are properly selected in accordance with the properties required of a sensitive material.

A development inhibitor releasing compound represented by formula (D1) of the present invention releases a development inhibitor by coupling with an oxidized form of a developing agent, and its nucleus (A in the explanation of formula (D1)) forms a dye.

This dye formed flows out into a processing solution or extinguishes its color by bleaching as described in Japan Photographic Society Journal Vol. 52 (1989), No. 2, pp. 150 to 155 (Kida et al.) or Main Purports of Lectures in 1989 Japan Photographic Society Annual Meeting 2A0-22 (Kida). Although most of the dye flows out into a processing solution in the color development step, the dye can also flow out in the subsequent bleaching, fixing, and washing steps. Accordingly, the formed dye does not remain as a dye in a sensitive material after color development.

A development inhibitor releasing compound represented by formula (D2) of the present invention couples with an oxidized form of a developing agent and releases a development inhibitor through intramolecular nucleophilic substitution which occurs subsequently to the coupling reaction. However, a nucleus (A' in the explanation of formula (D2)) of this compound does not form a dye and remains as a compound which does not leave a color image in a sensitive material.

Development inhibitor releasing compounds represented by formulas (D1) and (D2) of the present invention, therefore, can be advantageously used in any layer constructing a sensitive material, e.g., any of red- , green- , and blue-sensitive layers, in accordance with the properties required of the sensitive material. Additionally, a dye formed by a compound represented by formula (D1) does not remain as a dye. This improves the color reproduction and also improves the dye stability in some instances. A compound represented by formula (D2) forms a compound which does not leave a color image, and this compound formed remains in a sensitive material. Hence, a compound represented by formula (D2) is advantageous in that the compound does not flow out into a processing solution to pollute the solution.

In a silver halide color photosensitive material of the present invention, sensitive layers are generally arranged in the order of red- , green- , and blue-sensitive layers from a support. However, according to the intended use, this order of arrangement can be reversed, or sensitive layers sensitive to the same color can sandwich another sensitive layer sensitive to a different color. Non-sensitive layers can be formed between the silver halide sensitive layers and as the uppermost layer and the lowermost layer. These non-sensitive layers can contain, e.g., couplers, DIR compounds, and color amalgamation inhibitors to be described later. As a plurality of silver halide emulsion layers constituting each unit sensitive layer, as described in DE1,121,470 or GB923,045, the disclosures of which are herein incorporated by reference, high- and low-speed emulsion layers are preferably arranged such that the sensitivity is sequentially decreased toward a support. Also, as described in JP-A-57-112751, JP-A-62-200350, JP-A-62-206541, and JP-A-62-206543, the disclosures of which are herein incorporated by reference, layers can be arranged such that a low-speed emulsion layer is formed apart from a support and a high-speed layer is formed close to the support. When a sensitive material of the present invention has a plurality of silver halide emulsion layers forming each unit sensitive layer, the total of these silver halide emulsion layers satisfies the barycentric wavelength of the spectral sensitivity distribution and the like of each sensitive layer defined by the present invention.

More specifically, layers can be arranged from the farthest side from a support in the order of low-speed blue-sensitive layer (BLL)/high-speed blue-sensitive layer (BLH)/high-speed green-sensitive layer (GLH)/low-speed green-sensitive layer (GLL)/high-speed red-sensitive layer (RLH)/low-speed red-sensitive layer (RLL), the order of BLH/BLL/GLL/GLH/RLH/RLL, or the order of BLH/BLL/GLH/GLL/RLL/RLH.

In addition, as described in JP-B-55-34932, layers can be arranged from the farthest side from a support in the order of blue-sensitive layer/GLH/RLH/GLL/RLL. Furthermore, as described in JP-A-56-25738 and JP-A-62-63936, layers can be arranged from the farthest side from a support in the order of blue-sensitive layer/GLL/RLL/GLH/RLH.

As described in JP-B-49-15495, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward a support. When a layer structure is thus constituted by three layers having different sensitivities, these layers can be arranged, in a layer sensitive to one color, in the order of medium-speed emulsion layer/high-speed emulsion layer/low-speed emulsion layer from the farthest side from a support as described in JP-A-59-202464.

In addition, the order of high-speed emulsion layer/low-speed emulsion layer/medium-speed emulsion layer or low-speed emulsion layer/medium-speed emulsion layer/high-speed emulsion layer can be used. Furthermore, the arrangement can be changed as described above even when four or more layers are formed.

A silver halide used in the present invention is silver iodobromide, silver iodochloride, or silver bromochloroiodide containing about 30 mol % or less of silver iodide. A silver halide is especially preferably silver iodobromide or silver bromochloroiodide containing about 2 to about 10 mol % of silver iodide.

Silver halide grains contained in a photographic emulsion can have regular crystals such as cubic, octahedral, or tetradecahedral crystals, irregular crystals such as spherical or tabular crystals, crystals having crystal defects such as twin planes, or composite shapes thereof.

A silver halide can consist of fine grains having a grain size of about 0.2 $\mu$m or less or large grains having a projected area diameter of about 10 $\mu$m, and an emulsion can be either a polydisperse or monodisperse emulsion.

A silver halide photographic emulsion which can be used in the present invention can be prepared by methods described in, e.g., "I. Emulsion preparation and types," Research Disclosure (RD) No. 17643 (December, 1978), pp. 22 and 23, RD No. 18716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, e.g., U.S. Pat. No. 3,574,628, U.S. Pat. No. 3,655,394, and GB1,413,748 are also preferable.

Tabular grains having an aspect ratio of 3 or more can also be used in the present invention. Tabular grains can be easily prepared by methods described in Gutoff, "Photographic Science and Engineering", Vol. 14, pp. 248 to 257 (1970); and U.S. Pat. No. 4,434,226, U.S. Pat. No. 4,414,310, U.S. Pat. No. 4,433,048, U.S. Pat. No. 4,439,520, and GB2,112,157.

A crystal structure can be uniform, can have different halogen compositions in the interior and the surface layer thereof, or can be a layered structure. Alternatively, a silver halide having a different composition can be bonded by an epitaxial junction or a compound except for a silver halide such as silver rhodanide or zinc oxide can be bonded. A mixture of grains having various types of crystal shapes can also be used.

The above emulsion can be any of a surface latent image type emulsion which mainly forms a latent image on the surface of a grain, an internal latent image type emulsion which forms a latent image in the interior a grain, and another type of emulsion which has latent images on the surface and in the interior of a grain. However, the emulsion must be a negative type emulsion. The internal latent image type emulsion can be a core/shell internal latent image type emulsion described in JP-A-63-264740. A method of preparing this core/shell internal latent image type emulsion is described in JP-A-59-133542. Although the thickness of a shell of this emulsion depends on, e.g., development conditions, it is preferably 3 to 40 nm, and especially preferably 5 to 20 nm.

A silver halide emulsion layer is normally subjected to physical ripening, chemical ripening, and spectral sensitization steps before it is used. Additives for use in these steps are described in RD Nos. 17643, 18716, and 307105, and they are summarized in a table to be presented later.

In a sensitive material of the present invention, it is possible to mix, in a single layer, two or more types of emulsions different in at least one of characteristics of a sensitive silver halide emulsion, i.e., a grain size, grain size distribution, halogen composition, grain shape, and sensitivity.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in sensitive silver halide emulsion layers and/or essentially non-sensitive hydrophilic colloid layers. The internally fogged or surface-fogged silver halide grain means a silver halide grain which can be developed uniformly (non-imagewise) regardless of whether the location is a non-exposed portion or an exposed portion of the sensitive material. A method of preparing the internally fogged or surface-fogged silver halide grain is described in U.S. Pat. No. 4,626,498 and JP-A-59-214852. A silver halide which forms the core of an internally fogged core/shell type silver halide grain can have a different halogen composition. As the internally fogged or surface-fogged silver halide, any of silver chloride, silver chlorobromide, silver bromoiodide, and silver bromochloroiodide can be used. The average grain size of these fogged silver halide grains is preferably 0.01 to 0.75 $\mu$m, and especially preferably 0.05 to 0.6 $\mu$m. The grain shape can be a regular grain shape. Although the emulsion can be a polydisperse emulsion, it is preferably a monodisperse emulsion (in which at least 95% in weight or number of grains of silver halide grains have grain sizes falling within a range of ±40% of the average grain size).

In the present invention, it is preferable to use a non-sensitive fine grain silver halide. The non-sensitive fine grain silver halide preferably consists of silver halide grains which are not exposed during imagewise exposure for obtaining a dye image and are not essentially developed during development. These silver halide grains are preferably not fogged in advance. In the fine grain silver halide, the content of silver bromide is 0 to 100 mol %, and silver chloride and/or silver iodide can be added if necessary. The fine grain silver halide preferably contains 0.5 to 10 mol % of silver iodide. The average grain size (the average value of equivalent-circle diameters of projected areas) of the fine grain silver halide is preferably 0.01 to 0.5 $\mu$m, and more preferably 0.02 to 2 $\mu$m.

The fine grain silver halide can be prepared following the same procedures as for a common sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine grain silver halide grain-containing layer.

The silver coating amount of a sensitive material of the present invention is preferably 6.0 g/m$^2$ or less, and especially preferably 4.5 g/m$^2$ or less.

Photographic additives usable in the present invention are also described in RDs, the disclosures of which are herein incorporated by reference, and the relevant portions are summarized in the following table.

| Types of additives | RD17643 | RD18716 | RD307105 |
|---|---|---|---|
| 1.Chemical sensitizers | page 23 | page 648 right column | page 866 |
| 2.Sensitivity increasing agents | | page 648 right column | |
| 3.Spectral sensitizers, super sensitizers | pages 23–24 | page 648, right column to page 649, right column | pages 866–868 |
| 4.Brighteners | page 24 | page 647, right column | page 868 |
| 5.Light absorbents, filter dyes, ultraviolet absorbents | pages 25–26 | page 649, right column to page 650, left column | page 873 |
| 6.Binders | page 26 | page 651, left column | pages 873–874 |
| 7.Plasticizers, lubricants | page 27 | page 650, right column | page 876 |
| 8.Coating aids, surfactants | pages 26–27 | page 650, right column | pages 875–876 |
| 9.Antistatic agents | page 27 | page 650, right column | pages 876–877 |
| 10.Matting agents | | | pages 878–879 |

Various dye forming couplers can be used in a sensitive material of the present invention, and the following couplers are particularly preferable.

Yellow couplers: couplers represented by formulas (I) and (II) in EP502,424A; couplers (particularly Y-28 on page 18) represented by formulas (1) and (2) in EP513,496A; a coupler represented by formula (I) in claim 1 of EP568,037A; a coupler represented by formula (I) in column 1, lines 45 to 55 of U.S. Pat. No. 5,066,576; a coupler represented by formula (I) in paragraph 0008 of JP-A-4-274425; couplers (particularly D-35 on page 18) described in claim 1 on page 40 of EP498,381A1; couplers (particularly Y-1 (page 17) and Y-54 (page 41)) represented by formula (Y) on page 4 of EP447,969A1; and couplers (particularly II-17 and II-19 (column 17), and II-24 (column 19)) represented by formulas (II) to (IV) in column 7, lines 36 to 58 of U.S. Pat. No. 4,476,219, all the disclosures of which are herein incorporated by reference.

Magenta couplers: JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP456,257; M-4 and M-6 (page 26), and M-7 (page 27) in EP486,965; M-45 (page 19) in EP571,959A; (M-1) (page 6) JP-A-5-204106; and M-22 in paragraph 0237 of JP-A-4-362631, all the disclosures of which are herein incorporated by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of JP-A-6-67385, all the disclosures of which are herein incorporated by reference.

Polymer couplers: P-1 and P-5 (page 11) in JP-A-2-44345, all the disclosures of which are herein incorporated by reference.

Couplers for forming a colored dye with a proper diffusibility are preferably those described in U.S. Pat. No. 4,366,237, GB2,125,570, EP96,873B, and DE3,234,533, all the disclosures of which are herein incorporated by reference.

Couplers for correcting unnecessary absorption of a colored dye are preferably yellow colored cyan couplers (particularly YC-86 on page 84) represented by formulas (CI), (CII), (CIII), and (CIV) described on page 5 of EP456,257A1; yellow colored magenta couplers ExM-7 (page 202), EX-1 (page 249), and EX-7 (page 251) in EP456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers (particularly compound examples on pages 36 to 45) represented by formula (A) in claim 1 of W092/11575, all the disclosures of which are herein incorporated by reference.

Examples of a compound (including a coupler) which reacts with an oxidized form of a developing agent and releases a photographically useful compound residue are as follows. Development inhibitor release compounds: compounds (particularly T-101 (page 30), T-104 (page 31), T-113 (page 36), T-131 (page 45), T-144 (page 51), and T-158 (page 58)) represented by formulas (I), (II), (III), (IV) described on page 11 of EP378,236A1, compounds (particularly D-49 (page 51)) represented by formula (I) described on page 7 of EP436,938A2, compounds (particularly (23) (page 11)) represented by formula (1) in EP568,037A, and compounds (particularly I-(1) on page 29) represented by formulas (I), (II), and (III) described on pages 5 and 6 of EP440,195A2; bleaching accelerator release compounds: compounds (particularly (60) and (61) on page 61) represented by formulas (I) and (I') on page 5 of EP310,125A2, and compounds (particularly (7) (page 7)) represented by formula (I) in claim 1 of JP-A-6-59411; ligand release compounds: compounds (particularly compounds in column 12, lines 21 to 41) represented by LIG-X described in claim 1 of U.S. Pat. No. 4,555,478; leuco dye release compounds: compounds 1 to 6 in columns 3 to 8 of U.S. Pat. No. 4,749,641; fluorescent dye release compounds: compounds (particularly compounds 1 to 11 in columns 7 to 10) represented by COUP-DYE in claim 1 of U.S. Pat. No. 4,774,181; development accelerator or fogging agent release compounds: compounds (particularly (I-22) in column 25) represented by formulas (1), (2), and (3) in column 3 of U.S. Pat. No. 4,656,123, and ExZK-2 on page 75, lines 36 to 38 of EP450,637A2; compounds which release a group which does not function as a dye unless it splits off: compounds (particularly Y-1 to Y-19 in columns 25 to 36) represented by formula (I) in claim 1 of U.S. Pat. No. 4,857,447, all the disclosures of which are herein incorporated by reference.

Preferable examples of additives other than couplers are as follows.

Dispersants of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of an oil-soluble organic compound: latexes described in U.S. Pat. No. 4,199,363; developing agent oxidized form scavengers: compounds (particularly I-(1), I-(2), I-(6), and I-(12) (columns 4 and 5)) represented by formula (I) in column 2, lines 54 to 62 of U.S. Pat. No. 4,978,606, and formulas (particularly a compound 1 (column 3)) in column 2, lines 5 to 10 of U.S. Pat. No. 4,923,787; stain inhibitors: formulas (I) to (III) on page 4, lines 30 to 33, particularly I-47, I-72, III-1, and III-27 (pages 24 to 48) in EP298321A; discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP298321A, II-1 to III-23, particularly III-10 in columns 25 to 38 of U.S. Pat. No. 5,122,444, I-1 to III-4, particularly II-2 on pages 8 to 12 of EP471347A, and A-1 to A-48, particularly A-39 and A-42 in columns 32 to 40 of U.S. Pat. No. 5,139,931; materials which reduce the use amount of a color enhancer or a color amalgamation inhibitor: I-1 to II-15, particularly I-46 on pages 5 to 24 of EP411324A; formalin scavengers: SCV-1 to SCV-28, particularly SCV-8 on pages 24 to 29 of EP477932A; film hardeners: H-1, H-4, H-6, H-8, and H-14 on page 17 of JP-A-1-214845, compounds (H-1 to H-54) represented by formulas (VII) to (XII) in columns 13 to 23 of U.S. Pat. No. 4,618,573, compounds (H-1 to H-76), particularly H-14 represented by formula (6) on page 8, lower right column of JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7 of U.S. Pat. No. 5,019,492; antiseptic agents and mildewproofing agents: I-1 to III-43, particularly II-1, II-9, II-10, II-18, and III-25 in columns 3 to 15 of U.S. Pat. No. 4,923,790; stabilizers and antifoggants: I-1 to (14), particularly I-1, I-60, (2), and (13) in columns 6 to 16 of U.S. Pat. No. 4,923,793, and compounds 1 to 65, particularly a compound 36 in columns 25 to 32 of U.S. Pat. No. 4,952,483; chemical sensitizers: triphenylphosphine selenide and a compound 50 in JP-A-5-40324; dyes: a-1 to b-20, particularly a-1, a-12, a-18, a-27, a-35, a-36, and b-5 on pages 15 to 18 and V-1 to V-23, particularly V-1 on pages 27 to 29 of JP-A-3-156450, F-I-1 to F-II-43, particularly F-I-11 and F-II-8 on pages 33 to 55 of EP445627A, III-1 to III-36, particularly III-1 and III-3 on pages 17 to 28 of EP457153A, fine crystal dispersions of Dye-1 to Dye-124 on pages 8 to 26 of W088/04794, compounds 1 to 22, particularly a compound 1 on pages 6 to 11 of EP319999A, compounds D-1 to D-87 (pages 3 to 28) represented by formulas (1) to (3) in EP519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788; UV absorbents: compounds (18b) to (18r) and 101 to 427 (pages 6 to 9) represented by formula (1) in JP-A-46-3335, compounds (3) to (66) (pages 10 to 44) and compounds HBT-1 to HBT-10 (page 14) represented by formula (III) in EP520938A, and compounds (1) to (31) (columns 2 to 9) represented by formula (1) in EP521823A.

The present invention can be applied to various color sensitive materials such as color negative films for general purposes or movies, color reversal films for slides or television, color paper, color positive films, and color reversal paper. The present invention is also suited to film units with lens described in JP-B-2-32615 and Jpn. UM Appln. KOKOKU Publication No. 3-39784.

A support which can be suitably used in the present invention is described in, e.g., RD. No. 17643, page 28, RD. No. 18716, page 647, right column to page 648, left column, and RD. No. 307105, page 879.

In a sensitive material of the present invention, the total film thickness of all hydrophilic colloid layers on the side having emulsion layers is preferably 28 μm or less, more preferably 23 μm or less, especially preferably 18 μm or less, and particularly preferably 16 μm or less. A film swell speed $T_{1/2}$ is preferably 30 sec or less, and more preferably, 20 sec or less. $T_{1/2}$ is defined as a time which the film thickness requires to reach ½ of a saturation film thickness which is 90% of a maximum swell film thickness reached when processing is performed by using a color developer at 30° C. for 3 min and 15 sec. The film thickness means the thickness of a film measured under moisture conditioning at a temperature of 25° C. and a relative humidity of 55% (two days). $T_{1/2}$ can be measured by using a swell meter described in Photogr. Sci. Eng., A. Green et al., Vol. 19, No. 2, pp. 124 to 129. $T_{1/2}$ can be adjusted by adding a film hardening agent to gelatin as a binder or changing aging conditions after coating. The swell ratio is preferably 150 to 400%. The swell ratio can be calculated from the maximum swell film thickness under the conditions mentioned above by using (maximum swell film thickness—film thickness)/film thickness.

In a sensitive material of the present invention, hydrophilic colloid layers (called back layers) having a total dried film thickness of 2 to 20 μm are preferably formed on the side opposite to the side having emulsion layers. The back layers preferably contain, e.g., the aforementioned light absorbents, filter dyes, ultraviolet absorbents, antistatic agents, film hardeners, binders, plasticizers, lubricants, coating aids, and surfactants. The lubrication ratio of the back layers is preferably 150 to 500%.

A color sensitive material according to the present invention can be developed by conventional methods described in RD. No. 17643, pp. 28 and 29, RD. No. 18716, page 615, left to right columns, and RD No. 307105, pp. 880 and 881.

Color negative film processing solutions used in the present invention will be described below.

Compounds described in JP-A-4-121739, page 9, upper right column, line 1 to page 11, lower left column, line 4 can be used in a color developer of the present invention. As a color developing agent used when particularly rapid processing is to be performed, 2-methyl-4-[N-ethyl-N-(2-hydroxyethyl)amino]aniline, 2-methyl-4-[N-ethyl-N-(3-hydroxypropyl)amino]aniline, or 2-methyl-4-[N-ethyl-N-(4-hydroxybutyl)amino]aniline is preferable.

The use amount of any of these color developing agents is preferably 0.01 to 0.08 mol, more preferably 0.015 to 0.06 mol, and especially preferably 0.02 to 0.05 mol per liter (to be referred to as "L" hereinafter) of a color developer. Also, a replenisher of a color developer preferably contains a color developing agent at concentration 1.1 to 3 times, particularly 1.3 to 2.5 times the above concentration.

As a preservative of a color developer, hydroxylamine can be extensively used. When higher preservability is necessary, the use of a hydroxylamine derivative having a substituent such as an alkyl group, hydroxylalkyl group, sulfoalkyl group, or carboxyalkyl group is preferable. Examples are N,N-di(sulfoethyl)hydroxylamine, monomethylhydroxylamine, dimethylhydroxylamine, monoethylhydroxylamine, diethylhydroxylamine, and N,N-di(carboxylethyl)hydroxylamine. Of these derivatives, N,N-di(sulfoethyl)hydroxylamine is particularly preferable. Although these derivatives can be used together with hydroxylamine, it is preferable to use one or two types of these derivatives instead of hydroxylamine.

The use amount of a preservative is preferably 0.02 to 0.2 mol, more preferably 0.03 to 0.15 mol, and especially preferably 0.04 to 0.1 mol per L. As in the case of a color developing agent, a replenisher preferably contains a preservative at concentration 1.1 to 3 times that of a mother solution (processing tank solution).

A color developer contains sulfite as an agent for preventing an oxide of a color developing agent from changing into tar. The use amount of this sulfite is preferably 0.01 to 0.05 mol, and more preferably 0.02 to 0.04 mol per L. Sulfite is preferably used at concentration 1.1 to 3 times the above concentration in a replenisher.

The pH of a color developer is preferably 9.8 to 11.0, and more preferably 10.0 to 10.5. In a replenisher, the pH is preferably set to be higher by 0.1 to 1.0 than these values. To stably maintain this pH, a know buffering agent such as carbonate, phosphate, sulfosalicylate, or borate is used.

The replenishment rate of a color developer is preferably 80 to 1,300 mL per $m^2$ of a sensitive material. However, the replenishment rate is preferably smaller in order to reduce environmental pollution. For example, the replenishment rate is preferably 80 to 600 mL, and more preferably 80 to 400 mL.

The bromide ion concentration in the color developer is usually 0.01 to 0.06 mol per L. However, this bromide ion concentration is preferably set at 0.015 to 0.03 mol per L in order to suppress fog and improve discrimination and graininess while maintaining sensitivity. To set the bromide ion concentration in this range, it is only necessary to add bromide ions calculated by the following equation to a replenisher. When C takes a negative value, however, no bromide ions are preferably added to a replenisher.

where

C:a bromide ion concentration (mol/L) in a color developer replenisher

A:a target bromide ion concentration (mol/L) in a color developer

W:an amount (mol) of bromide ions dissolving into a color developer from 1 $m^2$ of a sensitive material when the sensitive material is color-developed V:a replenishment rate (L) of a color developer replenisher for 1 $m^2$ of a sensitive material As a method of increasing the sensitivity when the replenishment rate is decreased or high bromide ion concentration is set, it is preferable to use a development accelerator such as pyrazolidones represented by 1-phenyl-3-pyrazolidone and 1-phenyl-2-methyl-2-hydroxylmethyl-3-pyrazolidone, or a thioether compound represented by 3,6-dithia-1,8-octandiol.

Compounds and processing conditions described in JP-A-4-125558, page 4, lower left column, line 16 to page 7, lower left column, line 6 can be applied to a processing solution having bleaching capacity in the present invention.

This bleaching agent preferably has an oxidation-reduction potential of 150 mV. Preferable practical examples of the bleaching agent are described in JP-A-5-72694 and JP-A-5-173312. In particular, 1,3-diaminopropane tetraacetic acid and compound ferric complex salt as practical example 1 in JP-A-5-173312, page 7 are preferable.

To improve the biodegradability of a bleaching agent, it is preferable to use compound ferric complex salts described in JP-A-4-251845, JP-A-4-268552, EP588,289, EP591,934, and JP-A-6-208213 as the bleaching agent. The concentration of any of these bleaching agents is preferably 0.05 to 0.3 mol per L of a solution having bleaching capacity. To reduce the amount of waste to the environment, the concentration is preferably designed to be 0.1 to 0.15 mol per L of the solution having bleaching capacity. When the solution having bleaching capacity is a bleaching solution, preferably 0.2 to 1 mol, and more preferably 0.3 to 0.8 mol of a bromide is added per L.

A replenisher of the solution having bleaching capacity basically contains components at concentrations calculated by the following equation. This makes it possible to maintain the concentrations in a mother solution constant.

where $C_R$: concentrations of components in a replenisher $C_T$: concentrations of components in a mother solution (processing tank solution)

$C_P$: concentrations of components consumed during processing $V_1$: a replenishment rate (mL) of a replenisher having bleaching capacity per $m^2$ of a sensitive material $V_2$ : an amount (mL) carried over from a pre-bath by $m^2$ of a sensitive material Additionally, a bleaching solution preferably contains a pH buffering agent, and more preferably contains succinic acid, maleic acid, malonic acid, glutaric acid, adipic acid, or dicarboxylic acid with little odor. Also, the use of known bleaching accelerators described in JP-A-53-95630, RD No. 17129, and U.S. Pat. No. 3,893,858 is preferable.

It is preferable to replenish 50 to 1,000 mL of a bleaching replenisher to a bleaching solution per $m^2$ of a sensitive material. The replenishment rate is more preferably 80 to 500 mL, and especially preferably 100 to 300 mL. Aeration of a bleaching solution is also preferable.

Compounds and processing conditions described in JP-A-4-125558, page 7, lower left column, line 10 to page 8, lower right column, line 19 can be applied to a processing solution with fixing capacity.

To improve the fixing rate and preservability, compounds represented by formulas (I) and (II) described in JP-A-6-301169 are preferably added singly or together to a processing solution with fixing capacity. To improve the preservability, the use of sulfinic acid such as p-toluenesulfinate described in JP-A-1-224762 is also preferable.

To improve the desilvering characteristics, ammonium is preferably used as cation in a solution with bleaching capacity or a solution with fixing capacity. However, the amount of ammonium is preferably reduced or zero to reduce environmental pollution.

In the bleaching, bleach-fixing, and fixing steps, it is particularly preferable to perform jet stirring described in JP-A-1-309059.

The replenishment rate of a replenisher in the bleach-fixing or fixing step is preferably 100 to 1,000 mL, more preferably 150 to 700 mL, and more preferably 200 to 600 mL per $m^2$ of a sensitive material.

In the bleach-fixing or fixing step, an appropriate silver collecting apparatus is preferably installed either in-line or off-line to collect silver. When the apparatus is installed in-line, processing can be performed while the silver concentration in a solution is reduced, so the replenishment rate can be reduced. It is also preferable to install the apparatus off-line to collect silver and reuse the residual solution as a replenisher.

The bleach-fixing or fixing step can be performed by using a plurality of processing tanks, and these tanks are preferably cascaded to form a multistage counterflow system. To balance the size of a processor, a two-tank cascade system is generally efficient. The processing time ratio of the front tank to the rear tank is preferably 0.5:1 to 1:0.5, and more preferably 0.8:1 to 1:0.8.

In a bleach-fixing or fixing solution, the presence of free chelating agents which are not metal complexes is preferable to improve the preservability. As these chelating agents, the use of the biodegradable chelating agents previously described in connection to a bleaching solution is preferable.

Contents described in aforementioned JP-A-4-125558, page 12, lower right column, line 6 to page 13, lower right column, line 16 can be preferably applied to the washing and stabilization steps. To improve the safety of the work environment, it is preferable to use azolylmethylamines described in EP504,609 and EP519,190 or N-methylolazoles described in JP-A-4-362943 instead of formaldehyde in a stabilizer and to make a magenta coupler divalent to form a solution of surfactant containing no image stabilizing agent such as formaldehyde.

To reduce adhesion of dust to a magnetic recording layer formed on a sensitive material, a stabilizer described in JP-A-6-289559 can be preferably used.

The replenishment rate of washing water and a stabilizer is preferably 80 to 1,000 mL, more preferably 100 to 500 mL, and especially preferably 150 to 300 mL per $m^2$ of a sensitive material in order to maintain the washing and stabilization functions and at the same time reduce the waste liquors for environmental protection. In processing performed with this replenishment rate, it is preferable to prevent the propagation of bacteria and mildew by using known mildewproofing agents such as thiabendazole, 1,2-benzoisothiazoline-3-one, and 5-chloro-2-methylisothiazoline-3-one, antibiotics such as gentamicin, and water deionized by an ion exchange resin or the like. It is more effective to use deionized water together with a mildewproofing agent or an antibiotic.

The replenishment rate of a solution in a washing water tank or stabilizer tank is preferably reduced by performing reverse permeable membrane processing described in JP-A-3-46652, JP-A-3-53246, JP-A-3-55542, JP-A-3-121448, and JP-A-3-126030. A reverse permeable membrane used in this processing is preferably a low-pressure reverse permeable membrane.

In the processing of the present invention, it is particularly preferable to perform processing solution evaporation correction disclosed in JIII Journal of Technical Disclosure No. 94-4992. In particular, a method of performing correction on the basis of (formula-1) on page 2 by using temperature and humidity information of an environment in which a processor is installed is preferable. Water for use in this evaporation correction is preferably taken from the washing water replenishment tank. If this is the case, deionized water is preferably used as the washing replenishing water.

Processing agents described in aforementioned JIII Journal of Technical Disclosure No. 94-4992, page 3, right column, line 15 to page 4, left column, line 32 are preferably used in the present invention. As a processor for these processing agents, a film processor described on page 3, right column, lines 22 to 28 is preferable.

Practical examples of processing agents, automatic processors, and evaporation correction methods suited to practicing the present invention are described in the same JIII Journal of Technical Disclosure No. 94-4992, page 5, right column, line 11 to page 7, right column, last line.

Processing agents used in the present invention can be supplied in any form: a liquid agent having the concentration of a solution to be used, concentrated liquid agent, granules, powder, tablets, paste, and emulsion. Examples of such processing agents are a liquid agent contained in a low-oxygen permeable vessel disclosed in JP-A-63-17453, vacuum-packed powders and granules disclosed in JP-A-4-19655 and JP-A-4-230748, granules containing a water-soluble polymer disclosed in JP-A-4-221951, tablets disclosed in JP-A-51-61837 and JP-A-6-102628, and a paste disclosed in PCT No. 57-500485. Although any of these processing agents can be preferably used, the use of a liquid adjusted to have the concentration of a solution to be used is preferable for the sake of convenience in use.

As a vessel for containing these processing agents, polyethylene, polypropylene, polyvinylchloride, polyethyleneterephthalate, and nylon are used singly or as a composite material. These materials are selected in accordance with the level of necessary oxygen permeability. For a readily oxidizable solution such as a color developer, a low-oxygen permeable material is preferable. More specifically, polyethyleneterephthalate or a composite material of polyethylene and nylon is preferable. A vessel made of any of these materials preferably has a thickness of 500 to 1,500 $\mu$m and an oxygen permeability of 20 mL/$m^2$·24 hrs·atm or less.

Color reversal film processing solutions used in the present invention will be described below.

Processing for a color reversal film is described in detail in Aztech Ltd., Known Technology No. 6 (1991, April 1), page 1, line 5 to page 10, line 5 and page 15, line 8 to page 24, line 2, and any of the contents can be preferably applied. In this color reversal film processing, an image stabilizing agent is contained in a control bath or a final bath. Preferable examples of this image stabilizing agent are formalin, sodium formaldehyde-bisulfite, and N-methylolazole. Sodium formaldehyde-bisulfite or N-methylolazole is preferable in terms of work environment, and N-methyloltriazole is particularly preferable as N-methylolazole. The contents pertaining to a color developer, bleaching solution, fixing solution, and washing water described in the color negative film processing can be preferably applied to the color reversal film processing.

Preferable examples of color reversal film processing agents containing the above contents are an E-6 processing agent manufactured by Eastman Kodak Co. and a CR-56 processing agent manufactured by Fuji Photo Film Co., Ltd.

A color photosensitive material of the present invention is also suitably used as a negative film for an advanced photo system (to be referred to as an APS hereinafter). Examples are NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as Fuji Film EPION Series (e.g., EPION 300Z). A color photosensitive film of the present invention is also suited as a film with lens such as Fuji Film FUJICOLOR UTSURUNDESU SUPER SLIM.

A photographed film is printed through the following steps in a miniature laboratory system.

(1) Reception (an exposed cartridge film is received from a customer)
(2) Detaching step (the film is transferred from the cartridge to an intermediate cartridge for development)
(3) Film development
(4) Reattaching step (the developed negative film is returned to the original cartridge)
(5) Printing (prints of three types C, H, and P and an index print are continuously automatically printed on color paper [preferably Fuji Film SUPER FA8])
(6) Collation and shipment (the cartridge and the index print are collated by an ID number and shipped together with the prints)

As these systems, Fuji Film MINILABO CHAMPION SUPER FA-298, FA-278, FA-258, FA-238 and Fuji Film DIGITAL LABO SYSTEM FRONTIER are preferable. Examples of a processor for MINILABO CHAMPION are FP922AL, FP562B, FP562BAL, FP362B, and FP362BAL, and recommended processing chemicals are FUJICOLOR JUST-IT CN-16L AND CN-16Q. Examples of a printer processor are PP3008AR, PP3008A, PP1828AR, PP1828A, PP1258AR, PP1258A, PP728AR, and PP728A, and recommended processing chemicals are FUJICOLOR JUST-IT CP-47L and CP40FAII. In FRONTIER SYSTEM, Scanner & Image Processor SP-1000 and Laser Printer & Paper Processor LP-1000P or Laser Pinter LP-1000W are used. A detacher used in the detaching step and a reattacher used in the reattaching step are preferably Fuji Film DT200 or DT100 and AT200 or AT100, respectively.

The APS can also be enjoyed by PHOTO JOY SYSTEM whose main component is Fuji Film Digital Image Workstation Aladdin 1000. For example, a developed APS cartridge film is directly loaded into Aladdin 1000, or image information of a negative film, positive film, or print is input to Aladdin 1000 by using 35-mm Film Scanner FE-550 or Flat Head Scanner PE-550. Obtained digital image data can be easily processed and edited. This data can be printed out by Digital Color Printer NC-550AL using a photo-fixing heat-sensitive color printing system or PICTOROGRAPHY 3000 using a laser exposure thermal development transfer system, or by existing laboratory equipment through a film recorder. Aladdin 1000 can also output digital information directly to a floppy disk or Zip disk or to an CD-R via a CD writer.

In a home, a user can enjoy photographs on a TV set simply by loading a developed APS cartridge film into Fuji Film Photo Player AP-1. Image information can also be continuously input to a personal computer by loading a developed APS cartridge film into Fuji Film Photo Scanner AS-1. Fuji Film Photo Vision FV-10 or FV-5 can be used to input a film, print, or three-dimensional object. Furthermore, image information recorded in a floppy disk, Zip disk, CR-R, or hard disk can be variously processed on a computer by using Fuji Film Application Software Photo Factory. Fuji Film Digital Color Printer NC-2 or NC-2D using a photo-fixing heat-sensitive color printing system is suited to outputting high-quality prints from a personal computer.

To keep developed APS cartridge films, FUJICOLOR POCKET ALBUM AP-5 POP L, AP-1 POP L, AP-1 POP KG, or CARTRIDGE FILE 16 is preferable.

A magnetic recording layer usable in the present invention will be described below.

This magnetic recording layer is formed by coating the surface of a support with an aqueous or organic solvent-based coating solution which is prepared by dispersing magnetic grains in a binder.

As the magnetic grains, it is possible to use grains of, e.g., ferromagnetic iron oxide such as $\gamma$ $Fe_2O_3$, Co-deposited $\gamma$ $Fe_2O_3$, Co-deposited magnetite, Co-containing magnetite, ferromagnetic chromium dioxide, a ferromagnetic metal, ferromagnetic alloy, Ba ferrite of a hexagonal system, Sr ferrite, Pb ferrite, and Ca ferrite. Co-deposited ferromagnetic iron oxide such as Co-deposited $\gamma$ $Fe_2O_3$ is preferable. The grain can take the shape of any of, e.g., a needle, rice grain, sphere, cube, and plate. The specific area is preferably 20 $m^2/g$ or more, and more preferably 30 $m^2/g$ or more as $S_{BET}$. The saturation magnetization ($\sigma s$) of the ferromagnetic substance is preferably $3.0\times10^4$ to $3.0\times10^5$ A/m, and especially preferably $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in JP-A-6-161032. A ferromagnetic grain whose surface is coated with an inorganic or organic substance described in JP-A-4-259911 or JP-A-5-81652 can also be used.

As a binder used together with the magnetic grains, it is possible to use a thermoplastic resin described in JP-A-4-219569, thermosetting resin, radiation-curing resin, reactive resin, acidic, alkaline, or biodegradable polymer, natural polymer (e.g., a cellulose derivative and sugar derivative), and their mixtures. The Tg of the resin is −40° C. to 300° C., and its weight average molecular weight is 2,000 to 1,000,000. Examples are a vinyl-based copolymer, cellulose derivatives such as cellulosediacetate, cellulosetriacetate, celluloseacetatepropionate, celluloseacetatebutylate, and cellulosetripropionate, acrylic resin, and polyvinylacetal resin. Gelatin is also preferable. Cellulosedi(tri)acetate is particularly preferable. This binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mols of tolylenediisocyanate and 1 mol of trimethylolpropane), and polyisocyanate produced by condensation of any of these isocyanates. These examples are described in JP-A-6-59357.

As a method of dispersing the magnetic substance in the binder, as described in JP-A-6-35092, a kneader, pin type mill, and annular mill are preferably used singly or together. Dispersants described in JP-A-5-088283 and other known dispersants can be used. The thickness of the magnetic recording layer is 0.1 to 10 $\mu$m, preferably 0.2 to 5 $\mu$m, and more preferably 0.3 to 3 $\mu$m. The weight ratio of the magnetic grains to the binder is preferably 0.5:100 to 60:100, and more preferably 1:100 to 30:100. The coating amount of the magnetic grains is 0.005 to 3 $g/m^2$, preferably 0.01 to 2 $g/m^2$, and more preferably 0.02 to 0.5 $g/m^2$. The transmitting yellow density of the magnetic recording layer is preferably 0.01 to 0.50, more preferably 0.03 to 0.20, and especially preferably 0.04 to 0.15. The magnetic recording layer can be formed in the whole area of, or into the shape of stripes on, the back surface of a photographic support by coating or printing. As a method of coating the magnetic recording layer, it is possible to use any of an air doctor, blade, air knife, squeegee, impregnation, reverse roll, transfer roll, gravure, kiss, cast, spray, dip, bar, and extrusion. A coating solution described in JP-A-5-341436 is preferable.

The magnetic recording layer can be given a lubricating property improving function, curling adjusting function, antistatic function, adhesion preventing function, and head polishing function. Alternatively, another functional layer can be formed and these functions can be given to that layer. A polishing agent in which at least one type of grains are aspherical inorganic grains having a Mohs hardness of 5 or more is preferable. The composition of this aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or titanium coupling agent. These grains can be added to the magnetic recording layer or overcoated (as, e.g., a protective layer or lubricant layer) on the magnetic recording layer. A binder used together with the grains can be any of those described above and is preferably the same binder as in the magnetic recording layer. Sensitive materials having the magnetic recording layer are described in U.S. Pat. No. 5,336,589, U.S. Pat. No. 5,250,404, U.S. Pat. No. 5,229,259, U.S. Pat. No. 5,215,874, and EP466,130.

A polyester support used in the present invention will be described below. Details of the polyester support and sensitive materials, processing, cartridges, and examples (to be described later) are described in Journal of Technical Disclosure No. 94-6023 (JIII; Mar. 15, 1994, ). Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferable. Polyethylene-2,6-naphthalate is especially preferable among other polymers. The average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of 40° C.

to less than Tg, more preferably Tg −20° C. to less than Tg. The heat treatment can be performed at a fixed temperature within this range or can be performed together with cooling. The heat treatment time is 0.1 to 1500 hrs, more preferably 0.5 to 200 hrs. The heat treatment can be performed for a roll-like support or while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A preferable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferable.

An undercoating layer can include a single layer or two or more layers. Examples of an undercoating layer binder are copolymers formed by using, as a starting material, a monomer selected from vinylchloride, vinylidenechloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoating layer are chromium salt (e.g., chromium alum), aldehydes (e.g., formaldehyde and glutaraldehyde), isocyanates, an active halogen compound (e.g., 2,4-dichloro-6-hydroxy-s-triazine), epichlorohydrin resin, and active vinylsulfone compound. $SiO_2$, $TiO_2$, inorganic fine grains, or polymethylmethacrylate copolymer fine grains (0.01 to 10 $\mu$m) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound.

As the antistatic agent, it is especially preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of $10^7$ Ω·cm or less, more preferably $10^5$ Ω·cm or less and a grain size of 0.001 to 1.0 $\mu$m, fine grains of composite oxides (e.g., Sb, P, B, In, S, Si, and C) of these metal oxides, fine grains of sol metal oxides, or fine grains of composite oxides of these sol metal oxides. The content in a sensitive material is preferably 5 to 500 mg/m$^2$, and especially preferably 10 to 350 mg/m$^2$. The ratio of a conductive crystalline oxide or its composite oxide to the binder is preferably 1/300 to 100/1, and more preferably 1/100 to 100/5.

A sensitive material of the present invention preferably has a slip property. Slip agent-containing layers are preferably formed on the surfaces of both a sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60% RH). In this evaluation, a value of nearly the same level is obtained when the surface of a sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferable.

A sensitive material of the present invention preferably contains a matting agent. This matting agent can be added to either the emulsion surface or back surface and is especially preferably added to the outermost emulsion layer. The matting agent can be either soluble or insoluble in processing solutions, and the use of both types of matting agents is preferable. Preferable examples are polymethylmethacrylate grains, poly(methylmethacrylate/methacrylic acid=9/1 or 5/5 (molar ratio)) grains, and polystyrene grains. The grain size is preferably 0.8 to 10 $\mu$m, and a narrow grain size distribution is preferable. It is preferable that 90% or more of all grains have grain sizes 0.9 to 1.1 times the average grain size. To increase the matting property, it is preferable to simultaneously add fine grains with a grain size of 0.8 $\mu$m or smaller. Examples are polymethylmethacrylate grains (0.2 $\mu$m), poly(methylmethacrylate/methacrylic acid=9/1 (molar ratio, 0.3 $\mu$m) grains, polystyrene grains (0.25 $\mu$m), and colloidal silica grains (0.03 $\mu$m).

A film cartridge used in the present invention will be described below. The principal material of the cartridge used in the present invention can be a metal or synthetic plastic.

Preferable plastic materials are polystyrene, polyethylene, polypropylene, and polyphenylether. The cartridge of the present invention can also contain various antistatic agents. For this purpose, carbon black, metal oxide grains, nonion-, anion-, cation-, and betaine-based surfactants, or a polymer can be preferably used. These cartridges subjected to the antistatic treatment are described in JP-A-1-312537 and JP-A-1-312538. It is particularly preferable that the resistance be $10^{12}$Ω or less at 25° C. and 25% RH. Commonly, plastic cartridges are manufactured by using plastic into which carbon black or a pigment is incorporated in order to give a light-shielding property. The cartridge size can be a presently available 135 size. To miniaturize cameras, it is effective to decrease the diameter of a 25-mm cartridge of 135 size to 22 mm or less. The volume of a cartridge case is 30 cm$^3$ or less, preferably 25 cm$^3$ or less. The weight of plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. No. 4,834,306 and U.S. Pat. No. 5,226,613. Photographic films used in the present invention can be so-called raw films before being developed or developed photographic films. Also, raw and developed photographic films can be accommodated in the same new cartridge or in different cartridges.

The present invention will be described in more detail below by way of its examples. However, the present invention is not limited to these examples as long as the invention is within the scope of the invention.

EXAMPLE 1

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90-μm thick PEN film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hrs, manufacturing a support with a high resistance to curling.

2) Coating of Undercoat Layer

The two surfaces of the support were subjected to corona discharge, UV discharge, and glow discharge. After that, one surface of the support was coated with an undercoat solution (10 mL/m$^2$, by using a bar coater) consisting of 0.1 g/m$^2$ of gelatin, 0.01 g/m$^2$ of sodium-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

The other surface of the undercoated support was coated with an antistatic layer, magnetic recording layer, and slip layer having the following compositions were coated as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and 0.22 g/m$^2$ of resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 emu/g, $Fe^{+2}/Fe^{+3}$=6/94, the surface was treated with 2 wt % of iron oxide by aluminum oxide silicon oxide) coated with 3-polyoxyethylene-propyloxytrimethoxysilane (polymerization degree 15; 15 wt %) together with 1.2 g/m$^2$ of diacetylcellulose (iron oxide was dispersed by an open kneader and sand mill) by using 0.3 g/m$^2$ of $C_2H_5C(CH_2OCONH{-}C_6H_3(CH_3)NCO)_3$ as a hardener and acetone, methylethylketone, and cyclohexane as solvents, thereby forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-polyoxyethylene-propyloxytrimethoxysilane (polymerization degree 15; 15 wt %) were added as a polishing agent. Drying was performed at 115° C. for 6 min (all rollers and conveyors in the drying zone were at 115° C.). The color density increase of DB of the magnetic recording layer measured by an X-light (blue filter) was about 0.1. The saturation magnetization moment, coercive force, and squareness ratio of the magnetic recording layer were 4.2 emu/g, 7.3×10$^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was and formed into a dispersion (average grain size 0.01 μm) in acetone before being added. 15 mg/m2 of silica grains (0.3 μm) were added as a matting agent, and 15 mg/m$^2$ of aluminum oxide (0.15 μm) coated with 3-polyoxyethylene-propyloxytrimethoxysiliane (polymerization degree 15; 15 wt %) were added as a polishing agent. Drying was performed at 115° C. for 6 min (all rollers and conveyors in the drying zone were at 115° C.). The resultant slip layer was found to have excellent characteristics. That is, the coefficient of kinetic friction was 0.06 (5 mmø stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Sensitive Layers

The surface of the support on the side away from the back layers formed as above was coated with a plurality of layers having the following compositions to manufacture a color negative film. This film will be referred to as a sample 101 hereinafter.

Compositions of Sensitive Layers

The main materials used in the individual layers are classified as follows.

ExC: Cyan coupler

ExM: Magenta coupler

ExY: Yellow coupler

ExS: Sensitizing dye

UV: Ultraviolet absorbent

HBS: High-boiling organic solvent

H: Gelatin hardener

The number corresponding to each component indicates the coating amount in units of g/m$^2$. The coating amount of a silver halide is indicated by the amount of silver. The coating amount of each sensitizing dye is indicated in units of mols per mol of a silver halide in the same layer.

| (Sample 101) | | |
|---|---|---|
| 1st layer (1st antihalation layer) | | |
| Black colloidal silver | silver | 0.14 |
| Gelatin | 0.50 | |
| 2nd layer (2nd antihalation layer) | | |
| Black colloidal silver | silver | 0.12 |
| Gelatin | 0.57 | |
| ExM-1 | 0.12 | |
| ExF-1 | 2.0 × 10$^{-3}$ | |
| Solid disperse dye ExF-2 | 0.030 | |
| Solid disperse dye ExF-3 | 0.040 | |
| HBS-1 | 0.15 | |
| HBS-2 | 0.02 | |
| 3rd layer (Interlayer) | | |
| Silver iodobromide emulsion N | silver | 0.06 |

-continued (Sample 101)

| | | |
|---|---|---|
| ExC-2 | 0.05 | |
| Polyethylacrylate latex | 0.20 | |
| Gelatin | 0.70 | |

4th layer (Low-speed red-sensitive emulsion layer)

| | | |
|---|---|---|
| Silver iodobromide emulsion A | silver | 0.27 |
| Silver iodobromide emulsion B | silver | 0.12 |
| ExS-1 | $5.8 \times 10^{-4}$ | |
| ExS-2 | $0.8 \times 10^{-5}$ | |
| ExS-3 | $2.5 \times 10^{-4}$ | |
| ExC-1 | 0.28 | |
| ExC-3 | 0.058 | |
| ExC-4 | 0.19 | |
| ExC-5 | 0.03 | |
| ExC-6 | 0.02 | |
| Cpd-2 | 0.025 | |
| HBS-1 | 0.28 | |
| Gelatin | 2.00 | |

5th layer (Medium-speed red-sensitive emulsion layer)

| | | |
|---|---|---|
| Silver iodobromide emulsion B | silver | 0.77 |
| ExS-1 | $6.5 \times 10^{-4}$ | |
| ExS-2 | $0.9 \times 10^{-5}$ | |
| ExS-3 | $2.8 \times 10^{-4}$ | |
| ExC-1 | 0.12 | |
| ExC-2 | 0.04 | |
| ExC-3 | 0.055 | |
| ExC-4 | 0.08 | |
| ExC-5 | 0.02 | |
| ExC-6 | 0.015 | |
| Cpd-4 | 0.024 | |
| Cpd-2 | 0.025 | |
| HBS-1 | 0.10 | |
| Gelatin | 0.92 | |

6th layer (High-speed red-sensitive emulsion layer)

| | | |
|---|---|---|
| Silver iodobromide emulsion C | silver | 0.93 |
| ExS-1 | $5.8 \times 10^{-4}$ | |
| ExS-2 | $0.8 \times 10^{-5}$ | |
| ExS-3 | $2.8 \times 10^{-4}$ | |
| ExC-1 | 0.044 | |
| ExC-3 | 0.022 | |
| ExC-6 | 0.012 | |
| ExC-7 | 0.010 | |
| Cpd-2 | 0.065 | |
| Cpd-4 | 0.065 | |
| HBS-1 | 0.16 | |
| HBS-2 | 0.080 | |
| Gelatin | 1.10 | |

7th layer (Interlayer)

| | | |
|---|---|---|
| Cpd-1 | 0.060 | |
| Solid disperse dye ExF-4 | 0.030 | |
| HBS-1 | 0.043 | |
| Polyethylacrylate latex | 0.19 | |
| Gelatin | 1.05 | |

8th layer (Low-speed green-sensitive emulsion layer)

| | | |
|---|---|---|
| Silver iodobromide emulsion E | silver | 0.18 |
| Silver iodobromide emulsion F | silver | 0.21 |
| Silver iodobromide emulsion G | silver | 0.22 |
| ExS-7 | $8.1 \times 10^{-5}$ | |
| ExS-8 | $3.6 \times 10^{-4}$ | |
| ExS-4 | $2.5 \times 10^{-5}$ | |
| ExS-5 | $8.8 \times 10^{-5}$ | |
| ExS-6 | $4.1 \times 10^{-4}$ | |
| ExM-3 | 0.20 | |
| ExM-4 | 0.06 | |
| ExY-1 | 0.01 | |
| ExY-5 | 0.0020 | |
| HBS-1 | 0.18 | |
| HBS-3 | 0.008 | |
| Cpd-4 | 0.010 | |
| Gelatin | 0.73 | |

9th layer (Medium-speed green-sensitive emulsion layer)

| | | |
|---|---|---|
| Silver iodobromide emulsion G | silver | 0.47 |

-continued (Sample 101)

| | | |
|---|---|---|
| Silver iodobromide emulsion H | silver | 0.35 |
| ExS-4 | $3.9 \times 10^{-5}$ | |
| ExS-7 | $2.0 \times 10^{-4}$ | |
| ExS-8 | $8.9 \times 10^{-4}$ | |
| ExC-8 | 0.0020 | |
| ExM-3 | 0.18 | |
| ExM-4 | 0.055 | |
| ExC-6 | 0.016 | |
| ExY-4 | 0.001 | |
| ExY-5 | 0.001 | |
| Cpd-4 | 0.015 | |
| HBS-1 | 0.18 | |
| HBS-3 | 0.009 | |
| Gelatin | 1.00 | |

10th layer (High-speed green-sensitive emulsion layer)

| | | |
|---|---|---|
| Silver iodobromide emulsion I | silver | 0.95 |
| ExS-4 | $6.2 \times 10^{-5}$ | |
| ExS-7 | $1.6 \times 10^{-4}$ | |
| ExS-8 | $7.7 \times 10^{-4}$ | |
| ExC-6 | 0.03 | |
| ExM-4 | 0.020 | |
| ExM-2 | 0.010 | |
| ExM-5 | 0.001 | |
| ExM-6 | 0.001 | |
| ExM-3 | 0.034 | |
| Cpd-4 | 0.030 | |
| HBS-1 | 0.27 | |
| Polyethylacrylate latex | 0.15 | |
| Gelatin | 1.20 | |

Layer D (interlayer effect donor layer)

| | | |
|---|---|---|
| Silver iodobromide emulsion D (0.58 $\mu$m) | silver | 0.45 |
| ExS-6 | $6.5 \times 10^{-4}$ | |
| ExS-10 | $2.3 \times 10^{-4}$ | |
| ExM-3 | 0.10 | |
| ExM-4 | 0.031 | |
| ExY-1 | 0.034 | |
| HBS-1 | 0.30 | |
| Cpd-4 | 0.004 | |
| Gelatin | 0.51 | |

11th layer (Yellow filter layer)

| | | |
|---|---|---|
| Yellow colloidal silver | silver | 0.001 |
| Cpd-1 | 0.11 | |
| Comparative oil-soluble dye (1) | 0.19 | |
| HBS-1 | 0.05 | |
| Gelatin | 0.70 | |

12th layer (Low-speed blue-sensitive emulsion layer)

| | | |
|---|---|---|
| Silver iodobromide emulsion J | silver | 0.18 |
| Silver iodobromide emulsion K | silver | 0.08 |
| Silver iodobromide emulsion L | silver | 0.36 |
| ExS-9 | $8.4 \times 10^{-4}$ | |
| ExC-1 | 0.023 | |
| ExC-8 | $7.0 \times 10^{-3}$ | |
| ExY-1 | 0.033 | |
| ExY-2 | 0.91 | |
| ExY-3 | 0.01 | |
| ExY-4 | 0.01 | |
| Cpd-2 | 0.005 | |
| Cpd-4 | 0.001 | |
| HBS-1 | 0.28 | |
| Gelatin | 2.20 | |

13th layer (High-speed blue-sensitive emulsion layer)

| | | |
|---|---|---|
| Silver iodobromide emulsion M | silver | 0.42 |
| ExS-9 | $6.0 \times 10^{-4}$ | |
| ExY-2 | 0.16 | |
| ExY-3 | 0.001 | |
| ExY-4 | 0.002 | |
| Cpd-2 | 0.10 | |
| Cpd-3 | $1.0 \times 10^{-3}$ | |
| Cpd-4 | $5.0 \times 10^{-3}$ | |
| HBS-1 | 0.075 | |
| Gelatin | 0.70 | |

-continued (Sample 101)

| | | |
|---|---|---|
| **14th layer (1st protective layer)** | | |
| Silver iodobromide emulsion N | silver | 0.10 |
| UV-1 | 0.13 | |
| UV-2 | 0.10 | |
| UV-3 | 0.16 | |
| UV-4 | 0.025 | |
| ExF-8 | 0.03 | |
| ExF-9 | 0.005 | |
| ExF-10 | 0.005 | |
| ExF-11 | 0.02 | |
| HBS-1 | $5.0 \times 10^{-2}$ | |
| HBS-4 | $5.0 \times 10^{-2}$ | |
| Gelatin | 1.8 | |
| **15th layer (2nd protective layer)** | | |
| H-1 | 0.40 | |
| B-1 (diameter 1.7 μm) | 0.04 | |
| B-2 (diameter 1.7 μm) | 0.09 | |
| B-3 | 0.13 | |
| ES-1 | 0.20 | |
| Gelatin | 0.70 | |

In addition to the above components, to improve the storage stability, processability, resistance to pressure, antiseptic and mildewproofing properties, antistatic properties, and coating properties, the individual layers contained W-1 to W-3, B-4 to B-6, F-1 to F-18, iron salt, lead salt, gold salt, platinum salt, palladium salt, iridium salt, and rhodium salt.

TABLE 1

| Emulsion | Average AgI content (%) | Average grain diameter (μm) (Equivalent spherical diameter) | COV of grain diameter (%) | Equivalent circular diameter of projected area (μm) | Diameter/ thickness ratio | Tabularity |
|---|---|---|---|---|---|---|
| A | 3.7 | 0.37 | 13 | 0.43 | 2.3 | 12 |
| B | 3.7 | 0.55 | 19 | 0.52 | 3.0 | 17 |
| C | 5.4 | 0.66 | 22 | 1.1 | 6.8 | 42 |
| D | 6.3 | 0.60 | 19 | 0.84 | 5.7 | 38 |
| E | 3.7 | 0.37 | 13 | 0.43 | 2.3 | 12 |
| F | 3.7 | 0.43 | 19 | 0.58 | 3.2 | 18 |
| G | 5.4 | 0.55 | 20 | 0.86 | 6.2 | 45 |
| H | 5.4 | 0.66 | 23 | 1.10 | 7.0 | 45 |
| I | 5.4 | 0.72 | 23 | 1.10 | 6.3 | 36 |
| J | 3.7 | 0.37 | 19 | 0.55 | 4.6 | 38 |
| K | 3.7 | 0.37 | 19 | 0.55 | 4.6 | 38 |
| L | 8.8 | 0.64 | 23 | 0.85 | 5.2 | 32 |
| M | 6.8 | 0.88 | 30 | 1.12 | 4.7 | 20 |
| N | 1.0 | 0.07 | — | — | 1.0 | — |

COV = coefficient of variation

In Table 1, (1) The emulsions J to M were subjected to reduction sensitization during grain preparation by using thiourea dioxide and thiosulfonic acid in accordance with examples in U.S. Pat. No. 5,061,614.

(2) The emulsions B to D and M were subjected to gold sensitization, sulfur sensitization, and selenium sensitization in the presence of the spectral sensitizing dyes described in the individual sensitive layers and sodium thiocyanate in accordance with examples in EP443,453A.

(3) The tabular grains were prepared by using low-molecular weight gelatin in accordance with examples in JP-A-1-158426.

(4) Ten or more dislocation lines as described in EP443,453A were observed in the tabular grains when a high-voltage electron microscope was used.

(5) The emulsions A to E, G, H, and J to M contained optimum amounts of Rh, Ir, and Fe.

Also, letting Dc be the average equivalent-circle diameter of the projected areas of tabular grains and t be the average thickness of the tabular grains, the flatness is defined by $Dc/t^2$.

Preparation of dispersions of organic solid disperse dyes

ExF-2 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700-mL pot mill, and 5.0 g of the dye ExF-2 and 500 mL of zirconium oxide beads (diameter 1 mm) were added to the mill. The contents were dispersed for 2 hrs. This dispersion was done by using a BO type oscillating ball mill manufactured by Chuo Koki K.K. The dispersion was extracted from the mill and added to 8 g of a 12.5% aqueous solution of gelatin. The beads were filtered away to obtain a gelatin dispersion of the dye. The average grain size of the fine dye grains was 0.44 μm.

Following the same procedure as above, a solid dispersion ExF-4 was obtained. The average grain size of the fine dye grains was 0.45 μm.

The oil-soluble dye 1 added to the 11th layer was prepared by a method described in examples of JP-A-6-175289. That is, a dye powder was dissolved in a solvent mixture of ethyl acetate and HBS-1 (tricresyl phosphate), and the solution was dispersed by emulsification in an aqueous gelatin solution by using a colloid mill. In this emulsification dispersion, a surfactant (W-6) was used.

The sample formed as described above will be referred to as a sample 101.

Formulas and the like of compounds used in this example will be presented below.

ExC-1
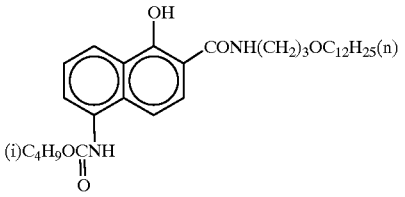
ExC-2
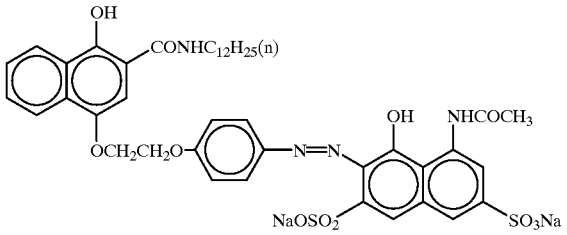
ExC-3
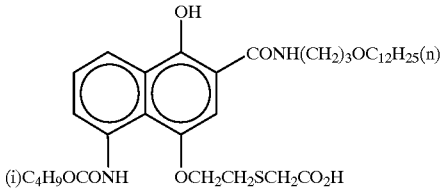
ExC-4
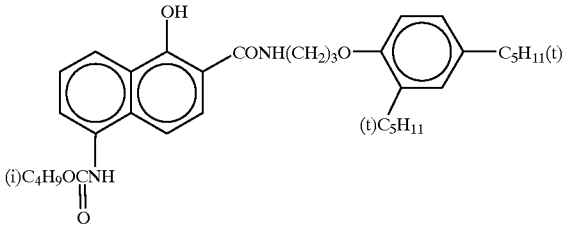
ExC-5
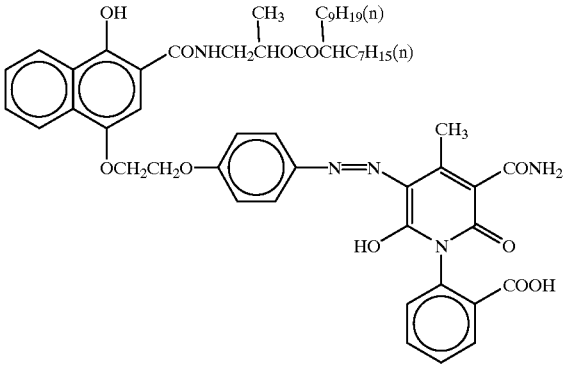
ExC-6
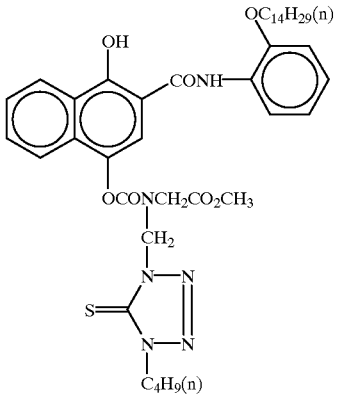
ExC-7
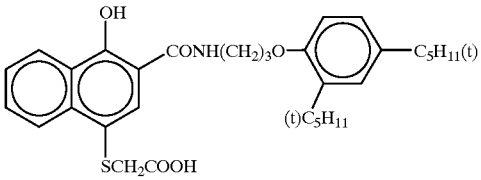
ExC-8
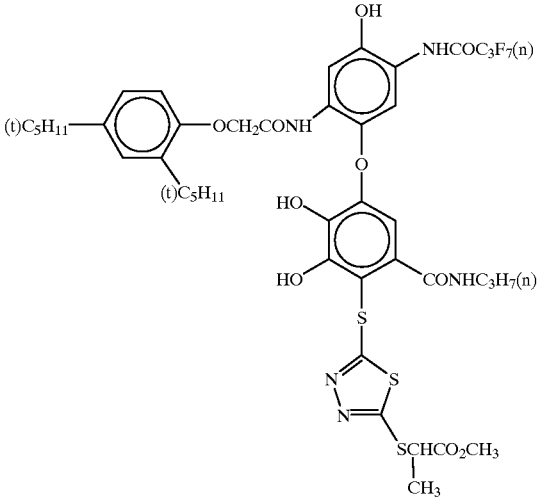

-continued
ExM-1
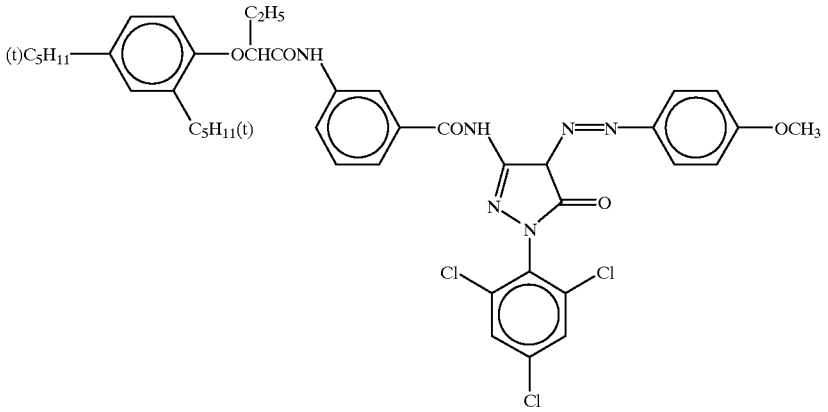
ExM-2
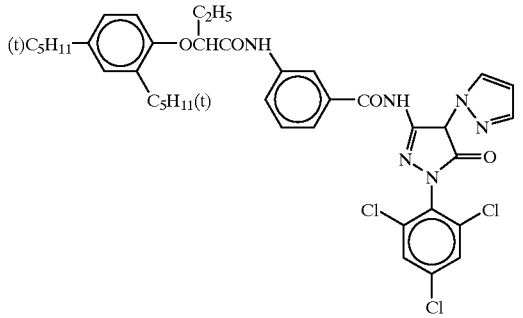
ExM-3
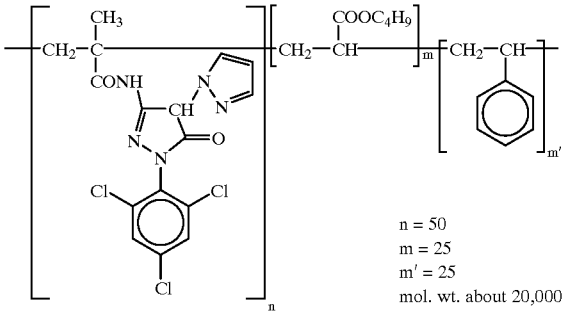
n = 50
m = 25
m′ = 25
mol. wt. about 20,000
ExM-4
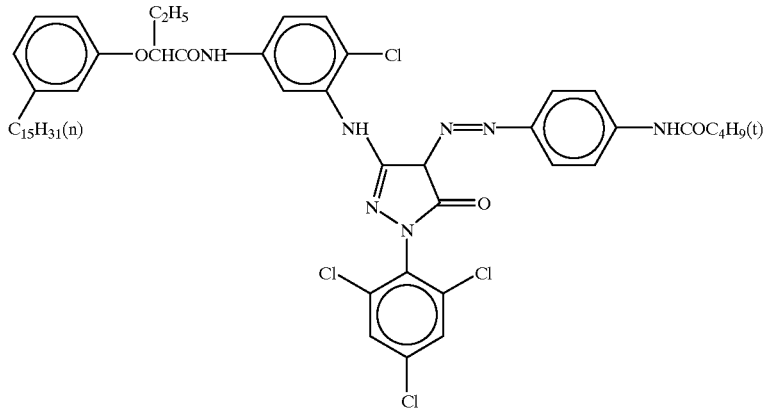
ExM-5
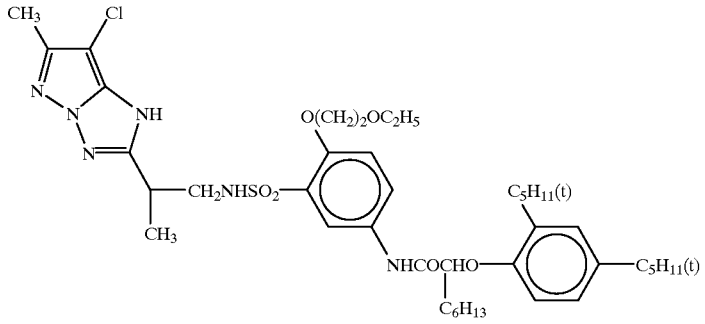

-continued
ExM-6
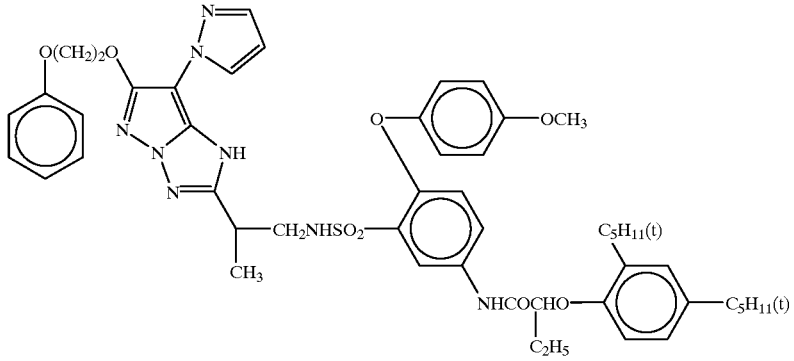
ExY-1
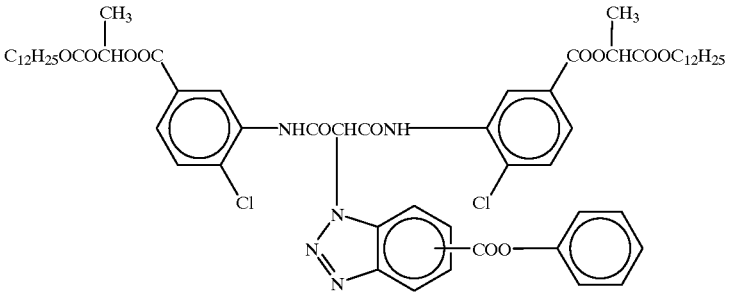
ExY-2
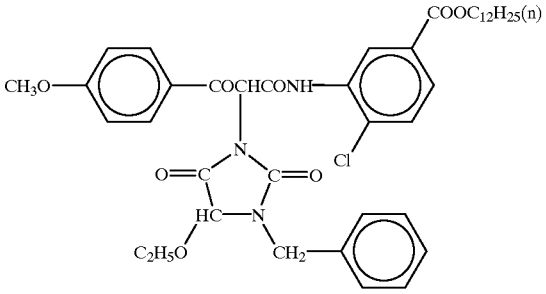
ExY-3
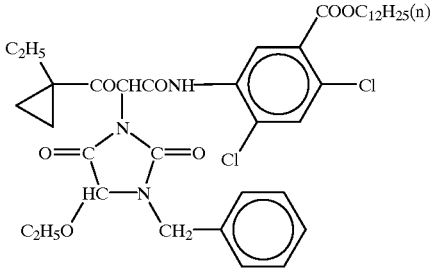
ExY-4
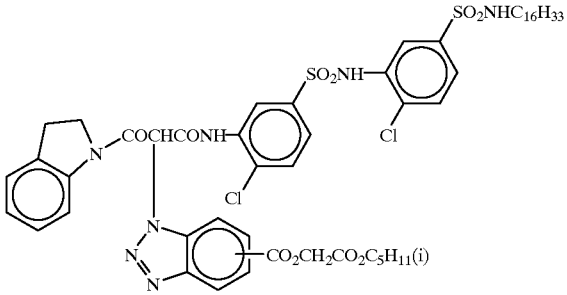
ExY-5
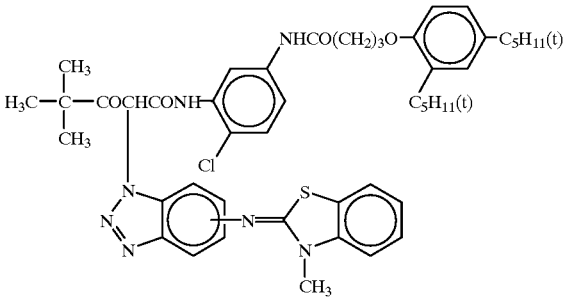

-continued
ExF-1
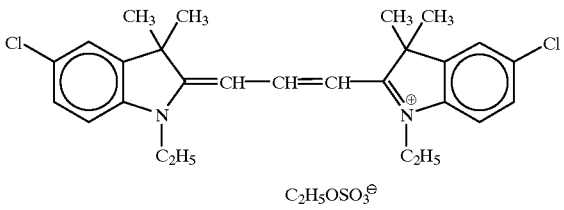
ExF-2
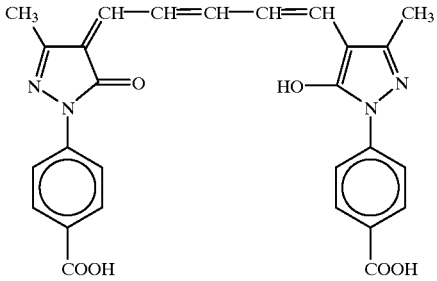
ExF-4
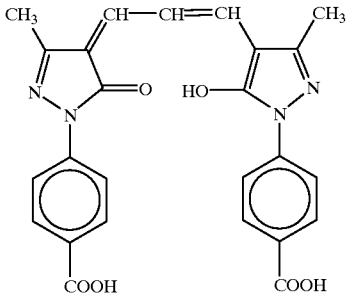
ExF-6
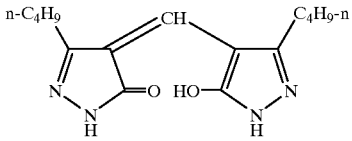
ExF-7
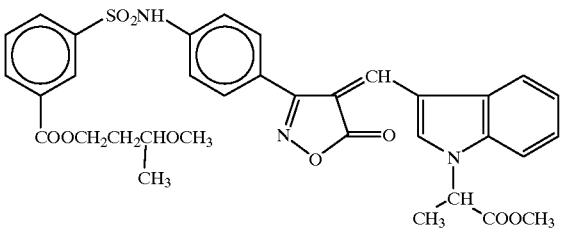
ExF-8
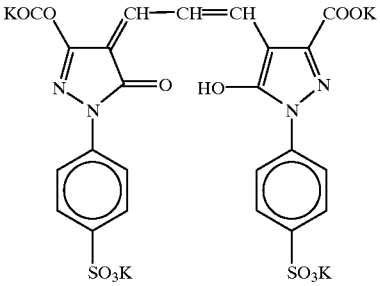
ExF-9
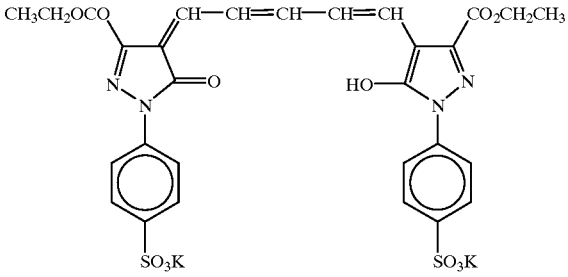
ExF-10
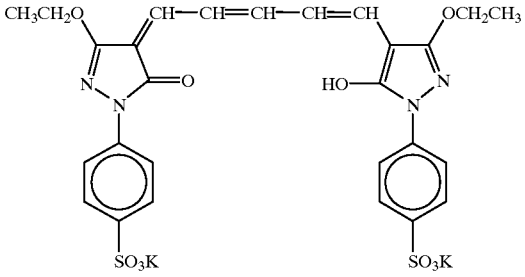
ExF-11
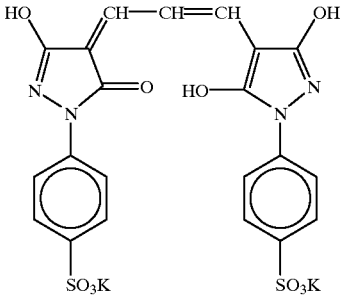
Cpd-1
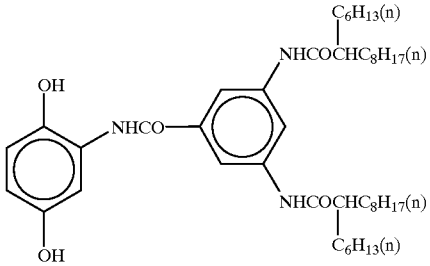

-continued
Cpd-2
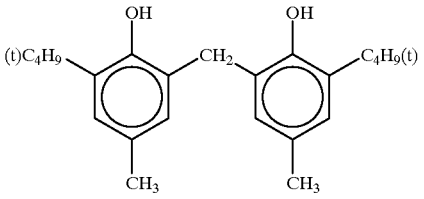
Cpd-3
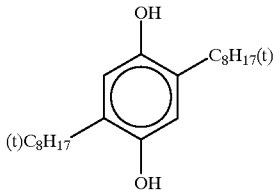
Cpd-4
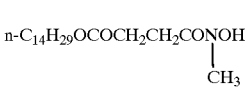
UV-1
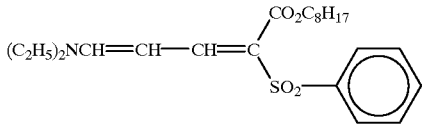
UV-2
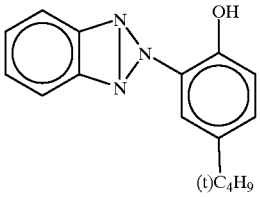
UV-3
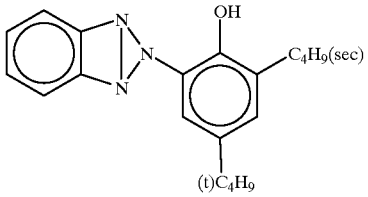
UV-4
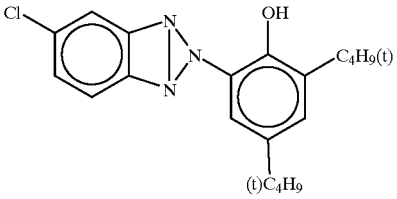
HBS-1
Tricresyl phosphate
HBS-2
Di-n-butyl phtalate
HBS-3
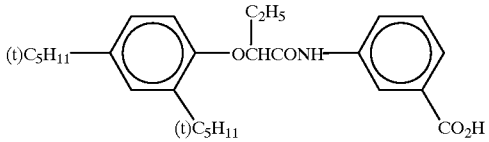
HBS-4
Tri (2-ethylhexyl) phosphate
ExS-1
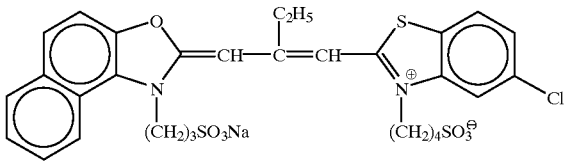
ExS-2
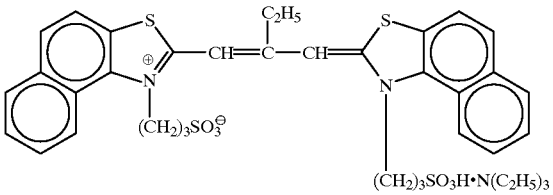
ExS-3
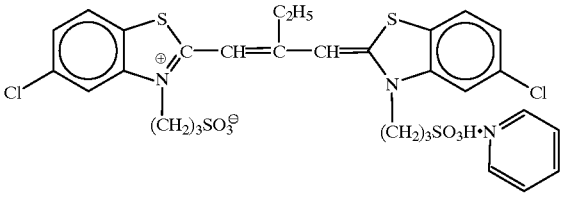
ExS-4
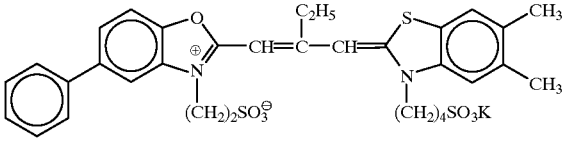
ExS-5
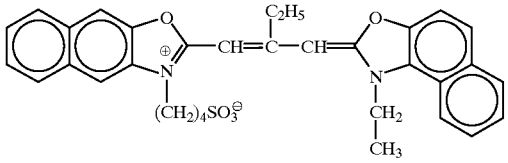

-continued
ExS-6
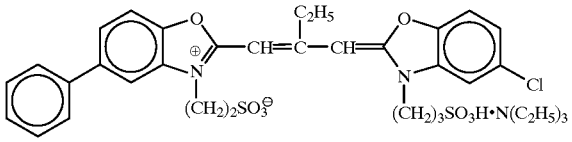
ExS-7
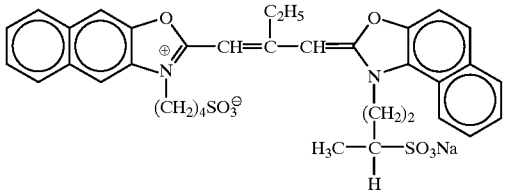
ExS-8
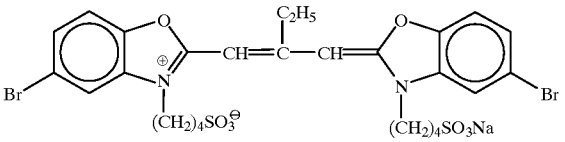
ExS-9
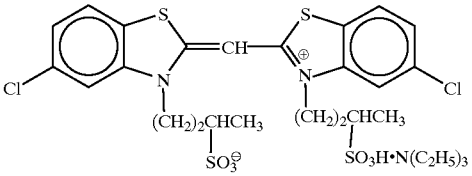
ExS-10
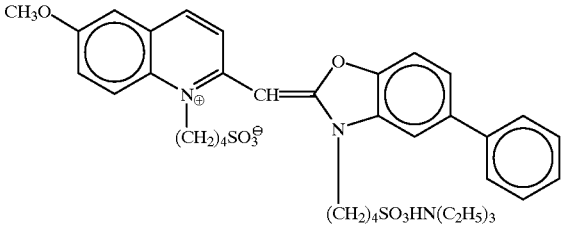
H-1
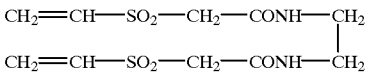
ES-1
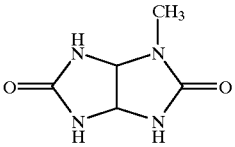
B-1
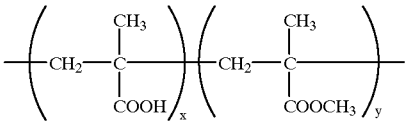
x/y = 10/90 (wt. ratio)
Av. mol. wt.: about 35,000
B-2
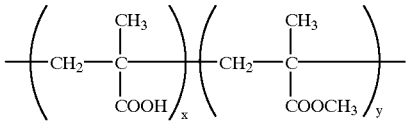
x/y = 45/55 (wt. ratio)
Av. mol. wt.: about 20,000
B-3
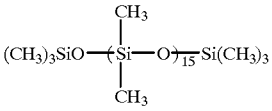
B-4
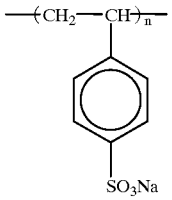
Av. mol. wt.: about 750,000
B-5
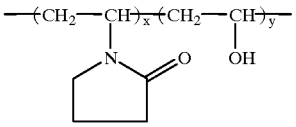
x/y = 70/30 (wt. ratio)
Av. mol. wt.: about 17,000
B-6
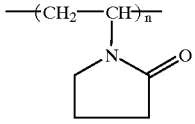
Av. mol. wt.: about 10,000
W-1
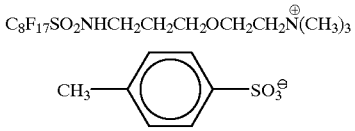

-continued
W-2
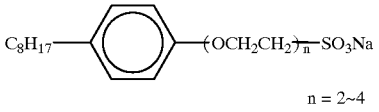
W-3
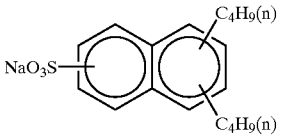
W-6
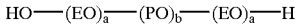
EO: Ethylene oxide residue
PO: Propylene oxide residue
Wt. ratio of propylene oxide = 0.8
Av. mol. wt. = 11,400
F-1
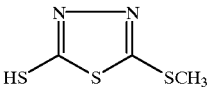
F-2
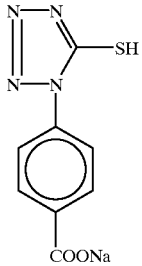
F-3
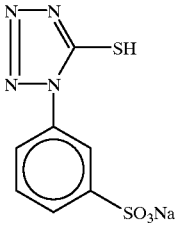
F-4
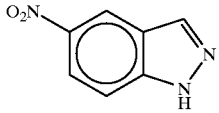
F-5
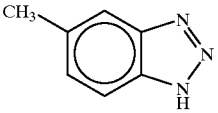
F-6
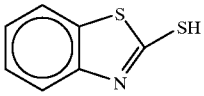
F-7
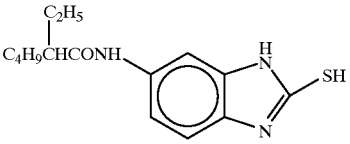
F-8
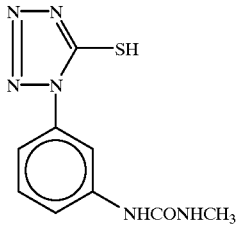
F-9
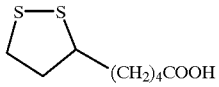
F-10
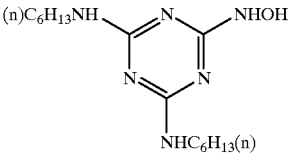
F-11
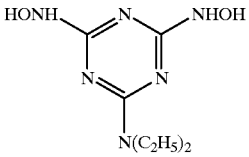
F-12
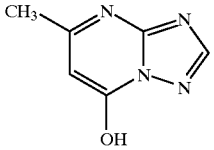
F-13
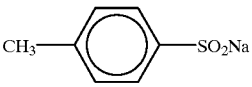
F-14
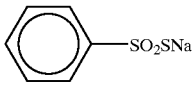
F-15
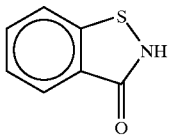

-continued

F-16

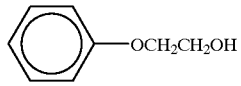

F-17

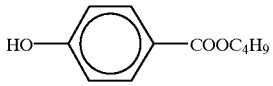

F-18

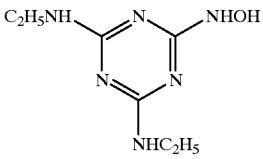

Oil-soluble dye (1) for comparison

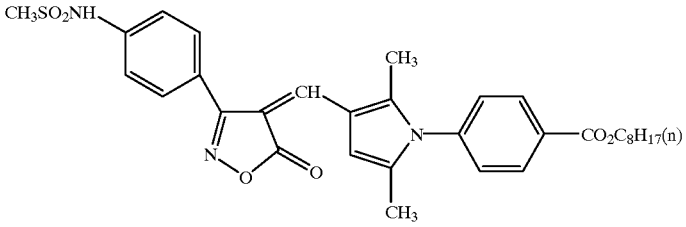

Preparation of Sample 102

Sample 102 was prepared following the same procedures as for the sample 101 except that the layer D (interlayer effect donor layer) formed between the 10th and 11th layers was removed and an identical layer D was formed between the 7th and 8th layers.

That is, the layer D between the 10th and 11th layer was moved to between the 7th and 8th layers.

Preparation of Sample 103

Sample 103 was prepared following the same procedures as for the sample 101, except that the comparative oil-soluble dye (1) added to the 11th layer was removed and instead, 0.20 g/m$^2$ of an organic solid disperse dye DYE-1 prepared by the following method was added to the 11th layer.

<Method of preparing organic solid dye, which is the exemplified dye (1), dispersion>

The dye was dispersed by the following method.

Water and 59.5 g of W-2 were added to 1,400 g of a wet cake containing 15% of water. The resultant material was stirred to form a slurry with a dye concentration of 33%. Next, Ultravisco Mill (UVM-2) manufactured by Imex K.K. was filled with 1,700 mL of zirconium beads with an average grain size of 0.5 mm. The slurry was placed in the mill and milled for 2 hrs with a peripheral speed of about 10 m/sec and a discharge amount of 0.5 L/min.

Preparation of Sample 104

Sample 104 was prepared following the same procedures as for the sample 103, except that the layer D (interlayer effect donor layer) formed between the 10th and 11th layers was removed and an identical layer D was formed between the 7th and 8th layers.

Preparation of Samples 105 & 106

Samples 105 and 106 were prepared following the same procedures as for the sample 104, except that the organic slide disperse dye in the 11th layer was replaced with compounds shown in Table 2. These solid dispersions were prepared in the same manner as for the dye DYE-1. The coating amounts were so adjusted that the sensitivity of a magenta image upon exposure to blue light was equal to that of the sample 104.

Preparation of Samples 107 & 108

Samples 107 and 108 were prepared following the same procedures as for the sample 104, except that the layer D formed between the 7th and 8th layers were removed and an identical layer D was formed in positions shown in Table 2.

Preparation of Sample 109

Sample 109 was prepared following the same procedures as for the sample 104, except that ExC-6 in the 10th layer was replaced with a 7/10 molar amount of D-43 and ExY-1 in the 8th layer was replaced with a 7/10 molar amount of D-43.

Preparation of Sample 110

Sample 110 was prepared following the same procedures as for the sample 104, except that the coating amount of ExC-6 in the 10th layer was changed to 0.4 times of the amount contained in the same layer of the sample 104, and D-43 was added in an amount of 7/10 molar of the thus reduced amount of ExC-6, the coating amount of ExC-6 in the 9th layer was changed to 0.4 times of the amount contained in the same layer of the sample 104, and D-43 was added in an amount of 8/10 molar of the thus reduced amount of ExC-6, and ExY-1 in the 8th layer was replaced with a 7/10 molar amount of D-43.

Preparation of Sample 111

Sample 111 was prepared following the same procedures as for the sample 110, except that D-43 in the 8th, 9th, and 10th layers was replaced with equal molar amounts of D-71.

Preparation of Sample 112

Sample 112 was prepared following the same procedures as for the sample 110, except that D-43 in the 8th, 9th, and 10th layers was replaced with equal molar amounts of D-23.

Evaluation of Changes in Photographic Properties Caused by Processing Solution Variations The samples 101 to 112 thus prepared as above were wedge-exposed to white light and developed by processes A and B.

In the process A (standard conditions), an automatic processor was used to perform running processing with standard replenishment rates by development steps shown below. Development was performed until an accumulated replenisher amount in color development was three times the tank volume of a color development bath. After running equilibrium, development for evaluation was performed.

The sensitive material used in the running processing was the sample 104 that was processed into an APS format and then photographed an object assumed to be standard.

In the process B (worse conditions), running processing was performed following the same procedure as in the process A, except that the replenishment rate in color development was 0.85 times the standard replenishment rate. After running equilibrium, the temperature of the processing solution was set at a standard temperature (38° C.), and left to stand for two weeks without development. The density of each developed sample was measured, and variations of the sensitivity were evaluated by the following calculation Variations of sensitivity=magenta image sensitivity in process B−magenta image sensitivity in process A. Sensitivity for this evaluation is represented by the logarithm of the reciprocal of an exposure amount by which a density of minimum magenta density +0.4 is given.

Processing steps and processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60.0° C. | | |

*The replenishment rate is represented by a value per 1.1 m of a 35-mm wide sample (equivalent to one 24 Ex. film).

The stabilizer and fixer were counter-flowed from (2) to (1), and the overflow of washing water was entirely introduced to the fixing bath (2). Note that the amounts of the developer carried over to the bleaching step, bleaching solution carried over to the fixing step, and fixer carried over the washing step were 2.5 mL, 2.0 mL, and 2.0 mL, respectively, per 1.1 m of a 35-mm wide light-sensitive material. Note also that each crossover time was 6 sec, and this time was included in the processing time of each preceding step.

The aperture area of the processor was 100 $cm^2$ for the color developer, 120 $cm^2$ for the bleaching solution, and approximately 100 $cm^2$ for other processing solutions.

The compositions of the processing solutions are presented below.

| | Tank solution (g) | Replenisher (g) |
|---|---|---|
| (Color developer) | | |
| Diethylenetriamine pentaacetic acid | 3.0 | 3.0 |
| Disodium catechol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonateethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylamine sulfate | 2.4 | 3.3 |
| 2-methyl-4-[N-ethyl-N-β-hydroxyethyl)amino] aniline sulfate | 4.5 | 6.5 |
| Water to make | 1.0 L | 1.0 L |
| pH (controlled by potassium hydroxide and sulfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (controlled by ammonia water) | 4.6 | 4.0 |
| (Fixing (1) tank solution) | | |

A 5:95 (volume ratio) mixture of the above bleaching tank solution and the following fixing tank solution (pH 6.8).

| (Fixing (2)) | Tank solution (g) | Replenisher (g) |
|---|---|---|
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0L | 1.0 L |
| pH (controlled by ammonia water and acetic acid) | 7.4 | 7.45 |
| (Washing water) | | |

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 0.15 g/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononylphenylether (average polymerization degree 10) | 0.2 |
| 1,2-benzoisothiazoline-3-one · sodium | 0.10 |
| Disodium ethylenediaminetetraacetate | 0.05 |
| 1,2,4-triazole | 1.3 |
| 1,4-bis(1,2,4-triazole-1-isomethyl) piperazine | 0.75 |
| Water to make | 1.0 |
| pH | 8.5 |

Variations of the minimum density were evaluated by

Minimum density change (ΔY) of yellow image=minimum density of yellow image in process B minimum density of yellow image in process A Minimum density change (ΔM) of magenta image= minimum density of magenta image in process B−minimum density of magenta image in process A Density valance was evaluated by the value of ΔY−ΔM. That is, the smaller the absolute value the better the minimum density balance. All evaluations of the sensitivity and color reproduction are results of the development in the process A. The sensitivity is represented by the logarithm of the reciprocal of an exposure amount by which a density of minimum magenta image density +0.15 is given.

The color reproduction was evaluated by calculating the principal wavelength of reproduction by using a method described in JP-A-62-160448. That is, a difference ($\lambda-\lambda_0$) between a wavelength $\lambda_0$ of test light and a principal wavelength $\lambda$ of a reproduced color was averaged from 450 to 600 nm by $$\Delta\lambda = \frac{\int_{450}^{600} (\lambda - \lambda_0)d\lambda}{600 - 450}$$

Table 2 shows the result. The test light was spectral light with an excitation purity of 0.7+white light.

The exposure amount was 0.04 lux·sec and 0.01 lux·sec as white light to be mixed. The latter exposure amount is supposed to better represent the characteristics of color reproduction in under-exposure.

The smaller the value of Δλ, the more faithful the color reproduction.

Table 2 shows that the effect of the present invention was obtained when the layer D (interlayer effect donor layer) was closer to the support than the 8th layer. The samples in which the layer D was formed between the 7th and 8th layers were particularly advantageous in color reproduction.

The samples using DIR couplers defined by the present invention were more preferable in that the color reproduction was good and sensitivity variations resulting from processing variations were small. Also, the sensitive materials of the present invention were found to change the sensitivity little during storage from manufacture to photographing.

TABLE 2

| Sample No. | Dye in 11th layer | Position of D layer | DIR coupler in 10th layer | DIR coupler in 9th layer | DIR coupler in 8th layer | Sensitivity* | Reproductivity of color 0.04 | Reproductivity of color 0.01 | ΔY−ΔM | Change in sensitivity during processing | Remarks |
|---|---|---|---|---|---|---|---|---|---|---|---|
| 101 | Oil-soluble dye (1) for comparison | Between 10th and 11th layers | ExC-6 | ExC-6 | ExY-1 | ±0.00 | 2.3 | 4.3 | +0.06 | −0.32 | Comparative Example (Embodiment described in JP-A-6-175289) |
| 102 | Oil-soluble dye (1) for comparison | Between 7th and 8th layers | ExC-6 | ExC-6 | ExY-1 | +0.10 | 1.9 | 4.3 | +0.05 | −0.30 | Comparative Example |
| 103 | Exemplified dye 1 | Between 10th and 11th layers | ExC-6 | ExC-6 | ExY-1 | +0.01 | 2.3 | 4.3 | −0.01 | −0.30 | Comparative Example |
| 104 | Exemplified dye 1 | Between 7th and 8th layers | ExC-6 | ExC-6 | ExY-1 | +0.14 | 1.8 | 4.2 | −0.01 | −0.26 | Invention |
| 105 | Exemplified dye 5 | Between 7th and 8th layers | ExC-6 | ExC-6 | ExY-1 | +0.14 | 1.8 | 4.2 | ±0.0 | −0.26 | Invention |
| 106 | Exemplified dye 24 | Between 7th and 8th layers | ExC-6 | ExC-6 | ExY-1 | +0.14 | 1.8 | 4.2 | −0.01 | −0.26 | Invention |
| 107 | Exemplified dye 1 | Between 6th and 7th layers | ExC-6 | ExC-6 | ExY-1 | +0.14 | 1.9 | 4.2 | −0.01 | −0.25 | Invention |
| 108 | Exemplified dye 1 | Between 3rd and 4th layers | ExC-6 | ExC-6 | ExY-1 | +0.14 | 2.1 | 4.2 | ±0.0 | −0.25 | Invention |
| 109 | Exemplified dye 1 | Between 7th and 8th layers | D-43 | ExC-6 | D-43 | +0.14 | 1.7 | 3.9 | −0.01 | −0.24 | Invention |
| 110 | Exemplified dye 1 | Between 7th and 8th layers | ExC-6 D-43 | ExC-6 D-43 | D-43 | +0.14 | 1.5 | 3.8 | −0.01 | −0.22 | Invention |
| 111 | Exemplified dye 1 | Between 7th and 8th layers | ExC-6 D-71 | ExC-6 D-71 | D-71 | +0.14 | 1.5 | 3.8 | −0.01 | −0.21 | Invention |
| 112 | Exemplified dye 1 | Between 7th and 8th layers | ExC-6 D-23 | ExC-6 D-23 | D-23 | +0.14 | 1.5 | 3.8 | +0.01 | −0.22 | Invention |

*Sensitivity is set forth by relative value to the sensitivity of Sample 101

EXAMPLE 2

Samples were formed following the same procedures as for the samples in Example 1 except that the emulsions A to N were replaced with those shown in Table 3 below. Evaluations were performed in the same manner as in Example 1, and results similar to those in Example 1 were obtained.

TABLE 3

| Emulsion | Average AgI content (%) | Average grain diameter (μm) (Equivalent spherical diameter) | COV of grain diameter (%) | Equivalent circular diameter of projected area (μm) | Diameter/ thickness ratio | Tabularity |
|---|---|---|---|---|---|---|
| A | 1.8 | 0.46 | 15 | 0.60 | 4.0 | 26 |
| B | 4.2 | 0.77 | 23 | 1.05 | 4.5 | 19 |
| C | 4.0 | 1.05 | 19 | 1.50 | 6.5 | 27 |
| D | 7.0 | 0.90 | 20 | 1.20 | 6.1 | 30 |
| E | 1.8 | 0.46 | 15 | 0.56 | 4.4 | 34 |
| F | 3.5 | 0.58 | 22 | 0.80 | 4.8 | 28 |
| G | 8.8 | 0.62 | 25 | 0.80 | 5.5 | 38 |
| H | 8.8 | 0.62 | 22 | 0.80 | 5.5 | 38 |
| I | 4.4 | 0.80 | 23 | 1.01 | 3.8 | 14 |
| J | 1.7 | 0.46 | 15 | 0.5 | 4.2 | 35 |
| K | 8.8 | 0.64 | 23 | 0.85 | 5.2 | 23 |
| L | 3.4 | 0.80 | 18 | 1.09 | 4.0 | 15 |
| M | 5.6 | 1.70 | 15 | 2.50 | 6.6 | 18 |
| N | 1.0 | 0.07 | — | — | 1.0 | — |

EXAMPLE 3

The samples in Examples 1 and 2 were processed into the form of Fuji Film "UTSURUNDESU FLASH". The manufactured films with lens were used to perform photographing and evaluations.

As in Examples 1 and 2, the samples of the present invention presented high print quality, so the effect of improvement of the present invention was obvious.

EXAMPLE 4

Preparation of Sample 401

Sample 401 was prepared following the same procedures as for the sample 102 in Example 1, except that the amounts of the silver iodobromide emulsions G and H in the 9th layer were 0.6 and 0.35 g/m$^2$, respectively, the amount of the silver iodobromide emulsion I in the 10th layer was 1.4 g/m$^2$, and the amounts of ExM-2 and ExM-3 in the 10th layer were 0.07 and 0.041 g/m$^2$, respectively.

Preparation of Samples 402–405

Samples 402 to 405 were prepared following the same procedures as for the sample 401, except that the dye in the 11th layer was replaced with dyes shown in Table 4 below.

The coating amounts were so adjusted that the sensitivity of a magenta image, which is indicated by the logarithm of the reciprocal of an exposure amount by which a density of minimum magenta image density +0.20 was given, upon exposure to blue light was equal to that of the sample 401.

The samples manufactured as above were evaluated in the same manner as in Example 1.

Additionally, in Example 3 the following tests were conducted to evaluate changes in the photographic properties caused by storage from photographing to development.

That is, two groups of the samples were prepared and wedge-exposed to white light. One group was stored in a freezer, and the other group was left to stand for 10 days in 40° C. 60% RH. After that, the samples of the latter group and the samples stored in the freezer were developed. The density of each sample left to stand for 10 days in 40° C. 60% RH was measured with an exposure amount by which a density of minimum magenta image density +1.5 was given to a counterpart sample stored in the freezer, and the two samples were evaluated by the difference. The smaller the difference, the smaller the change of photographic properties from photographing to development.

TABLE 4

| Sample No. | Dye in 11th layer | Change of sensitivity by the processing | Change of photographic characteristics from the time of photographing to the time of development |
|---|---|---|---|
| 401 | Oil-soluble dye (1) for comparison | −0.30 | +0.08 |
| 402 | Exemplified dye 59 | −0.25 | +0.03 |
| 403 | Exemplified dye 69 | −0.24 | +0.03 |
| 404 | Exemplified dye 76 | −0.24 | +0.02 |
| 405 | Exemplified dye 42 | −0.26 | +0.04 |

As is evident from Table 4, effects similar to those in Example 1 were found. Also, the changes in photographic properties from photographing to development were surprisingly small.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photosensitive material comprising, on a support, at least one silver halide emulsion layer (BL) containing a yellow coupler and spectrally sensitized such that a spectral sensitivity region is 400 to 520 nm, at least one silver halide emulsion layer (GL) containing a magenta coupler and spectrally sensitized such that a spectral sensitivity region is 470 to 600 nm, and at least one silver halide emulsion layer (RL) containing a cyan coupler and spectrally sensitized such that a spectral sensitivity region is 540 to 700 nm;

wherein a barycentric sensitivity wavelength ($\lambda_G$) of a spectral sensitivity distribution of GL is 520 nm to 580 nm, a barycentric sensitivity wavelength ($\lambda_R$) of a spectral sensitivity distribution of RL is 590 nm to 650 nm, and a barycentric sensitivity wavelength ($\lambda_B$) of a spectral sensitivity distribution of BL is 430 nm to 485 nm;

the photosensitive material further has an interlayer effect donor layer (DL) by which a barycentric wavelength ($\lambda_{-R}$) of a magnitude distribution of an interlayer effect given to at least one RL at a wavelength of 500 to 600 nm satisfies 500 nm $\leqq\lambda_{-R}\leqq$560 nm, and $\lambda_G-\lambda_{-R}\geqq$5 nm;

and the photosensitive material further has a hydrophilic colloid layer containing at least one dye, in a dispersed state of solid fine grains, selected form the group consisting of dyes represented by formula (1) below and dyes represented by formula (2) below:

$$A1=L-Q \quad (1)$$

wherein A1 represents an acidic nucleus; Q represents an aryl group or aromatic heterocyclic group; and L represents a methine group; and $$A2=L-A3 \quad (2)$$

wherein each of A2 and A3 represents an acidic nucleus; and L represents a methine group; and wherein the support is coated, in order from the support, with RL, DL, GL, and the hydrophilic colloid layer.

2. The photosensitive material according to claim 1, wherein the photosensitive material further has at least one compound selected from the group consisting of a compound presented by formula (DI) below and a compound represented by formula (D2) below:

$$A-X \quad (D1)$$

$$A'-B-X \quad (D2)$$

wherein A represents a group which releases X by reacting with an oxidized form of a developing agent and generates a processing solution-soluble or noncolor-forming compound; A' represents a coupler moiety capable of coupling with the oxidized form of a developing agent; B represents a linking group having an electrophilic portion and capable of releasing X, along with forming a ring and without forming a dye, by intramolecular nucleophilic substitution between the electrophilic portion and a nitrogen atom that is originated from the developing agent and that is contained in a product of the reaction of A' with the oxidized form of the developing agent; and X represents a development inhibitor or a precursor moiety thereof.

3. The photosensitive material according to claim 2, wherein the compound that is further contained in the material is represented by the formula (D1).

4. The photosensitive material according to claim 3, wherein A in the formula (D1) is represented by (Cp-8):

(Cp-8)

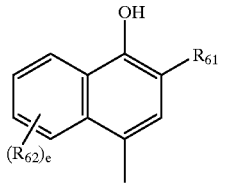

wherein $R_{61}$ represents a hydrogen atom, an alkyl group, an aryl group, or a heterocyclic group; $R_{62}$ represents an alkyl group, an aryl group or a heterocyclic group; and e represents an integer from 0 to 4, when e is an integer of 2 to 4 two or more $R_{62}$'s may be the same or different from each other.

5. The photosensitive material according to claim 2, wherein the compound that is further contained in the material is represented by the formula (D2).

6. The photosensitive material according to claim 5, wherein the compound represented by formula (D2) is represented by formula (IF-2'):

(IF-2')

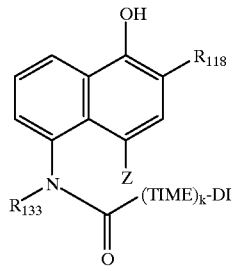

wherein $R_{118}$ represents a substituent; $R_{133}$ represents a hydrogen atom, an aliphatic group, an aryl group or a heterocyclic group; Z represents a hydrogen atom, a halogen atom, $R_{151}$—, $R_{152}O$—, $R_{152}S$—, $R_{152}OCOO$—, $R_{153}COO$—, $R_{153}(R_{154})NCOO$—, or $R_{153}CON(R_{154})$—, wherein $R_{151}$ represents an aliphatic group, $R_{152}$ represents an aliphatic group, an aryl group, or a heterocyclic group, $R_{153}$ and $R_{154}$ each represent a hydrogen atom, an aliphatic group, an aryl group, or a heterocyclic group; TIME represents a timing group capable of releasing DI after it splits off from —C(=O)—, k represents an integer from 0 to 2; and DI represents a development inhibitor.

7. The photosensitive material according to claim 1, wherein the dye is represented by the formula (1).

8. The photosensitive material according to claim 7, wherein the dye is represented by formula (3):

(3)

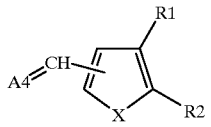

wherein A4 represents an acidic nucleus; X represents an oxygen atom, sulfur atom, or N—Y, wherein Y represents a hydrogen atom, a substituted or unnsubstituted alkyl group, a substituted or unnsubstituted aryl group, or a substituted or unnsubstituted heterocyclic group; and R1 and R2 each represent a hydrogen atom or a substituent, and R1 and R2 may combine with each other to form a condensed ring.

9. The photosensitive material according to claim 7, wherein the dye is represented by formula (4):

(4)

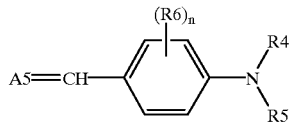

wherein A5 represents an acidic nucleus; R4 and R5 each represent a hydrogen atom, a substituted or unnsubstituted alkyl group, or a substituted or unnsubstituted aryl group; R6 represents a hydrogen atom or a substituent; and n represents an integer from 0 to 4, and when n is an integer from 2 to 4, two or more R6's may be the same or different from each other, and two R6's may combine with each other to form a condensed ring.

10. The photosensitive material according to claim 7, wherein the dye is represented by formula (5):

(5)

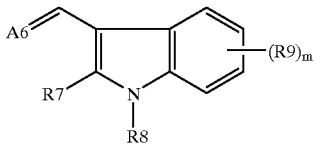

wherein A6 represents an acidic nucleus; R7 represents a hydrogen atom or a substituent; R8 represents a hydrogen atom or an alkyl group; R9 represents a substituent; and m represents an integer from 0 to 4, and when m is an integer from 2 to 4, two or more R9's may be the same or different from each other.

11. The photosensitive material according to claim 1, wherein the dye is represented by the formula (2).

12. The photosensitive material according to claim 11, wherein the dye is represented by formula (6):

(6)

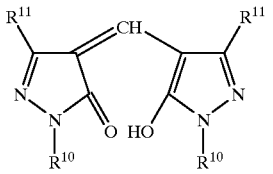

wherein $R^{10}$ represents a hydrogen atom, an alkyl group, or an aryl group; and $R^{11}$ represents an alkyl group or an aryl group.

13. The photosensitive material according to claim 1, wherein a coating amount of the dye is 0.5 $mg/m^2$ to 1000 $mg/m^2$.

14. The photosensitive material according to claim 13, wherein the coating amount is 1 $mg/m^2$ to 600 $mg/m^2$.

15. The photosensitive material according to claim 1, wherein A1 contains at least one dissociative group having a pKa of 3 to 11.

16. The photosensitive material according to claim 1, wherein the dye represented by Formula (1) or (2) is sparingly soluble in water having a pH of 5 to 7.

17. The photosensitive material according to claim 1, wherein the average grain size of the dye represented by Formula (1) or (2) is 0.005 to 10 microns.

18. The photosensitive material according to claim 1, wherein the total film thickness of all hydrophilic colloid layers on the side having emulsion layers is up to 28 microns.

19. The photosensitive material according to claim 1, wherein the dye represented by Formula (1) or (2) has an optical density of 0.05 to 3.0.

* * * * *